US008424939B2

(12) United States Patent
Slack

(10) Patent No.: US 8,424,939 B2
(45) Date of Patent: Apr. 23, 2013

(54) TRI-CAM AXIAL EXTENSION TO PROVIDE GRIPPING TOOL WITH IMPROVED OPERATIONAL RANGE AND CAPACITY

(75) Inventor: Maurice William Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 645 days.

(21) Appl. No.: 12/505,446

(22) Filed: Jul. 17, 2009

(65) Prior Publication Data

US 2009/0273201 A1 Nov. 5, 2009

Related U.S. Application Data

(63) Continuation-in-part of application No. 11/912,665, filed as application No. PCT/CA2006/000710 on May 3, 2006, now Pat. No. 7,909, 120.

(60) Provisional application No. 60/677,489, filed on May 3, 2005, provisional application No. 61/082,117, filed on Jul. 18, 2008.

(51) Int. Cl.
*E21B 31/00* (2006.01)
*E21B 19/10* (2006.01)

(52) U.S. Cl.
USPC ..... 294/86.25; 294/86.3; 294/86.31

(58) Field of Classification Search ..... 294/86.25, 294/86.21, 86.22, 86.23, 86.26, 86.27, 86.3, 294/86.15, 86.31; 175/425; 166/77.52, 77.53
See application file for complete search history.

(56) References Cited

U.S. PATENT DOCUMENTS

| | | | | |
|---|---|---|---|---|
| 1,843,537 | A | 2/1932 | Bickerstaff | |
| 2,028,966 | A * | 1/1936 | Burns et al. | 294/86.21 |
| 2,028,968 | A * | 1/1936 | Carlstrom | 52/249 |
| 2,191,000 | A * | 2/1940 | Thomas | 294/86.17 |
| 2,647,431 | A | 8/1953 | Lewis | |
| 2,953,406 | A * | 9/1960 | Young | 294/86.17 |
| 3,527,494 | A * | 9/1970 | Young | 294/86.25 |
| 3,603,110 | A | 9/1971 | Fredd | |
| 3,697,113 | A | 10/1972 | Palauro | |
| 4,204,910 | A | 5/1980 | Koshkin | |
| 4,320,579 | A | 3/1982 | Kinley | |
| 4,702,313 | A | 10/1987 | Greenlee | |

(Continued)

FOREIGN PATENT DOCUMENTS

| | | | |
|---|---|---|---|
| GB | 2 343 904 | A | 5/2000 |
| WO | 01/59253 | A1 | 8/2001 |
| WO | 02/086279 | A1 | 10/2002 |

OTHER PUBLICATIONS

Extended European Search Report mailed Oct. 14, 2011, issued in corresponding European Application No. EP 06 72 1876, filed May 3, 2006, 6 pages.

*Primary Examiner* — Paul T Chin
(74) *Attorney, Agent, or Firm* — Christensen O'Connor Johnson Kindness PLLC

(57) ABSTRACT

An improvement in a gripping tool having a grip surface carried by movable grip elements and cam linkages to radially move the grip surface from a retracted to an extended position. The improvement involves a tri-cam linkage with cam pairs supporting bi-rotary to axial stroke activation and further cam linkages to cause radial stroke of the tool grip surface as a function of axial stroke.

5 Claims, 70 Drawing Sheets

U.S. PATENT DOCUMENTS

| | | | | |
|---|---|---|---|---|
| 5,085,479 | A * | 2/1992 | Taylor | 294/86.17 |
| 6,155,346 | A | 12/2000 | Aldridge | |
| 6,557,641 | B2 * | 5/2003 | Sipos et al. | 166/380 |
| 6,835,036 | B2 | 12/2004 | Paul | |
| 7,587,873 | B2 | 9/2009 | Mcsherry | |
| 7,909,120 | B2 * | 3/2011 | Slack | 294/86.3 |
| 8,042,626 | B2 * | 10/2011 | Slack | 294/86.3 |
| 2002/0070032 | A1 | 6/2002 | Maguire | |
| 2004/0216924 | A1 | 11/2004 | Pietras | |

* cited by examiner

TRI-CAM AXIAL EXTENSION TO PROVIDE GRIPPING TOOL WITH IMPROVED OPERATIONAL RANGE AND CAPACITY

CROSS-REFERENCES TO RELATED APPLICATIONS

This application is a continuation-in-part of U.S. application Ser. No. 11/912,665, filed Oct. 25, 2007, now U.S. Pat. No. 7,909,120, which is the national stage of PCT/CA2006/000710, filed May 3, 2006, which claims the benefit of U.S. Provisional Application No. 60/677,489, filed May 3, 2005, and also claims the benefit of U.S. Provisional Application No. 61/082,117, filed Jul. 18, 2008, the entire disclosures of which are incorporated herein by reference.

FIELD OF THE INVENTION

This invention relates generally to applications where tubulars and tubular strings must be gripped, handled and hoisted with a tool connected to a drive head or reaction frame to enable the transfer of both axial and torsional loads into or from the tubular segment being gripped. In the field of earth drilling, well construction and well servicing with drilling and service rigs this invention relates to slips, and more specifically, on rigs employing top drives, applies to a tubular running tool that attaches to the top drive for gripping the proximal segment of tubular strings being assembled into, deployed in or removed from the well bore. This tubular running tool supports various functions necessary or beneficial to these operations including rapid engagement and release, hoisting, pushing, rotating and flow of pressurized fluid into and out of the tubular string.

BACKGROUND OF THE INVENTION

Until recently, power tongs were the established method used to run casing or tubing strings into or out of petroleum wells, in coordination with the drilling rig hoisting system. This power tong method allows such tubular strings, comprised of pipe segments or joints with mating threaded ends, to be relatively efficiently assembled by screwing together the mated threaded ends (make-up) to form threaded connections between sequential pipe segments as they are added to the string being installed in the well bore; or conversely removed and disassembled (break-out). But this power tong method does not simultaneously support other beneficial functions such as rotating, pushing or fluid filling, after a pipe segment is added to or removed from the string, and while the string is being lowered or raised in the well bore. Running tubulars with tongs also typically requires personnel deployment in relatively higher hazard locations such as on the rig floor or more significantly, above the rig floor, on the so called 'stabbing boards'.

The advent of drilling rigs equipped with top drives has enabled a new method of running tubulars, and in particular casing, where the top drive is equipped with a so called 'top drive tubular running tool' or 'top drive tubular running tool' to grip and perhaps seal between the proximal pipe segment and top drive quill. (It should be understood here that the term top drive quill is generally meant to include such drive string components as may be attached thereto, the distal end thereof effectively acting as an extension of the quill.) Various devices to generally accomplish this purpose of 'top drive casing running' have therefore been developed. Using these devices in coordination with the top drive allows rotating, pushing and filling of the casing string with drilling fluid while running, thus removing the limitations associated with power tongs. Simultaneously, automation of the gripping mechanism combined with the inherent advantages of the top drive reduces the level of human involvement required with power tong running processes and thus improves safety.

In addition, to handle and run casing with such top drive tubular running tools, the string weight must be transferred from the top drive to a support device when the proximal or active pipe segments are being added or removed from the otherwise assembled string. This function is typically provided by an 'annular wedge grip' axial load activated gripping device that uses 'slips' or jaws placed in a hollow 'slip bowl' through which the casing is run, where the slip bowl has a frusto-conical bore with downward decreasing diameter and is supported in or on the rig floor. The slips then acting as annular wedges between the pipe segment at the proximal end of the string and the frusto-conical interior surface of the slip bowl, tractionally grip the pipe but slide or slip downward and thus radially inward on the interior surface of the slip bowl as string weight is transferred to the grip. The radial force between the slips and pipe body is thus axial load self-activated or 'self-energized', i.e., considering tractional capacity the dependent and string weight the independent variable, a positive feedback loop exists where the independent variable of string weight is positively fed back to control radial grip force which monotonically acts to control tractional capacity or resistance to sliding, the dependent variable. Similarly, make-up and break-out torque applied to the active pipe segment must also be reacted out of the proximal end of the assembled string. This function is typically provided by tongs which have grips that engage the proximal pipe segment and an arm attached by a link such as a chain or cable to the rig structure to prevent rotation and thereby react torque not otherwise reacted by the slips in the slip bowl. The grip force of such tongs is similarly typically self-activated or 'self-energized' by positive feed back from applied torque load.

SUMMARY OF THE INVENTION

Extension linkages are provided for use with a gripping tool in support of extending the radial stroke and work piece sizes that can be accommodated by a given gripping tool that has a grip surface carried by movable grip elements. This involves a tri-cam linkage with cam pairs supporting bi-rotary to axial stroke activation and further cam linkages to cause radial stroke of the tool grip surface as a function of axial stroke.

The tri-cam linkage includes:

- a drive cam body,
- an intermediate cam body,
- a driven cam body,
- a drive cam pair acting between the drive cam body and intermediate cam body, and
- a driven cam pair acting between the intermediate cam body and driven cam body.

It is preferred that the drive cam pair be arranged to only be active to cause axial stroke as a function of rotation under a first direction of rotation and the driven cam pair under the second direction of rotation which separation of bi-rotary activation into two cam pairs facilitates providing greater axial stroke and correlatively radial stroke of the grip surface than is possible where a single cam pair is employed in a bi-rotary activated linkage.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

Externally Gripping (External Grip) Tubular Running Tool Configurations

Internal Gripping (Internal Grip) Tubular Running Tools

Figure 14:
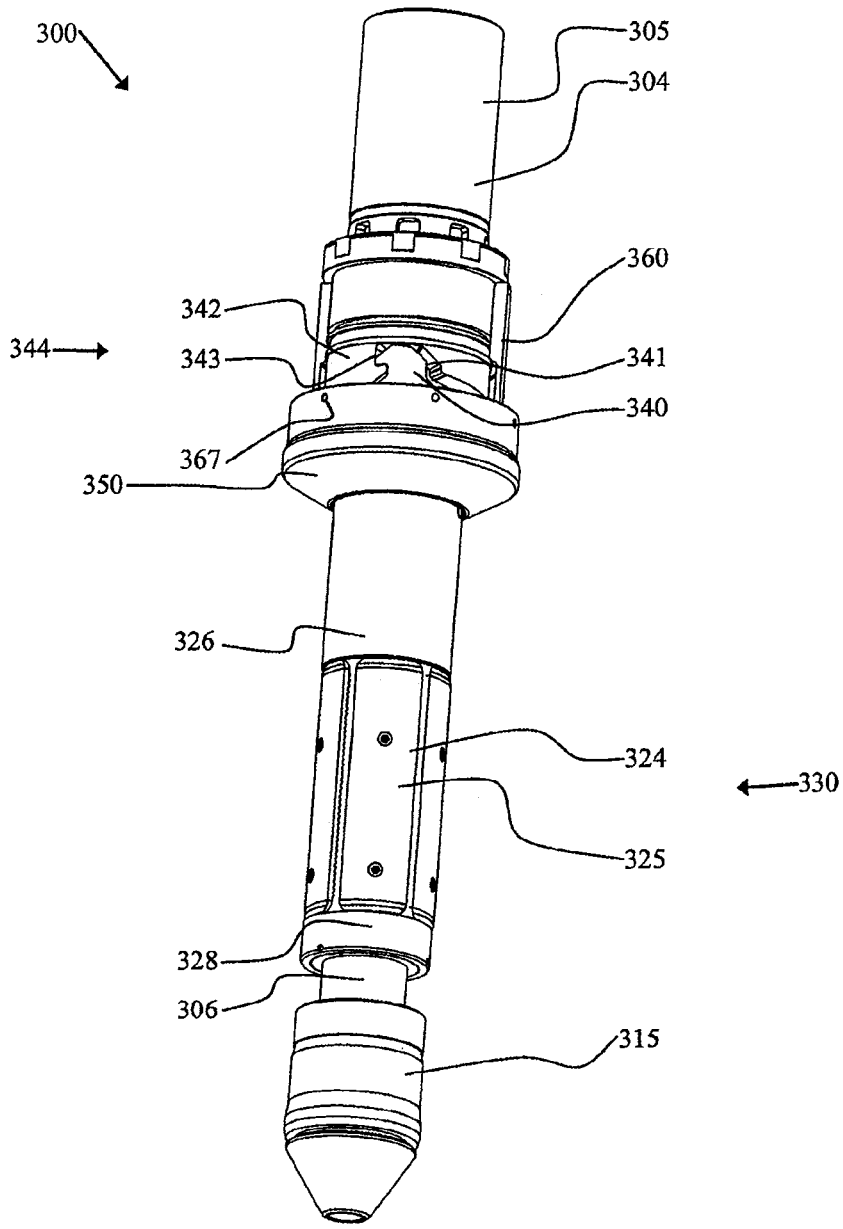

FIG. 14 is a partial cutaway isometric view of a tubular running tool provided with an internal bi-axially activated wedge-grip mechanism in its base configuration architecture (latched position w/o casing).

Figure 15:
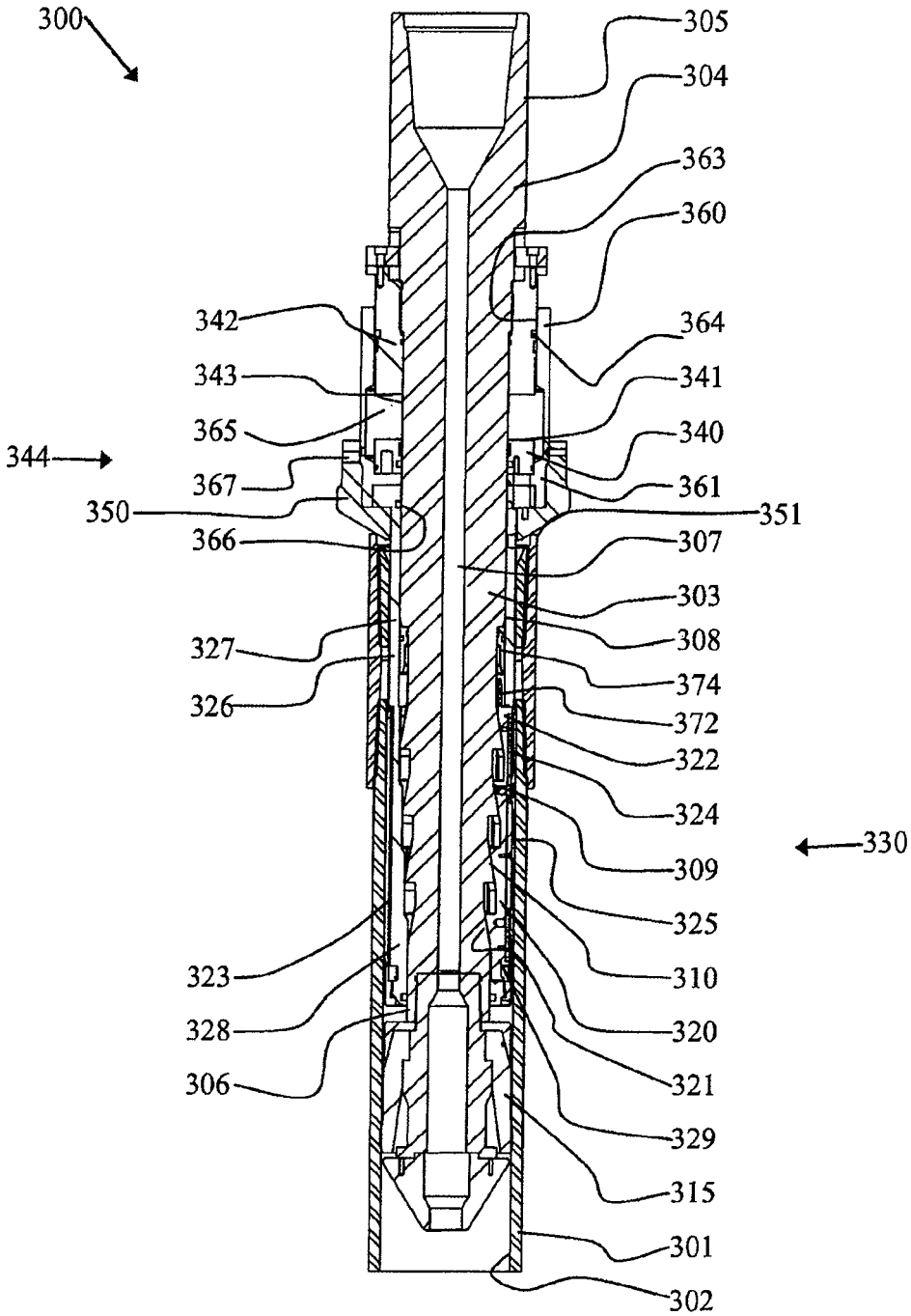

FIG. 15 is a cross-section view of an internal grip tubular rung tool shown in FIG. 14 as it appears set on the proximal end of a threaded and coupled segment of casing.

Figure 16:
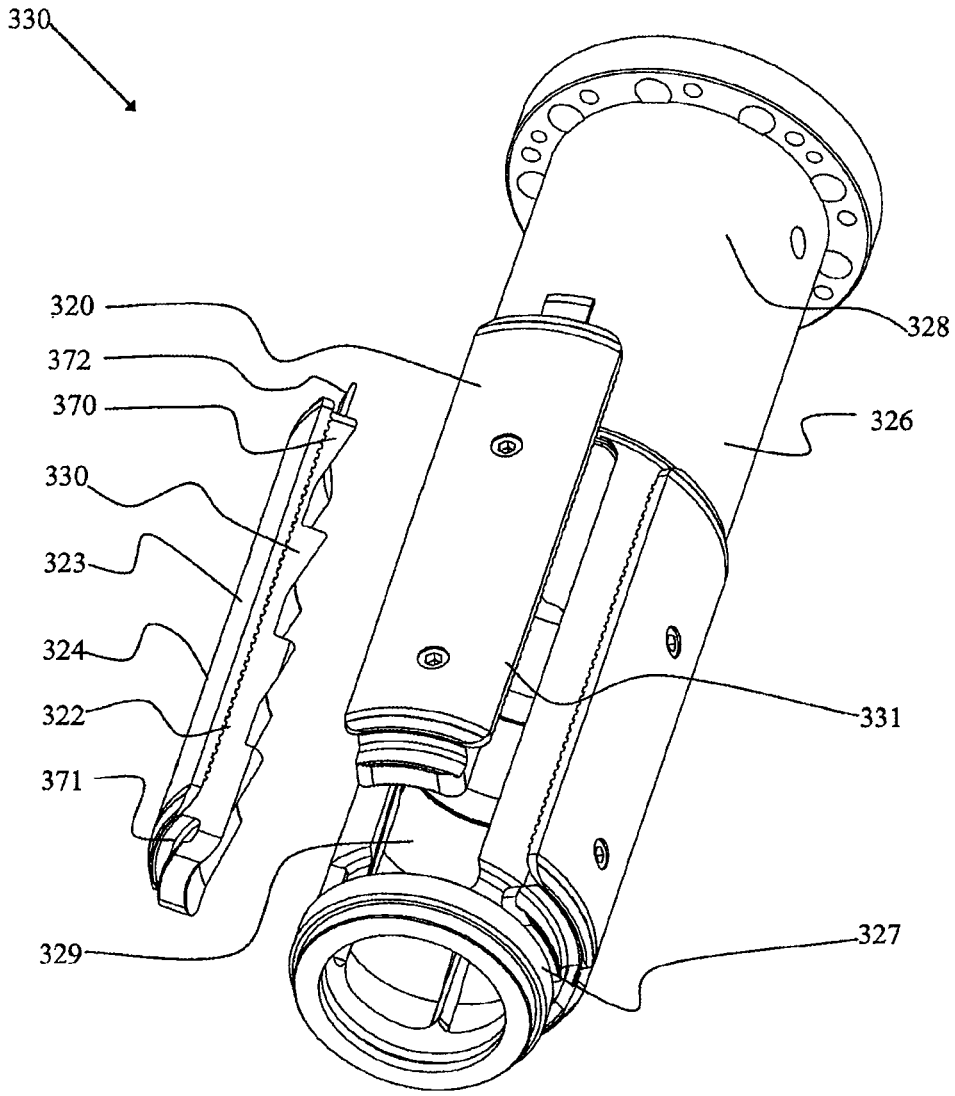

FIG. 16 is an isometric partially exploded view of jaws and cage assembly for internal grip tubular running tool shown in FIG. 14.

Figure 17:
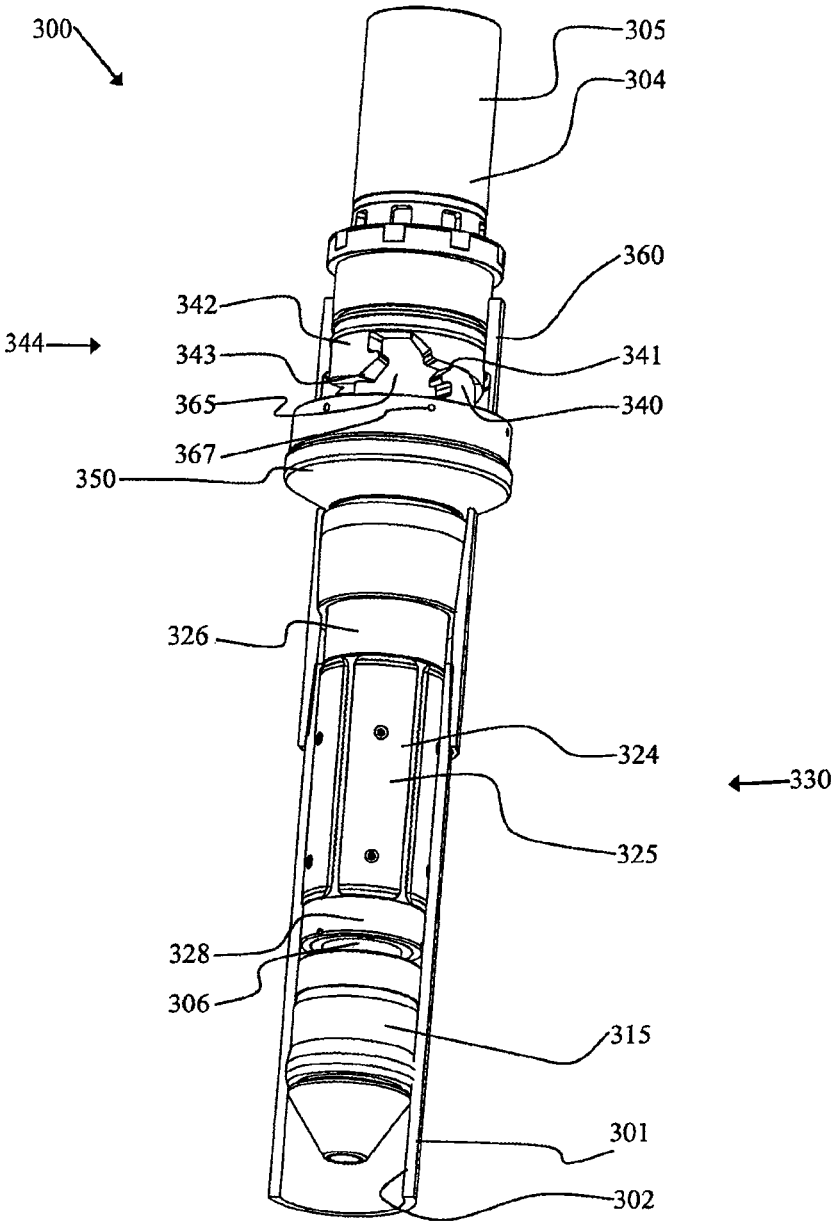

FIG. 17 is a partial cutaway isometric view of the internal gripping tubular running tool shown in FIG. 14 as it appears under torque causing rotation and torque activation.

Figure 18:
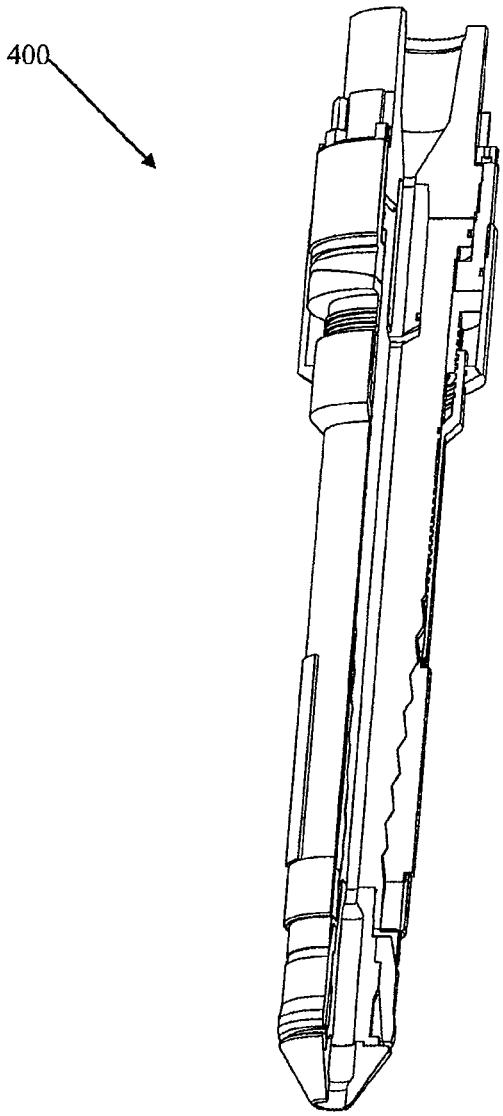

FIG. 18 is a partial cutaway isometric view of an internal gripping tubular running tool configured with a helical wedge grip in its retracted position.

Figure 19:
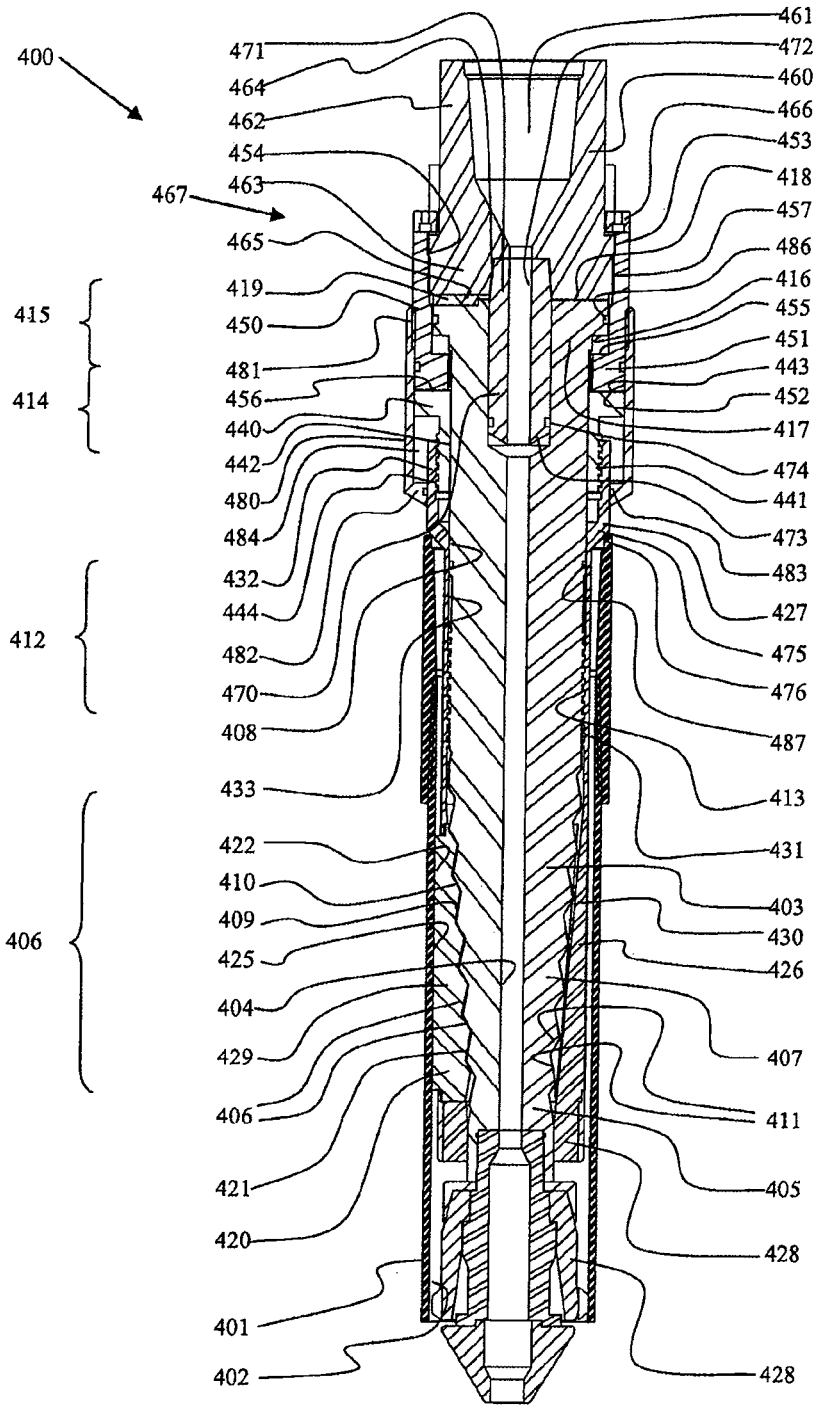

FIG. 19 is a cross section view of the tool shown in FIG. 18 as it appears in its set position gripping the proximal end of a threaded and coupled segment of casing.

Figure 20:
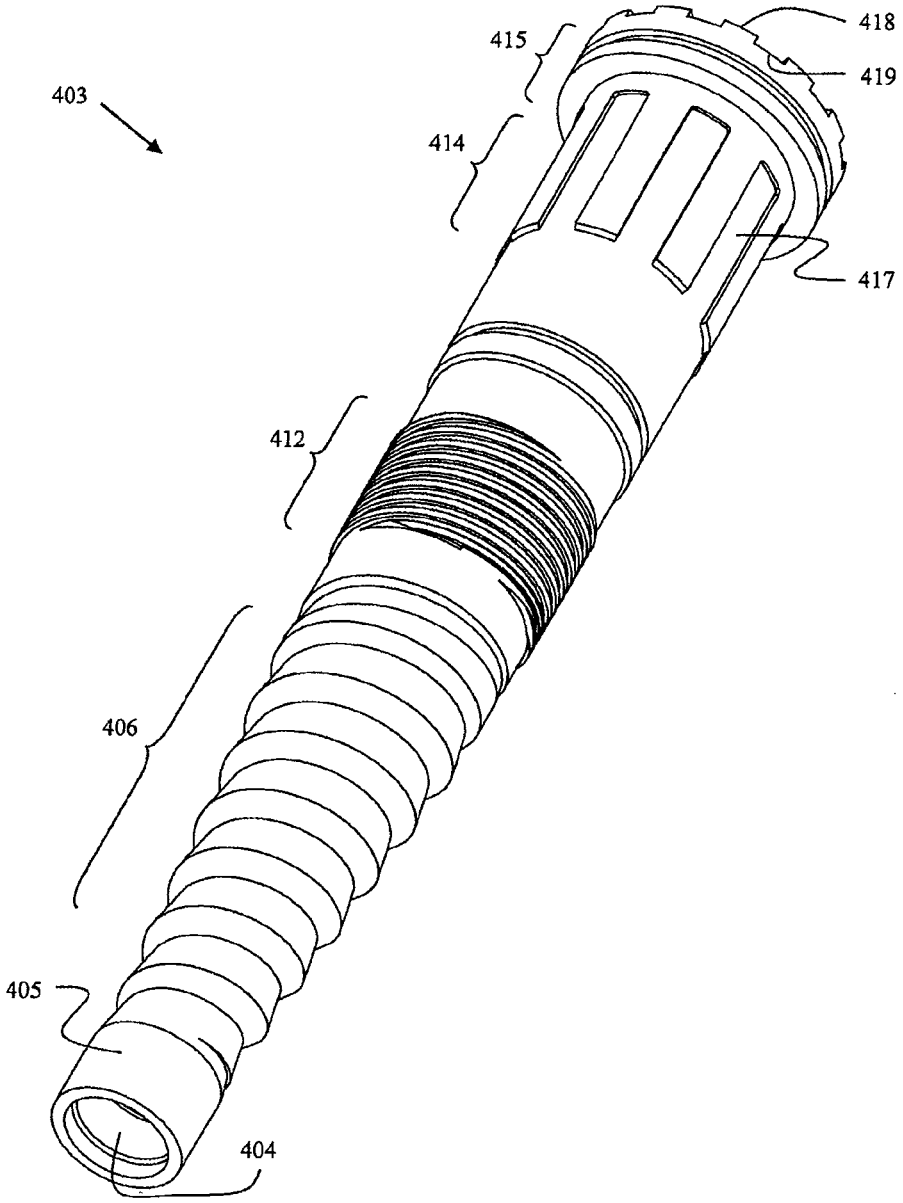

FIG. 20 is an isometric view of the mandrel of the tool shown in FIG. 18 showing the helical wedge grip ramp surfaces.

Figure 21:
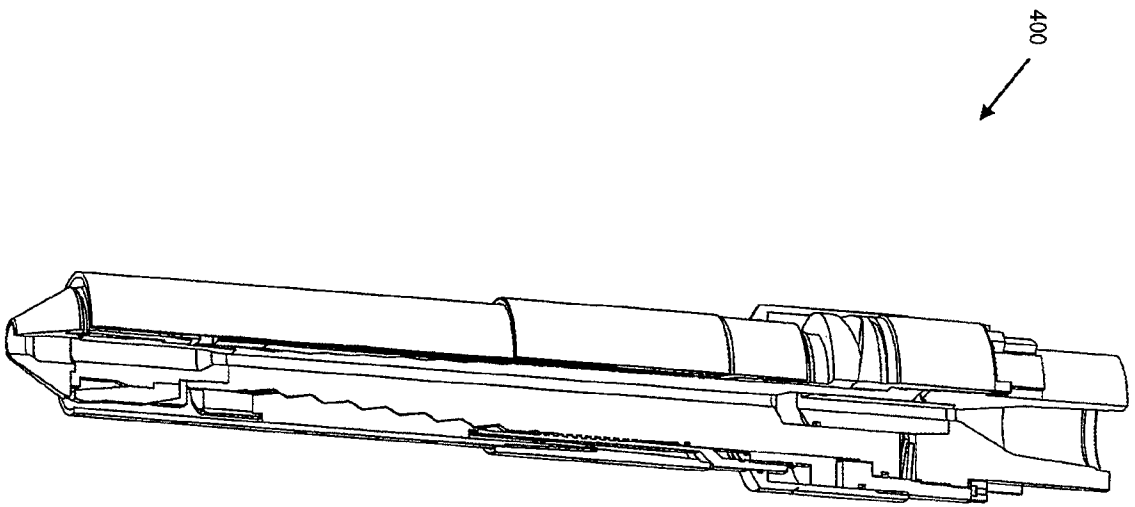

FIG. 21 is a partial cutaway isometric view of the internal grip tubular running tool shown in FIG. 18 as it appears under hoisting and torque load causing rotation and torque activation.

Figure 22:
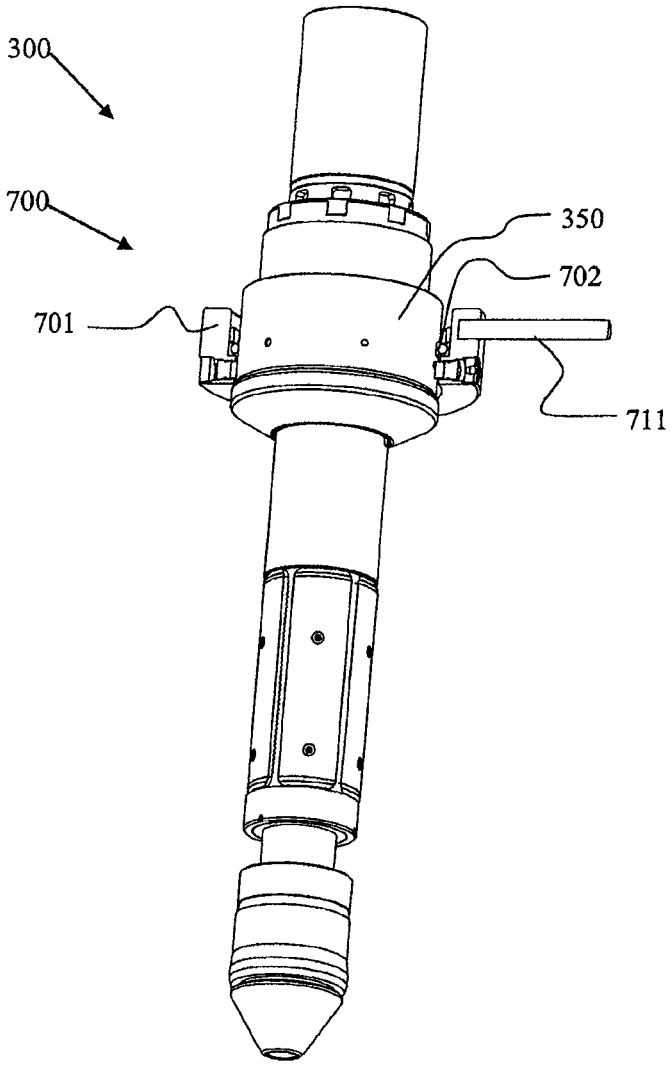

FIG. 22 is a partial cutaway isometric view of the internal grip tubular running tool shown in FIG. 14 incorporating a shaft brake assembly.

Figure 23:
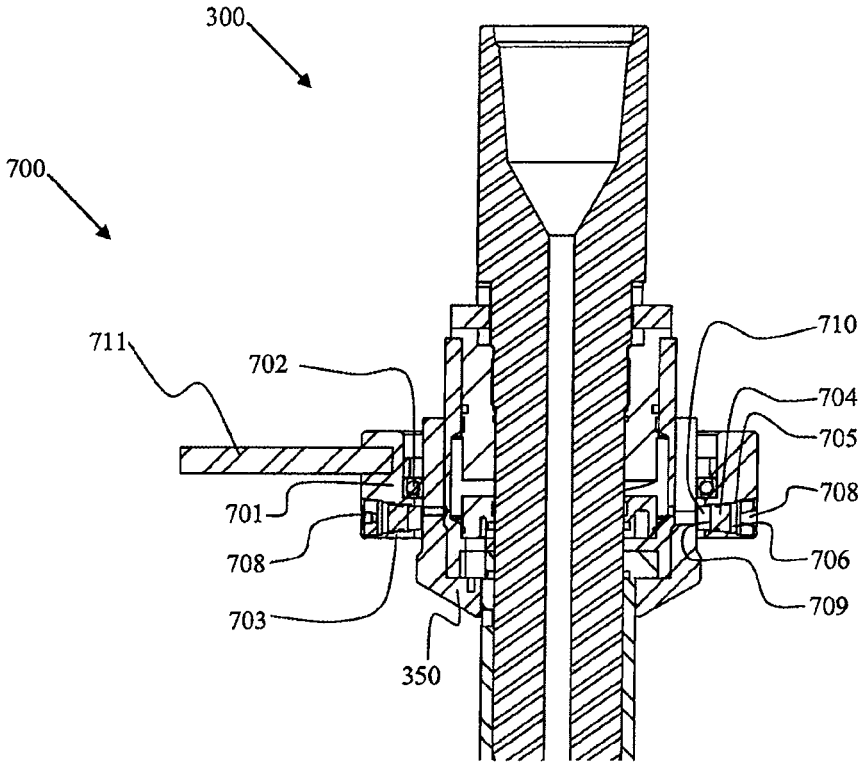

FIG. 23 is a close up cross-sectional view of the shaft brake assembly incorporated in the tool shown in FIG. 22.

Figure 24:
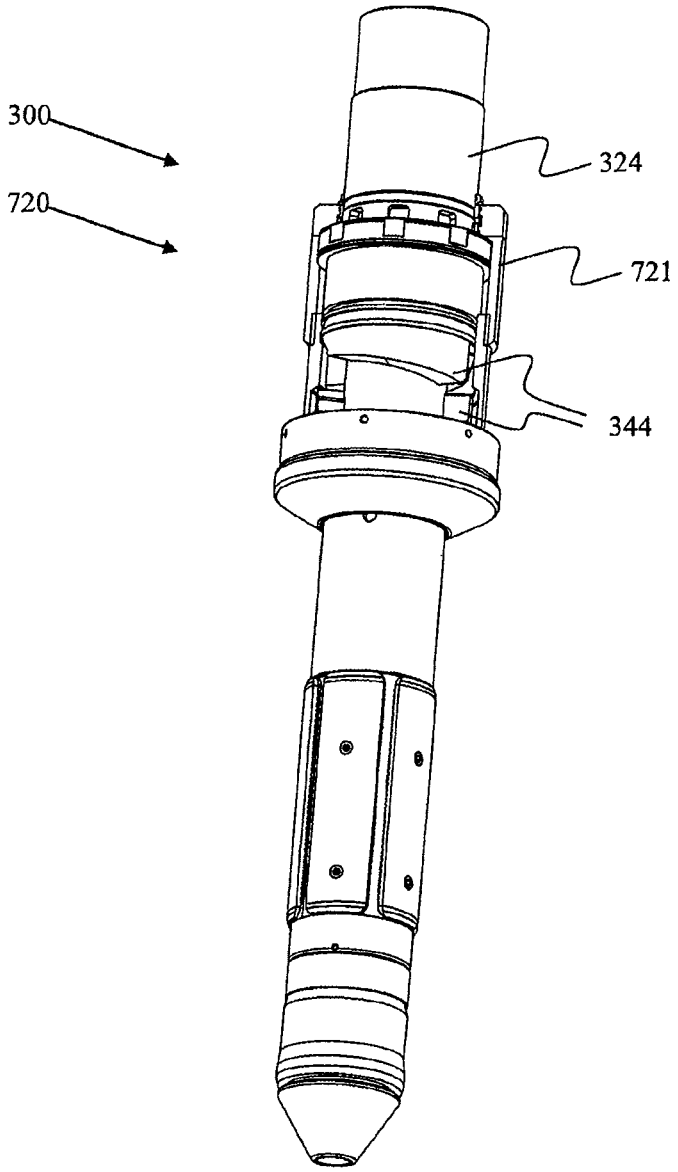

FIG. 24 is a partial cutaway isometric view of the internal grip tubular running tool shown in FIG. 14 incorporating a power retract module with the tool in its set position but not rotated to engage the cams.

Figure 25:
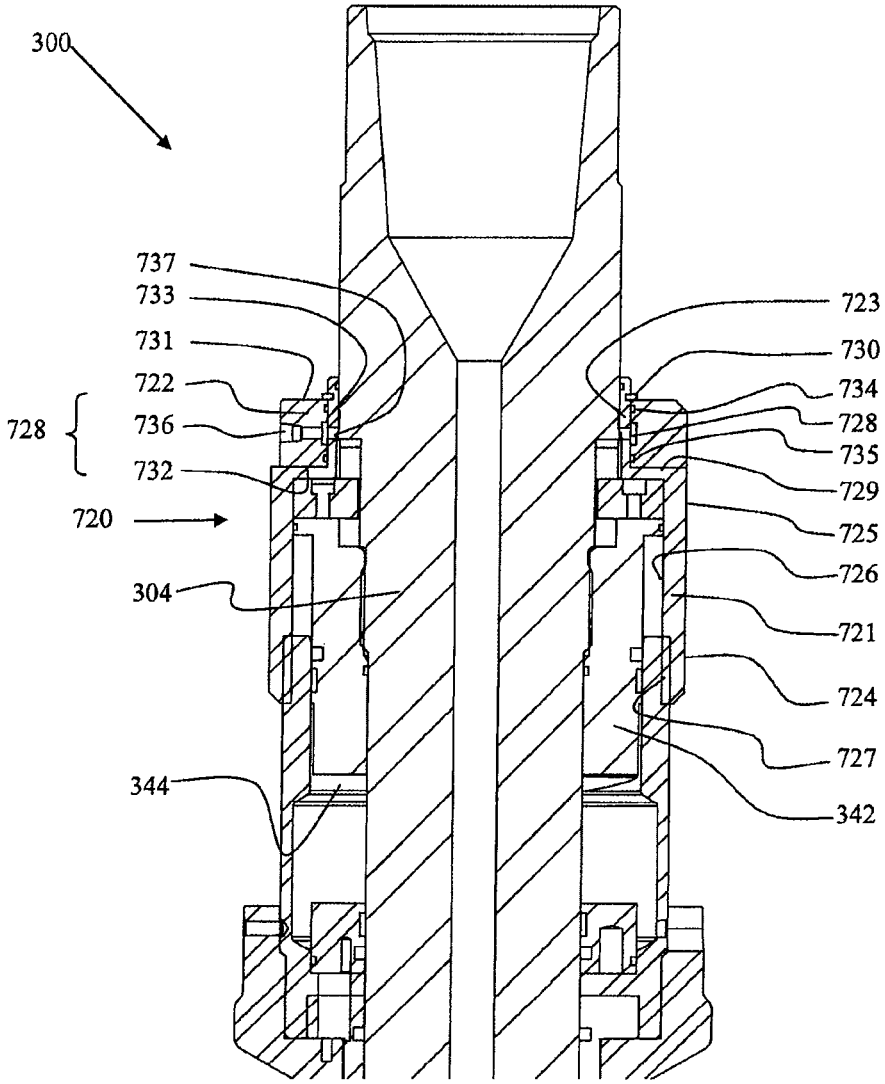

FIG. 25 is a close up cross-sectional view of the power retract module assembly incorporated in the tool shown in FIG. 24.

Figure 26:
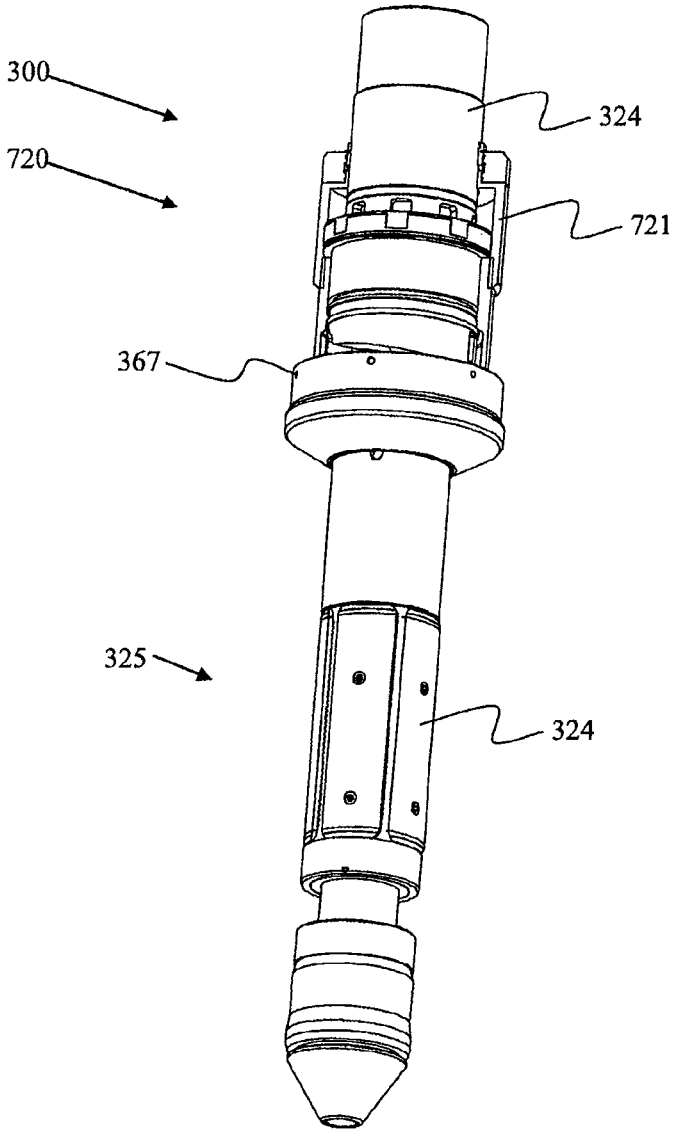

FIG. 26 is a partial cutaway isometric view of the tool shown in FIG. 24 as it would appear with the power retract module extended by application of pressure to hold the tool in its retracted position.

Figure 27:
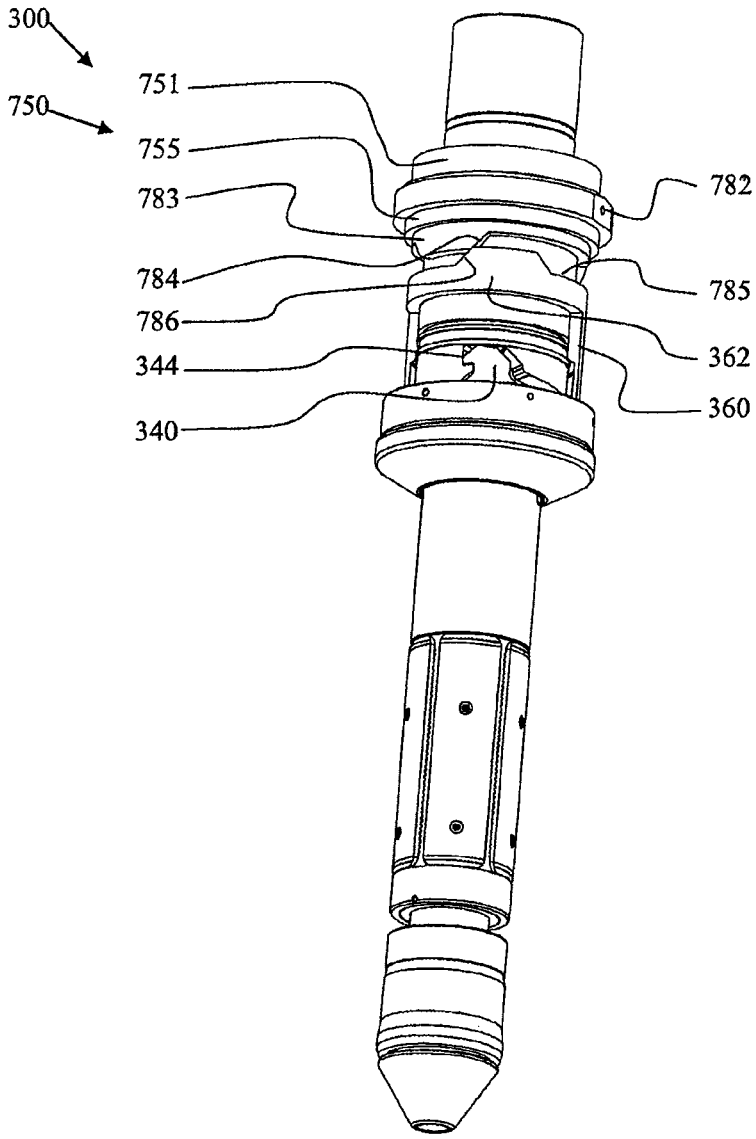

FIG. 27 is a partial cutaway isometric view of the internal grip tubular running tool shown in FIG. 14 incorporating a power release module where the tool is shown as it would appear with the power release module actuator retracted and the tool in its latched position.

Figure 28:
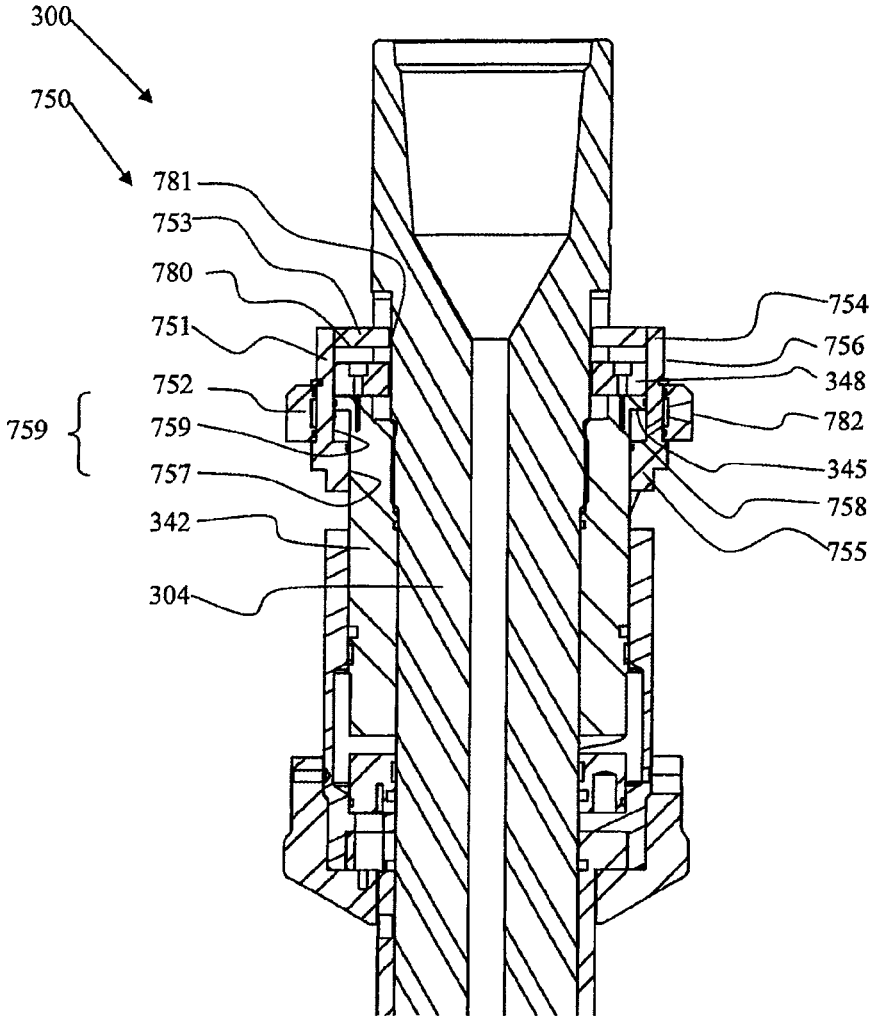

FIG. 28 is a close up cross-sectional view of the power release module assembly incorporated in the tool shown in FIG. 27.

Figure 29:
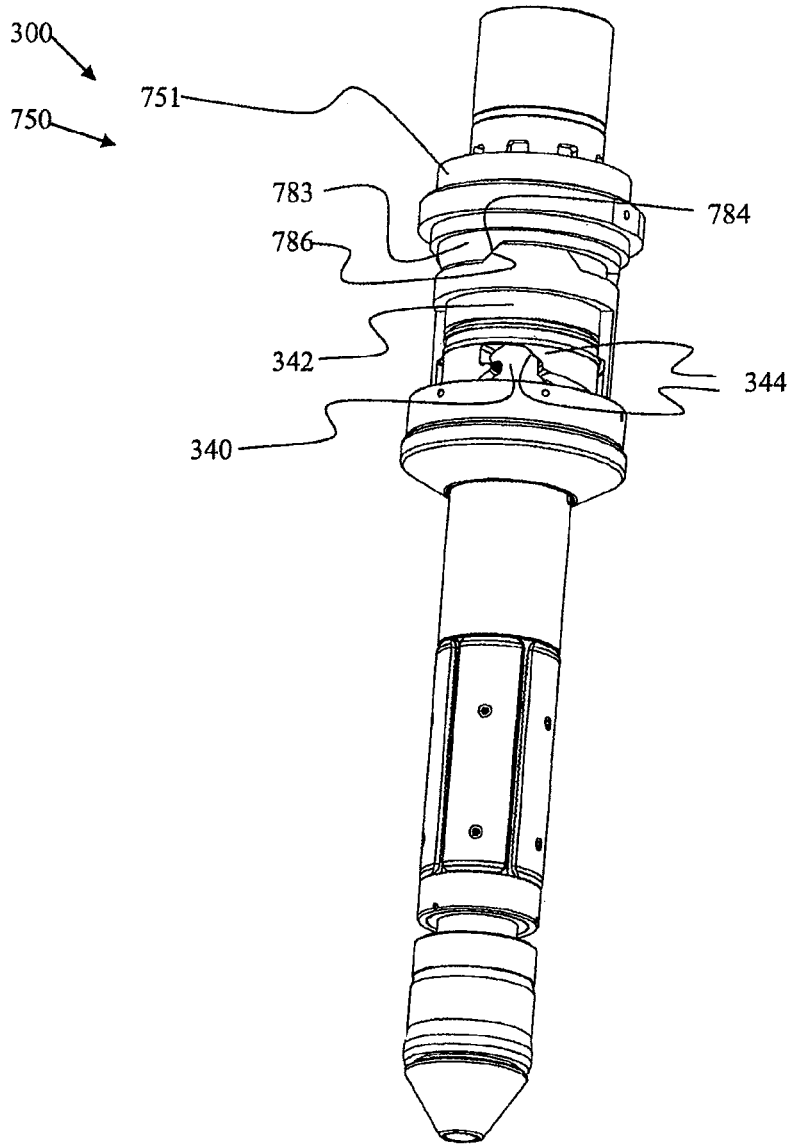

FIG. 29 is a partial cutaway isometric view of the tool shown in FIG. 27 as it would appear with the power release module actuator extended under fluid pressure to unlatch the tool.

External Wedge Grip Tubular Running Tool with Internal Expansive Element

Figure 11A:
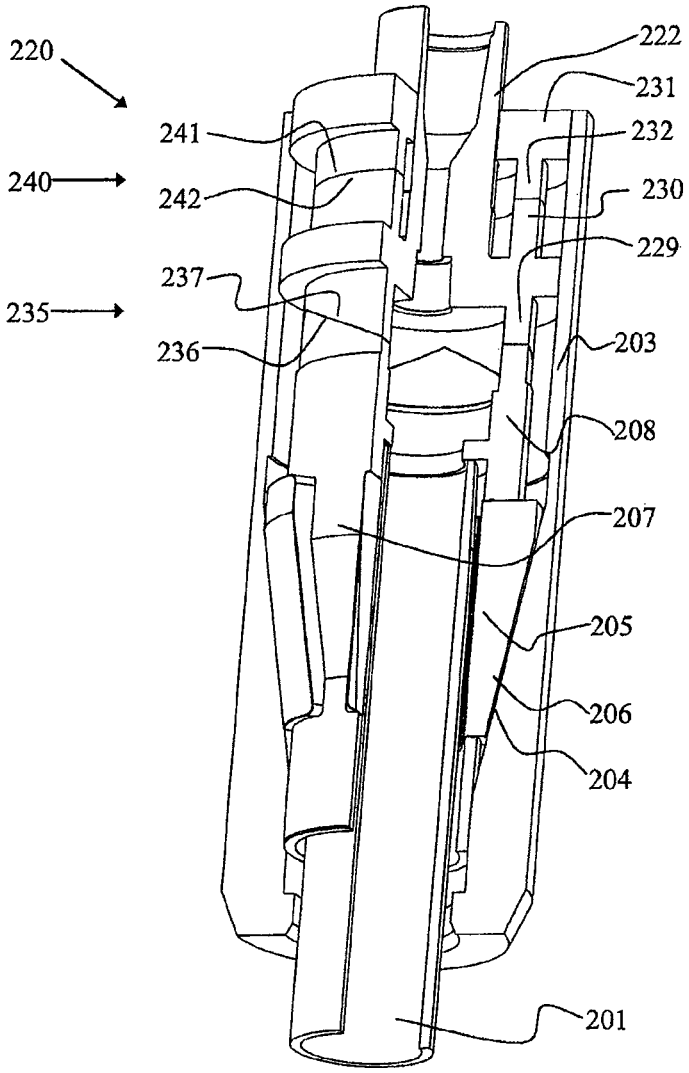
FIGS. 11 A and B are a tubular running tool as shown in FIG. 10A with a flat/cam wedge-grip torque activation architecture, in its unset (retracted) and set positions respectively.
Figure 11B:
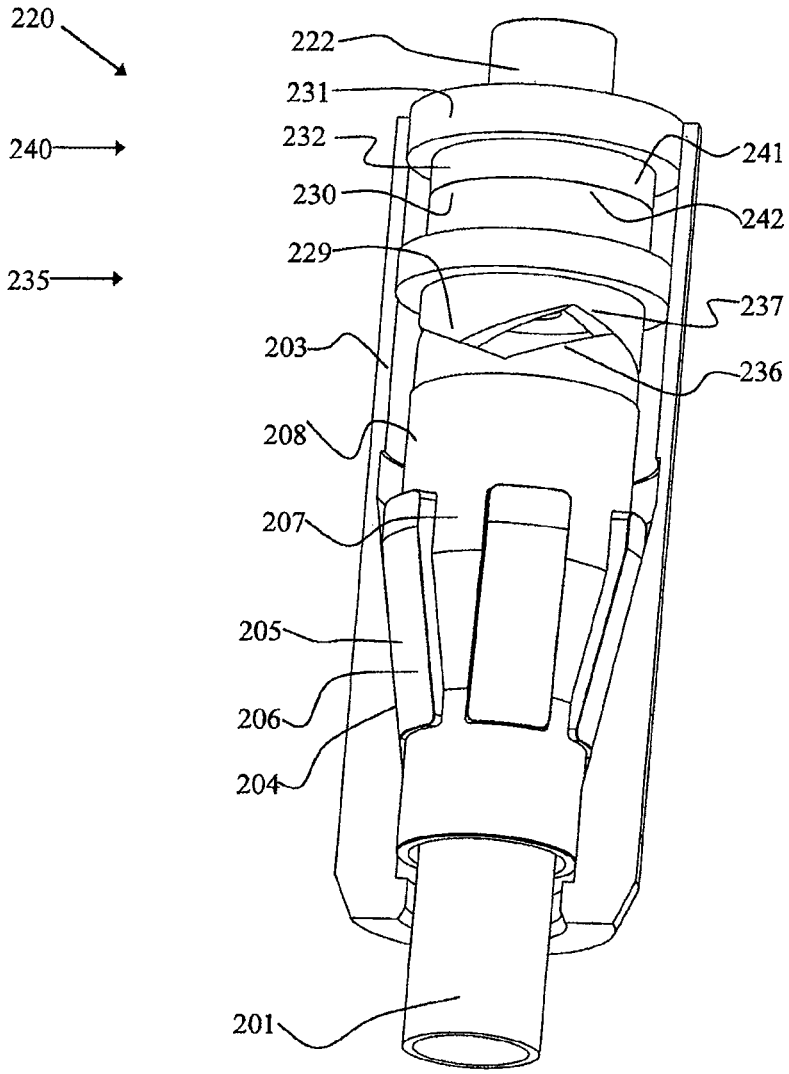
Figure 30:
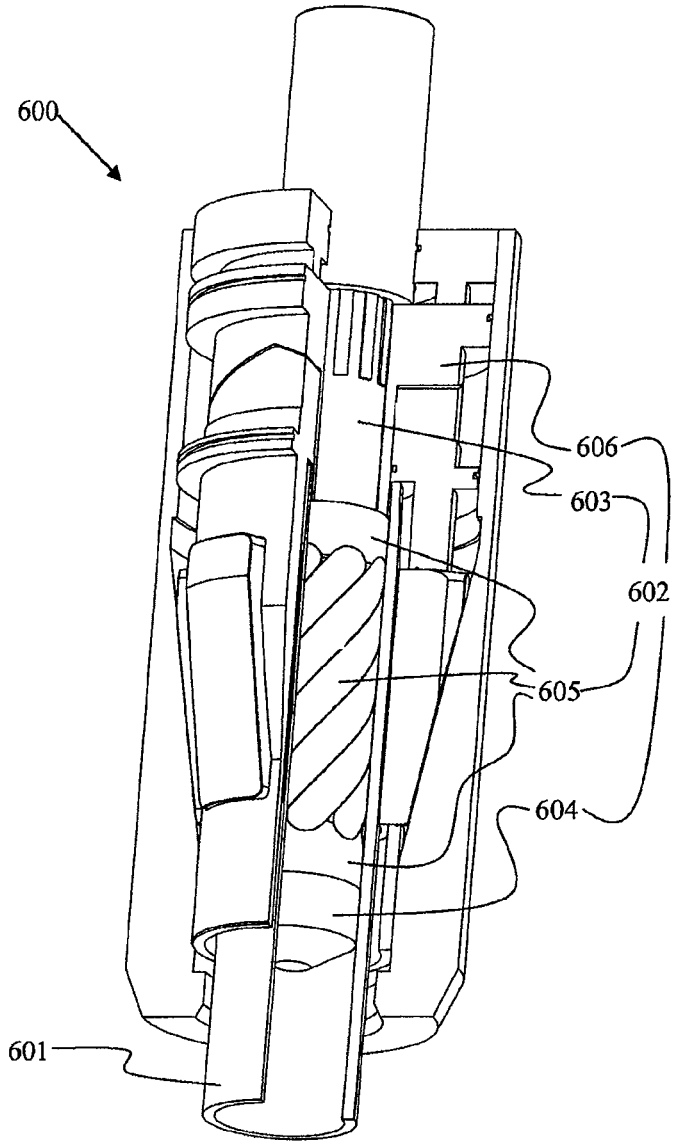

FIG. 30 is a partial cutaway isometric view of the external gripping tubular running tool of FIG. 11 incorporating an internal expansive element and shown stabbed into the proximal end of a tubular work piece as it would appear in its retracted position.

Figure 31:
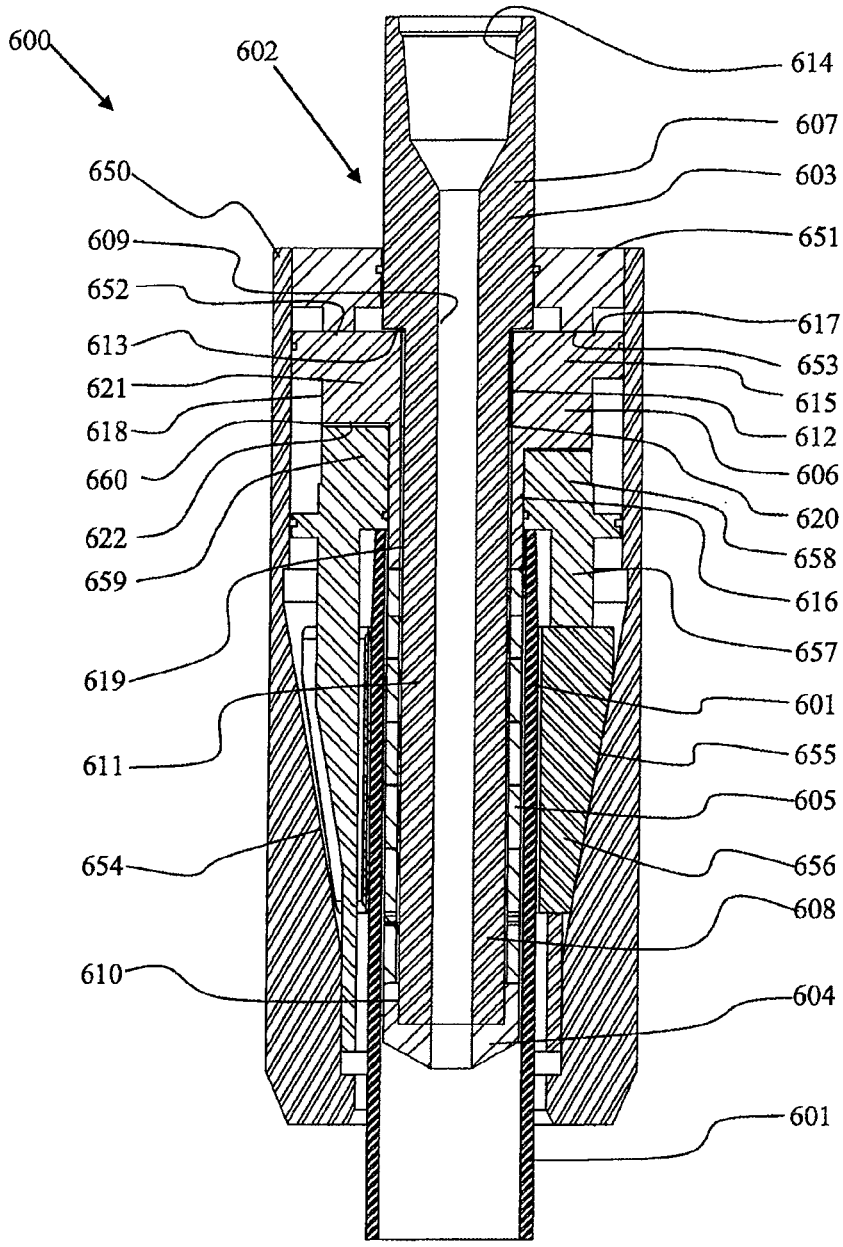

FIG. 31 is a cross-sectional view of the tool shown in FIG. 30.

Figure 32:
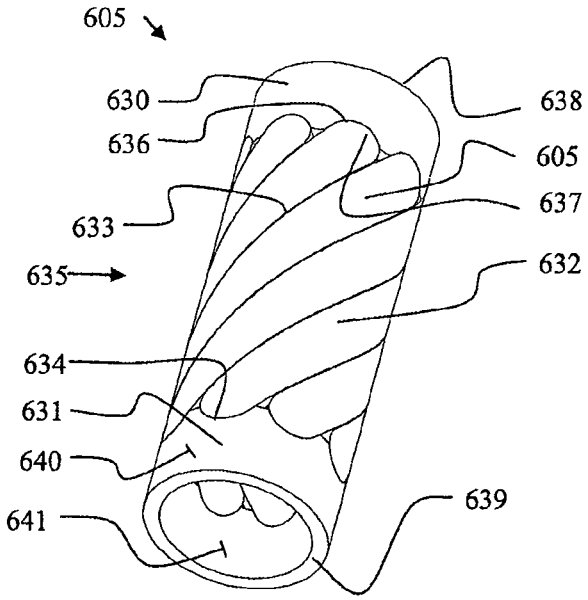

FIG. 32 is an isometric view of the internal expansive element of the tool shown in FIG. 30.

FIG. 33 A is a partial cutaway isometric view of the tool of FIG. 30 shown as it would appear under combined torque and hoisting loads.

Figure 33A:
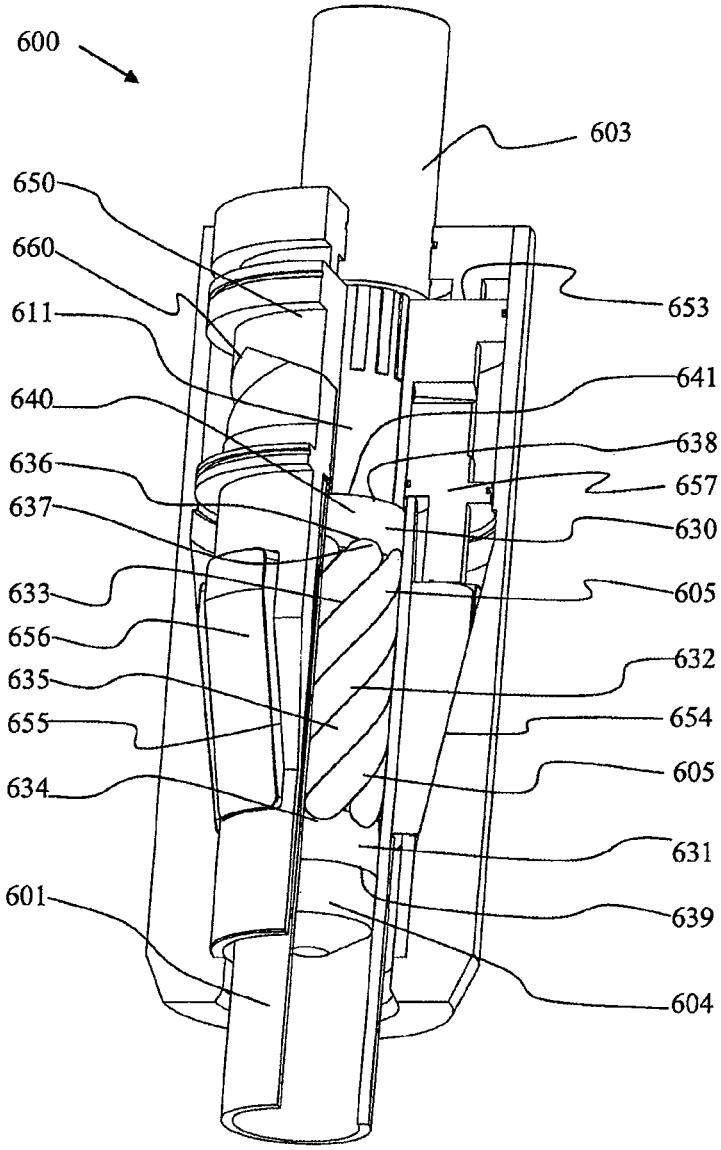

FIG. 33 B is a partial cutaway isometric view of the tool of FIG. 33A configured to provide torque activation of the expansive element and shown as it would appear under combined torque and hoisting loads.

Rig Floor Reaction Tool (Torque Activated Slips)

Figure 34:
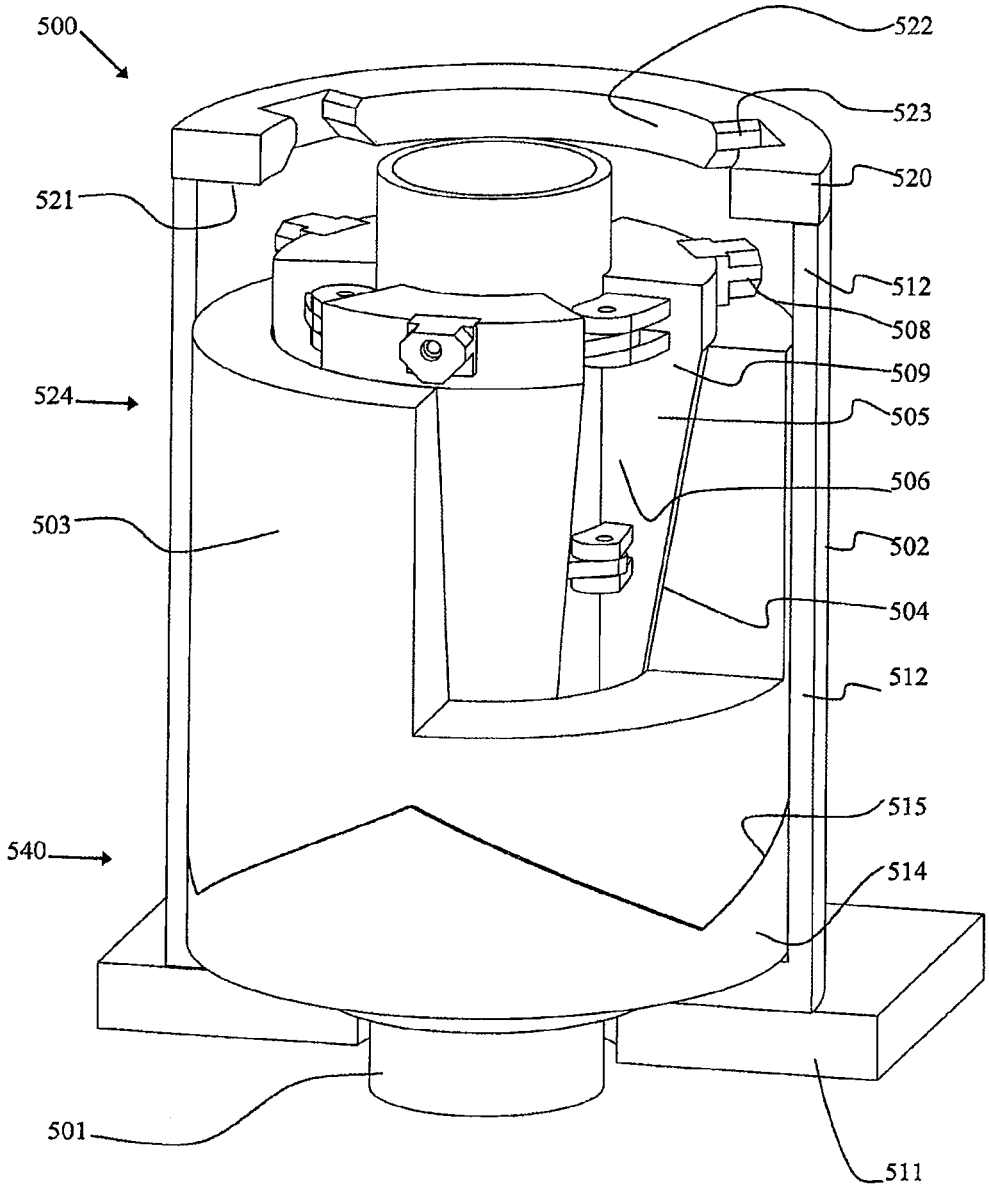
Figure 35:
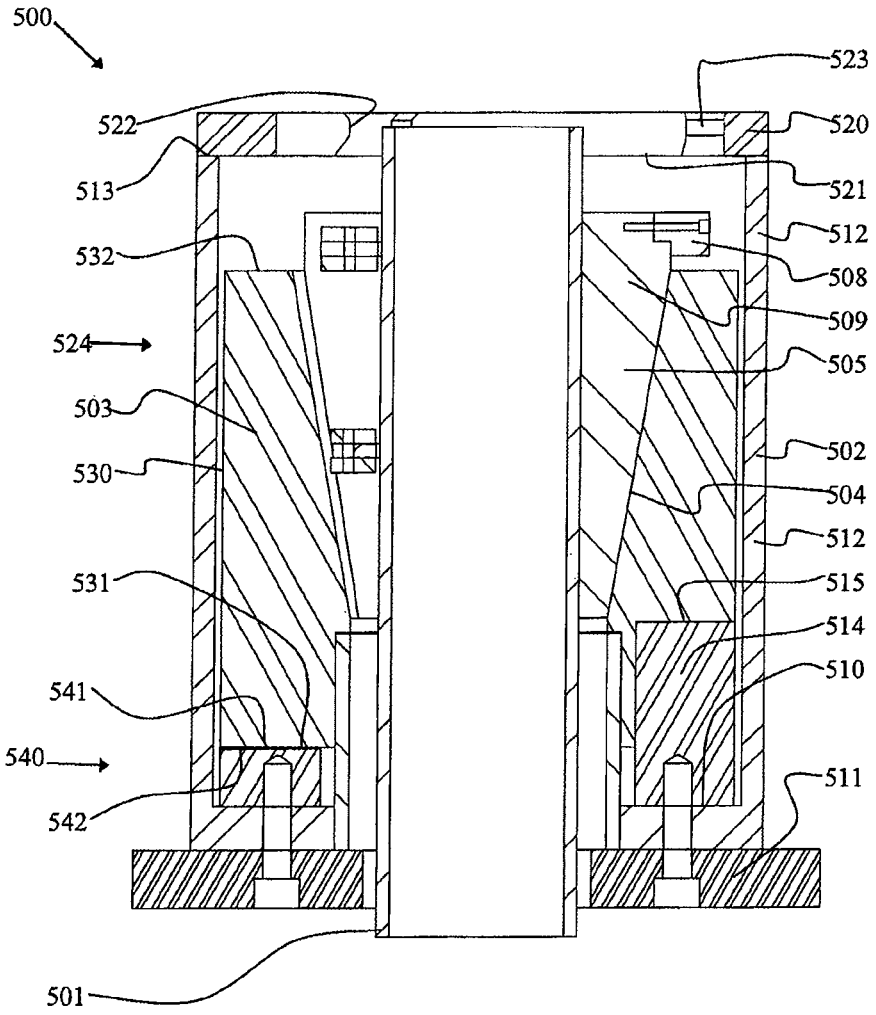

FIG. 34 is a partial cutaway isometric view of an externally gripping rig floor tubular bi-axial reaction tool provided with a torque activated slip mechanism as it appears supporting casing without torque activation FIG. 35 cross section of rig floor tubular bi-axial reaction tool shown in FIG. 34.

Figure 36:
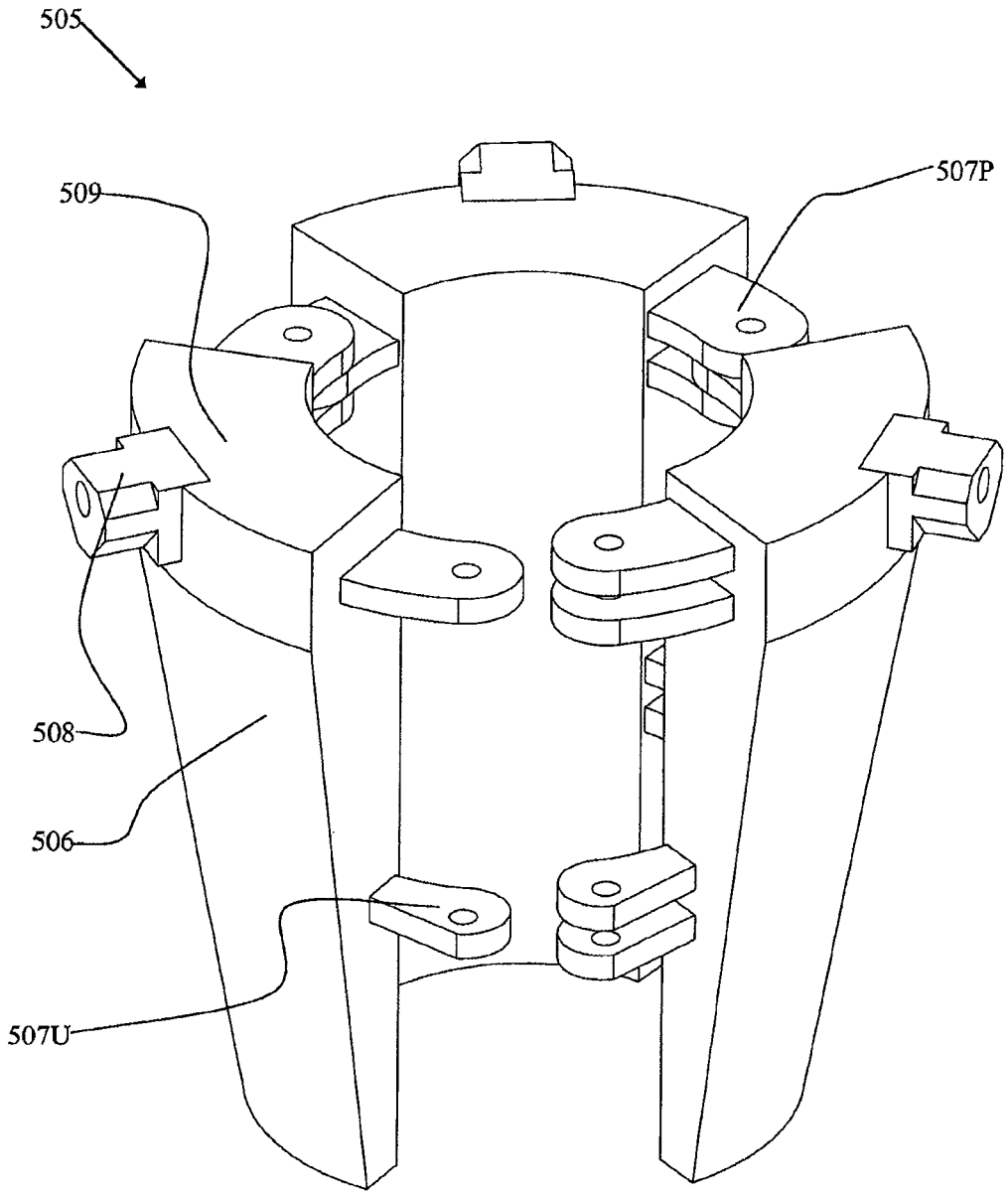

FIG. 36 is an isometric view of the slips in the tool of FIG. 34 showing load dogs.

Figure 37:
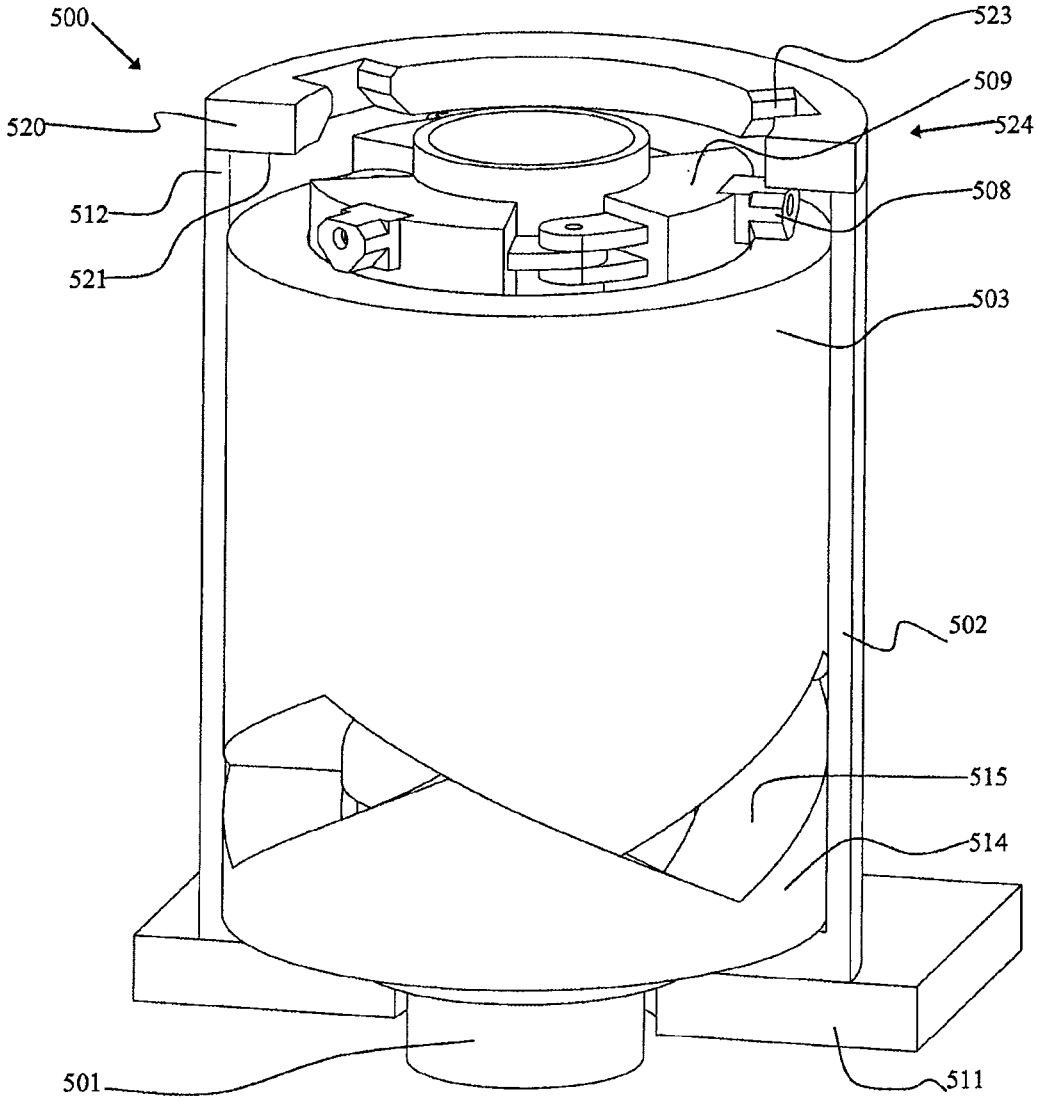

FIG. 37 is a partial cutaway isometric view of the tool shown in FIG. 34 as it appears under torque causing rotation and torque activation.

Internal Collet Cage Grip Tubular Running Tool

Figure 38:
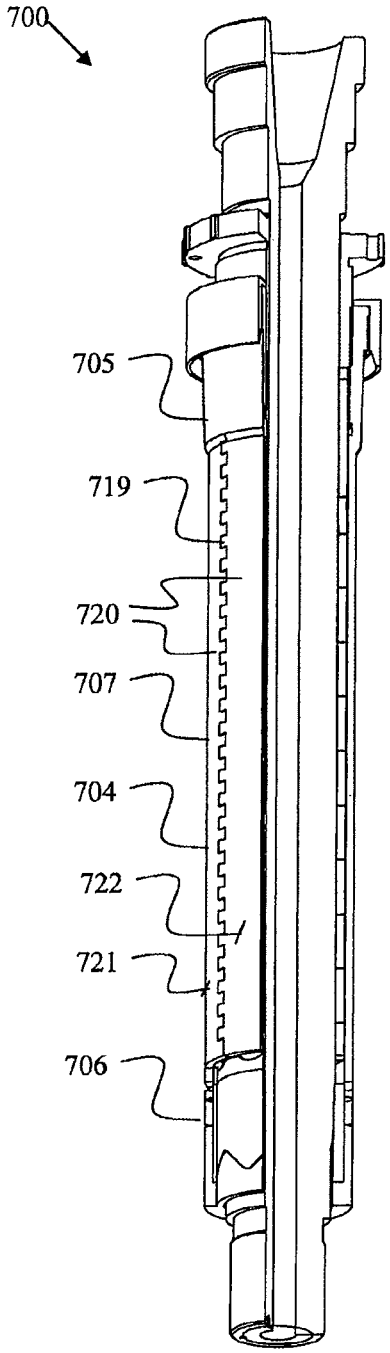

FIG. 38 is a partial cutaway isometric view of an internal gripping tubular running tool configured with a collet cage grip in its retracted position.

Figure 39:
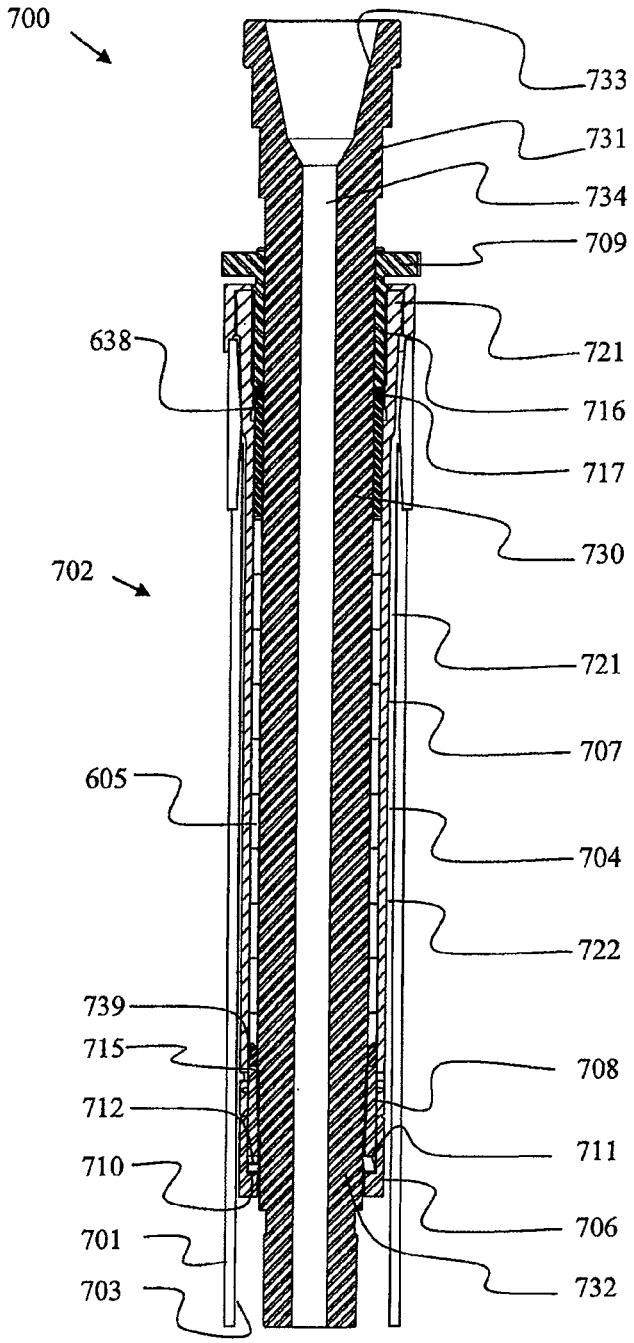

FIG. 39 is a cross section view of the tool shown in FIG. 38 as it would appear inserted into the proximal end of a tubular work piece.

Figure 40:
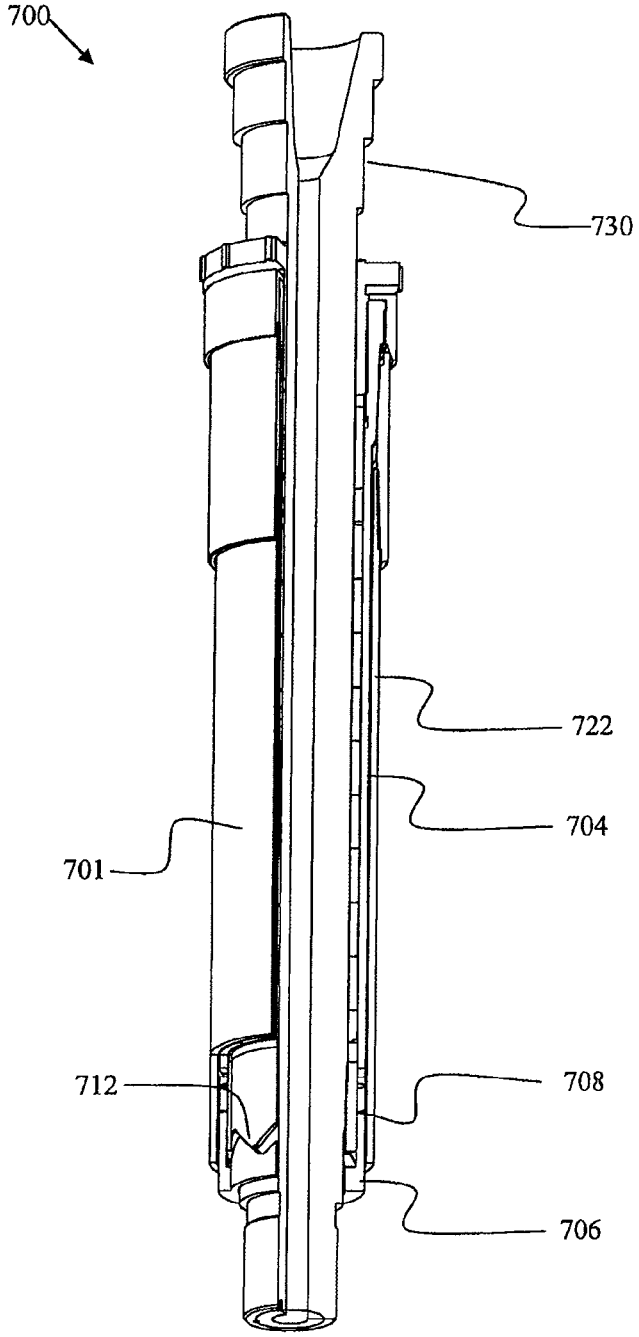

FIG. 40 is a partial cutaway isometric view of the tool shown in FIG. 38 as it would appear set and under torque load causing activation of the grip element.

Figure 41:
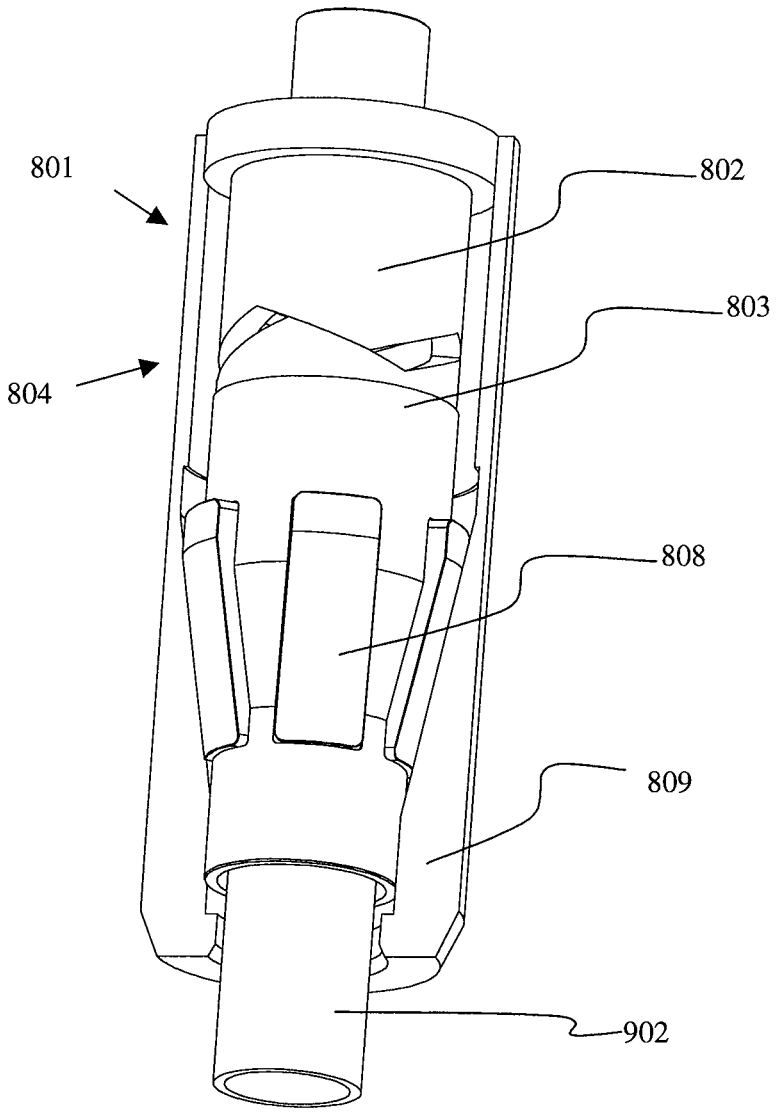

FIG. 41 is a partial cutaway trimetric view of a simplified version of a bi-axial bi-rotary activated external grip tubular running tool, provided with single cam pair base configuration cam architecture, shown as it would appear with application of right hand torque.

Figure 42A:
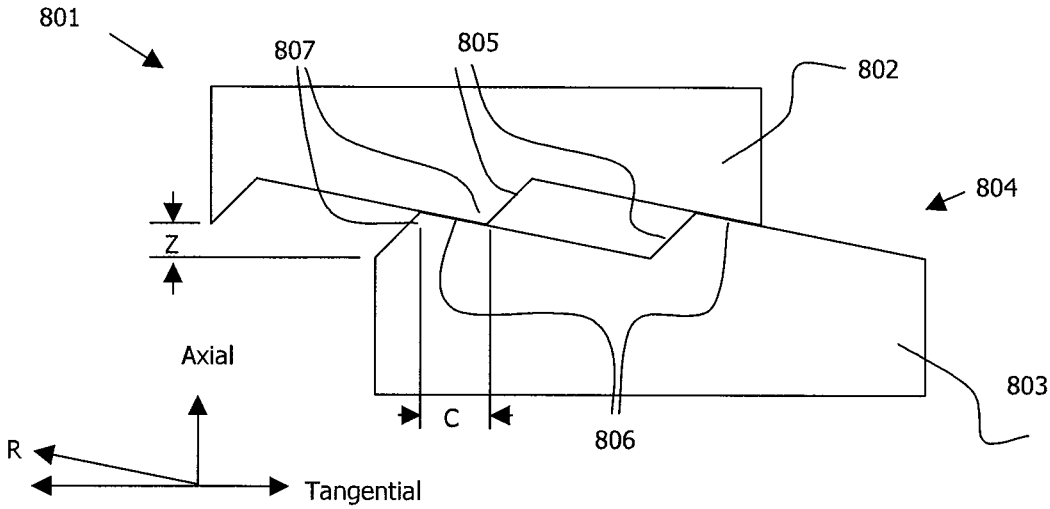

FIG. 42A is a schematic of the single cam pair base configuration cam architecture shown in FIG. 41 in a two dimensional representation, shown as it would appear with application of right hand torque.

Figure 42B:
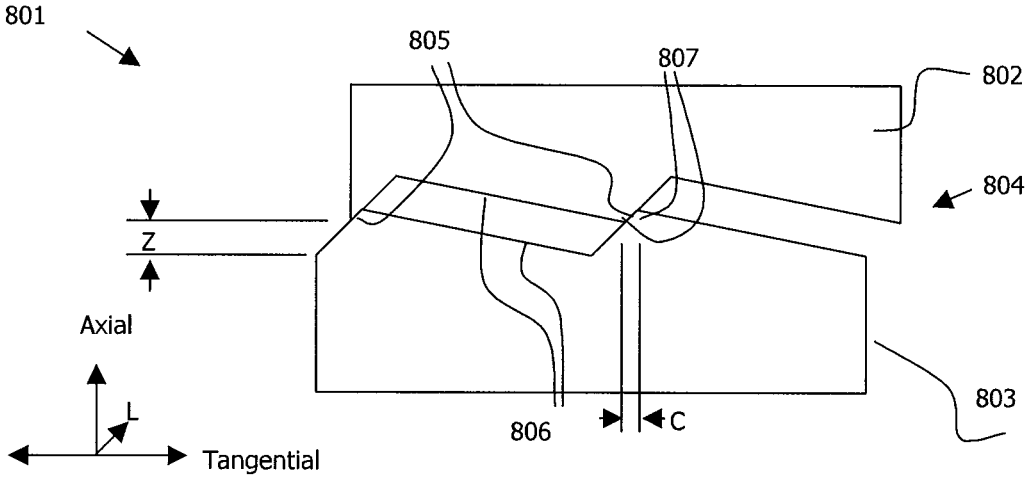

FIG. 42B is a schematic of the cam architecture of FIG. 42A in a two dimensional representation, shown as it would appear with application of left hand torque.

Figure 43:
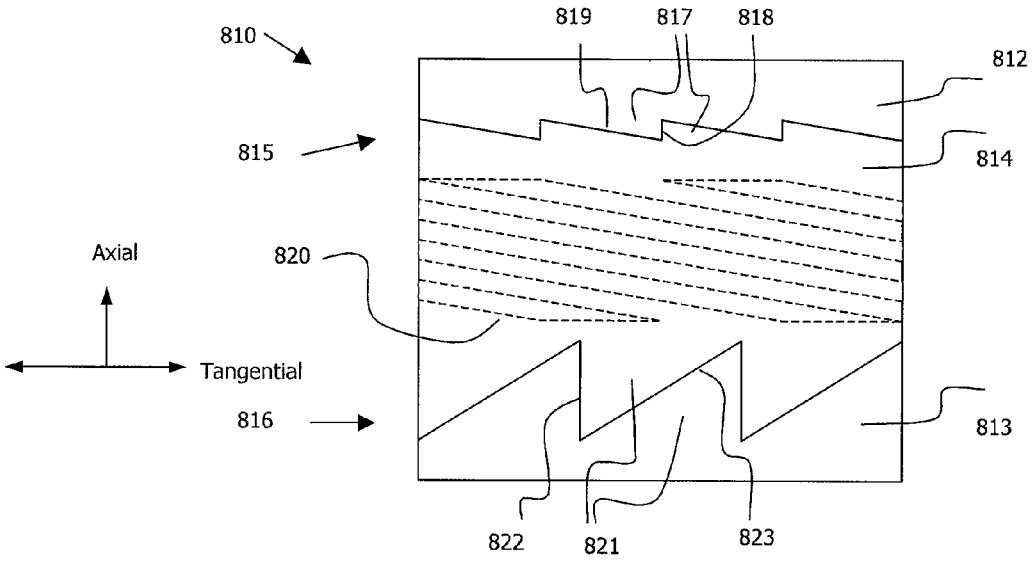

FIG. 43 is a schematic of a tri-cam architecture in a two dimensional representation, shown as it would appear with no applied torque.

Figure 44A:
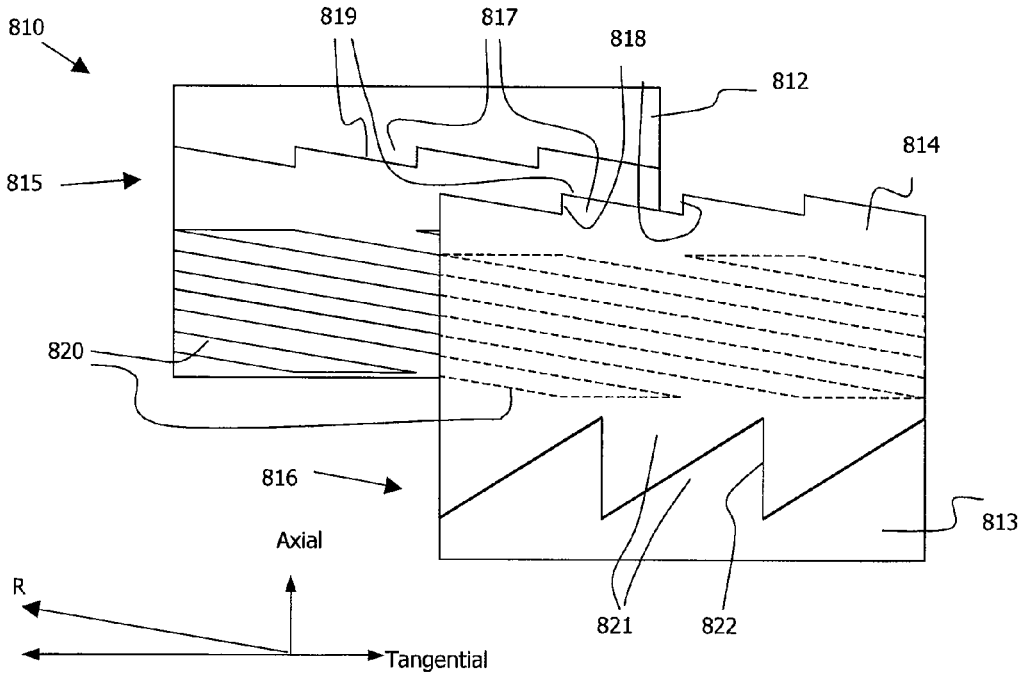

FIG. 44A is a schematic of the tri-cam architecture of FIG. 43 in a two dimensional representation, shown as it would appear with application of right hand torque.

Figure 44B:
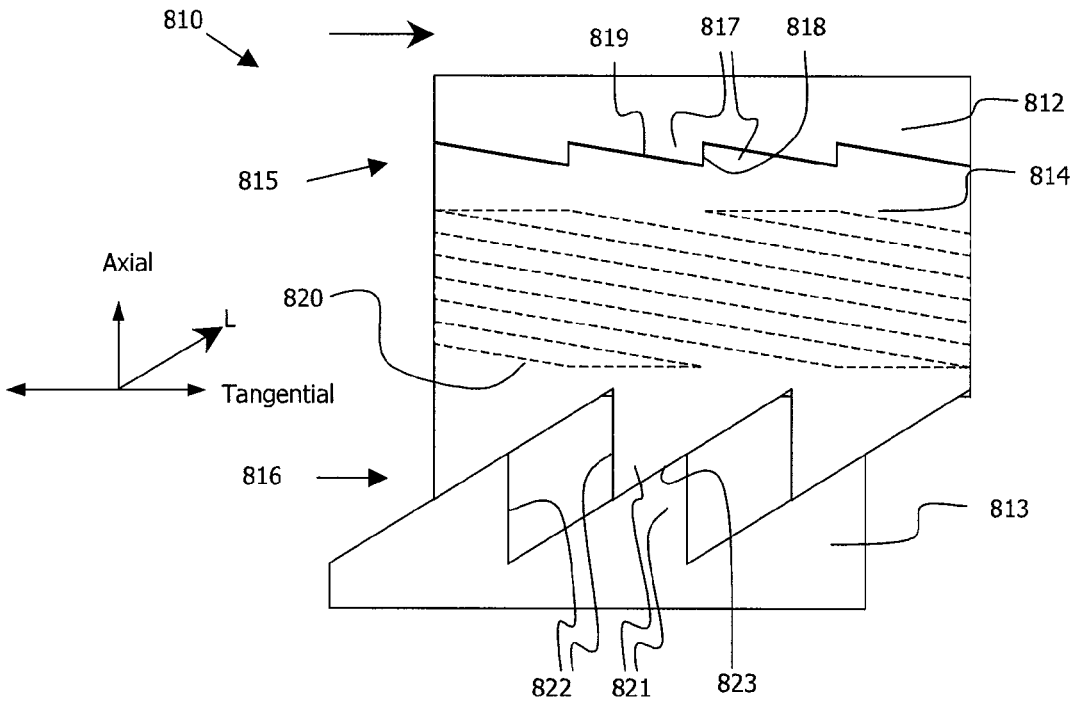

FIG. 44B is a schematic of the tri-cam architecture of FIG. 43 in a two dimensional representation, shown as it would appear with application of left hand torque.

Figure 44C:
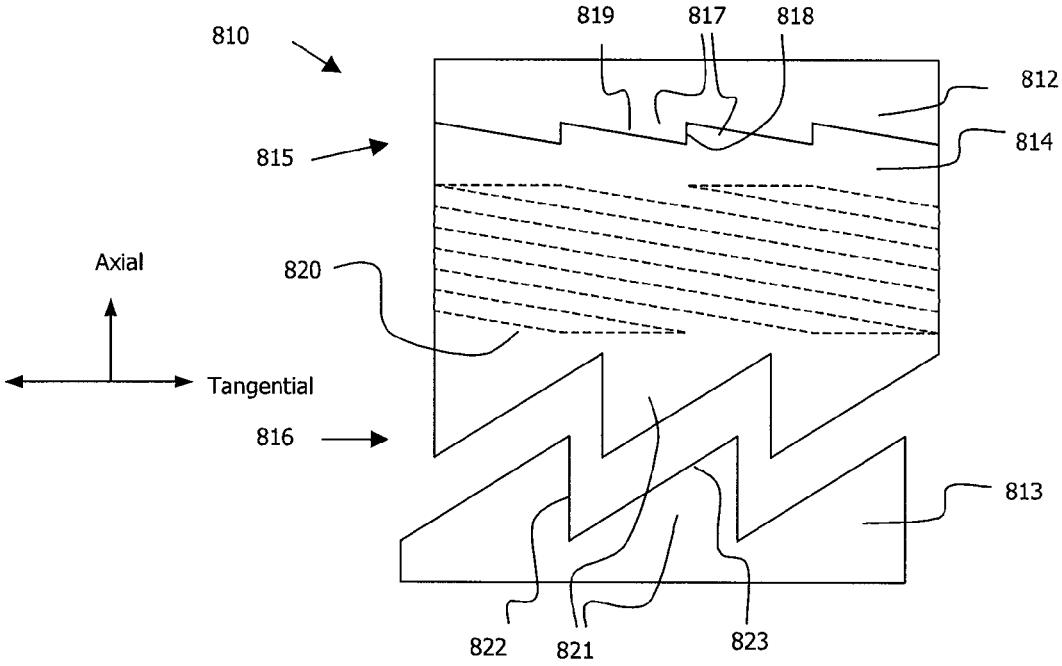

FIG. 44C is a schematic of the tri-cam architecture of FIG. 43 in a two dimensional representation, shown as it would appear in a gripping tool with axial tension applied.

Figure 45A:
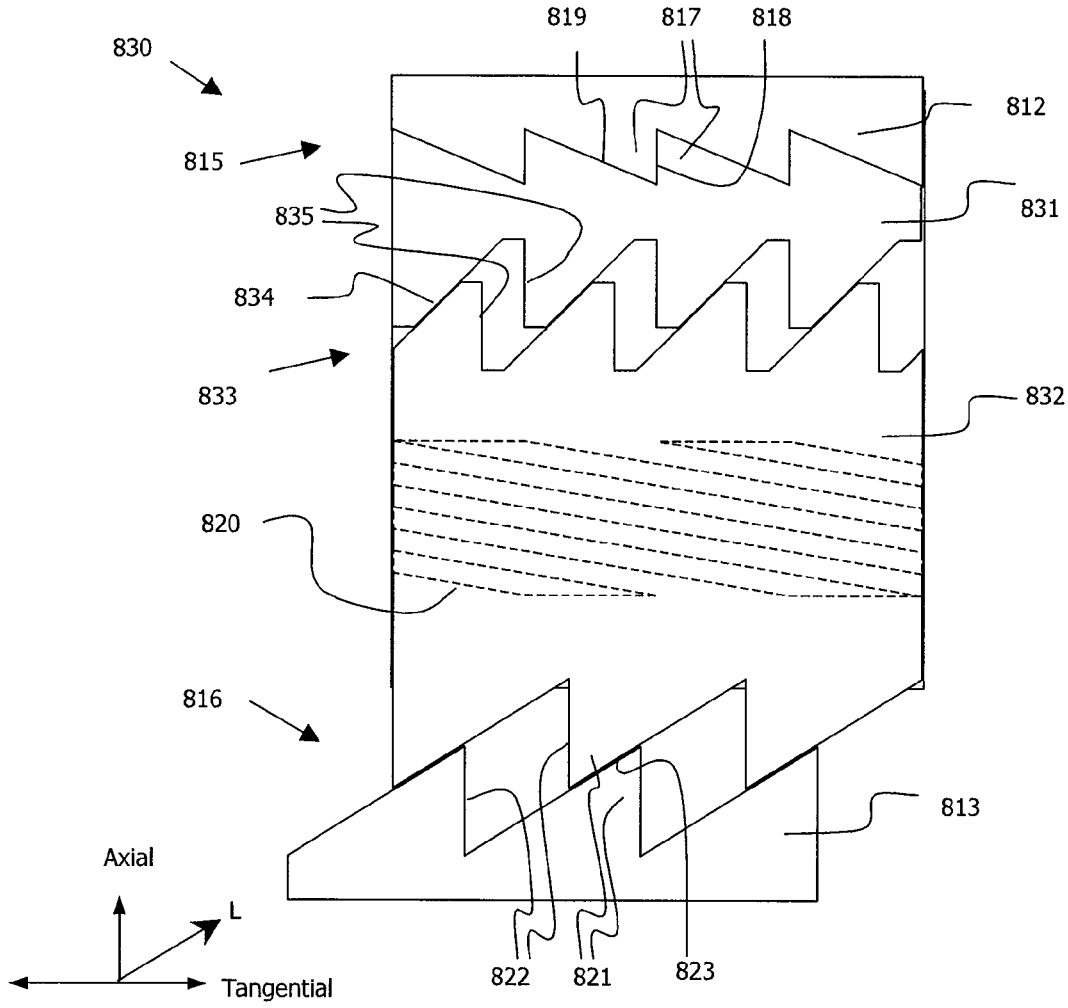

FIG. 45A is a schematic of a tri-cam architecture with dog boost cam pair in a two dimensional representation, shown as it would appear with application of left hand torque.

Figure 45B:
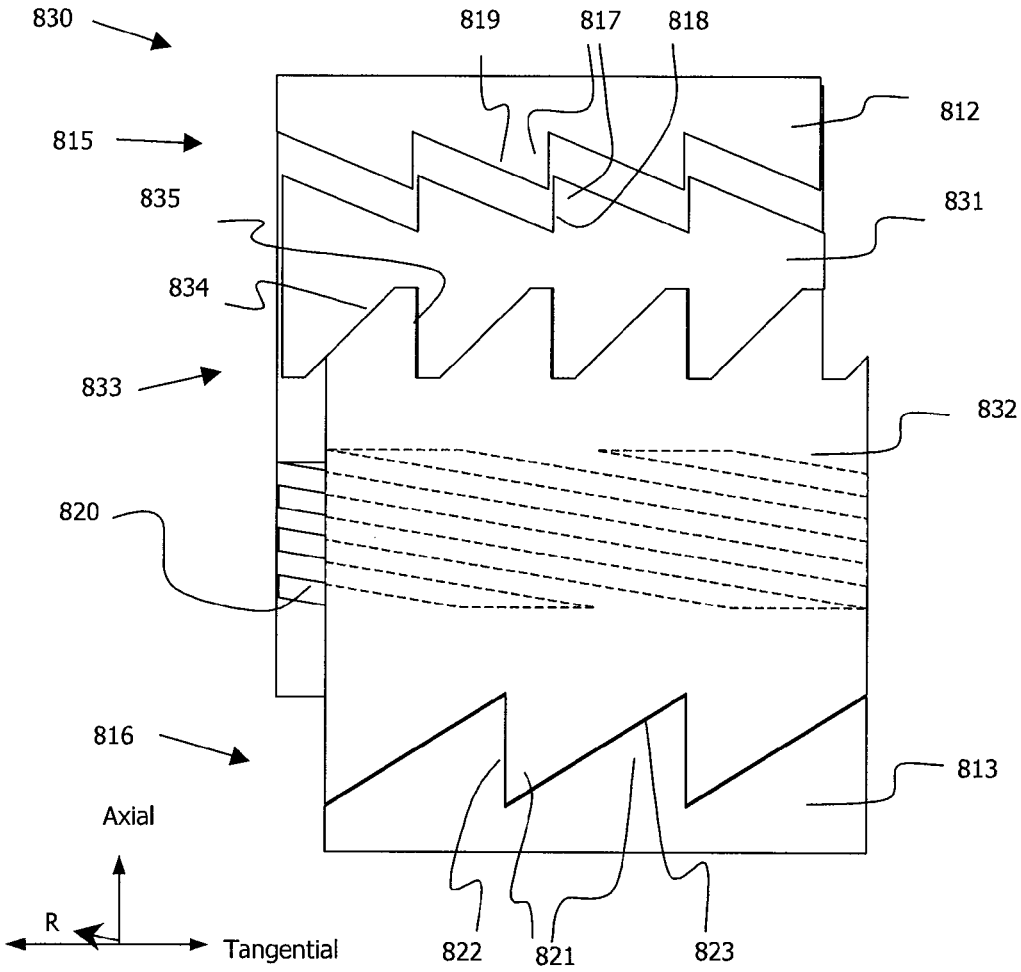

FIG. 45B is a schematic of the tri-cam architecture of FIG. 45A with dog boost cam pair in a two dimensional representation, shown as it would appear with a small amount of right hand rotation prior to dog boost in the neutral position.

Figure 45C:
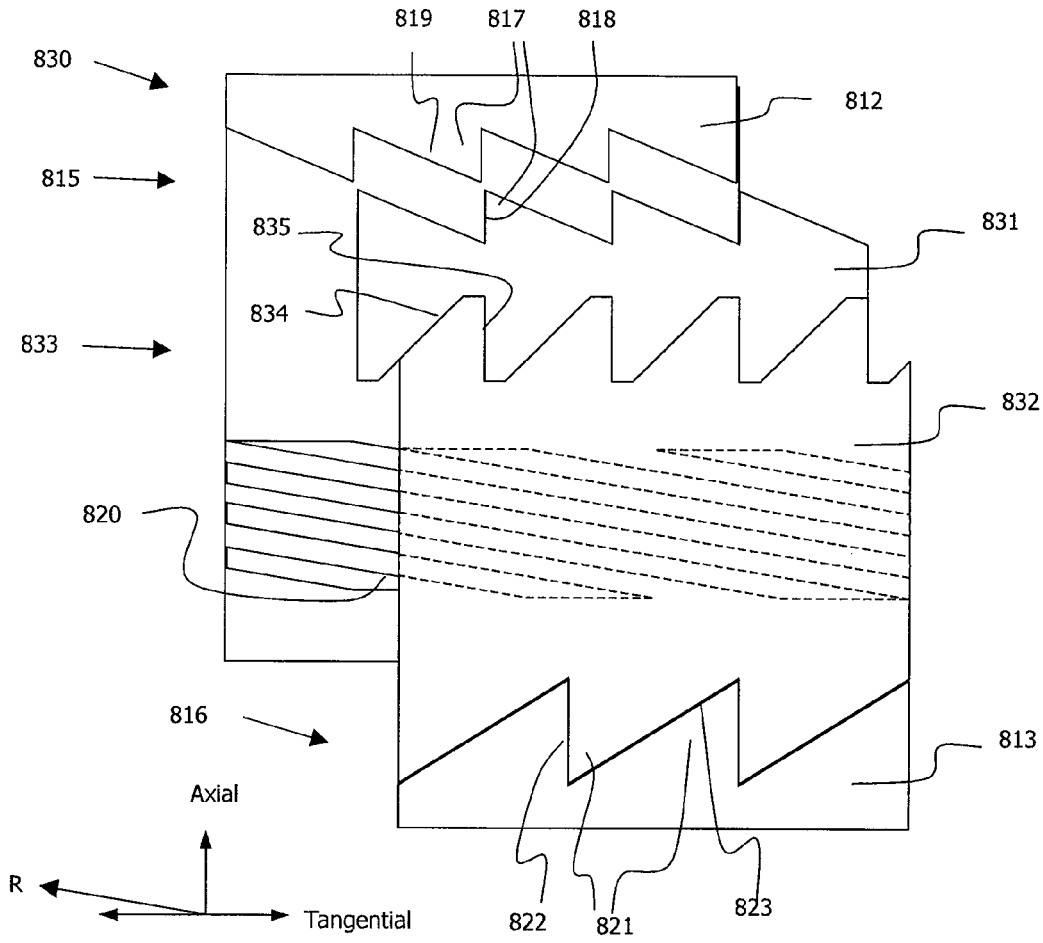

FIG. 45C is a schematic of the tri-cam architecture of FIG. 45A with dog boost cam pair in a two dimensional representation, shown as it would appear with application of right hand torque.

Figure 46A:
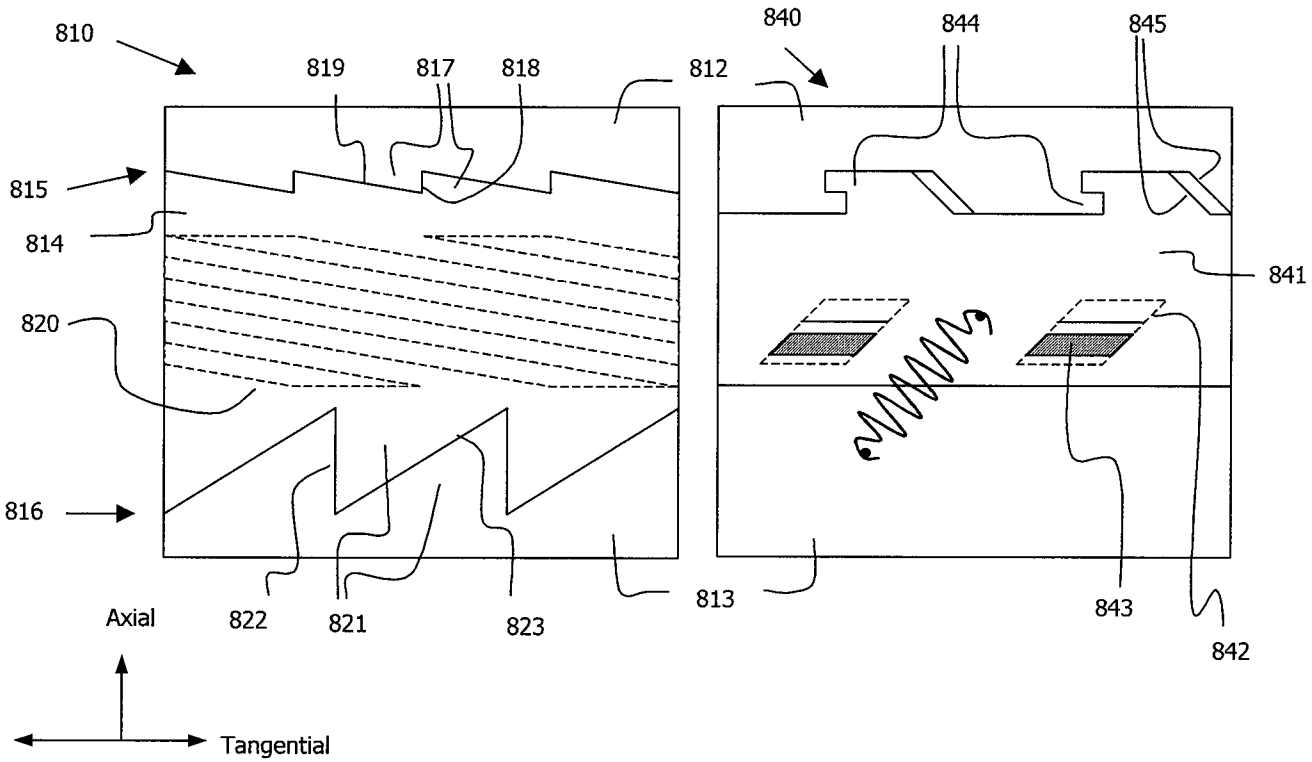

FIG. 46A is a schematic of the tri-cam architecture of FIG. 43 with latch in a two dimensional representation, shown as it would appear in the latched position.

Figure 46B:
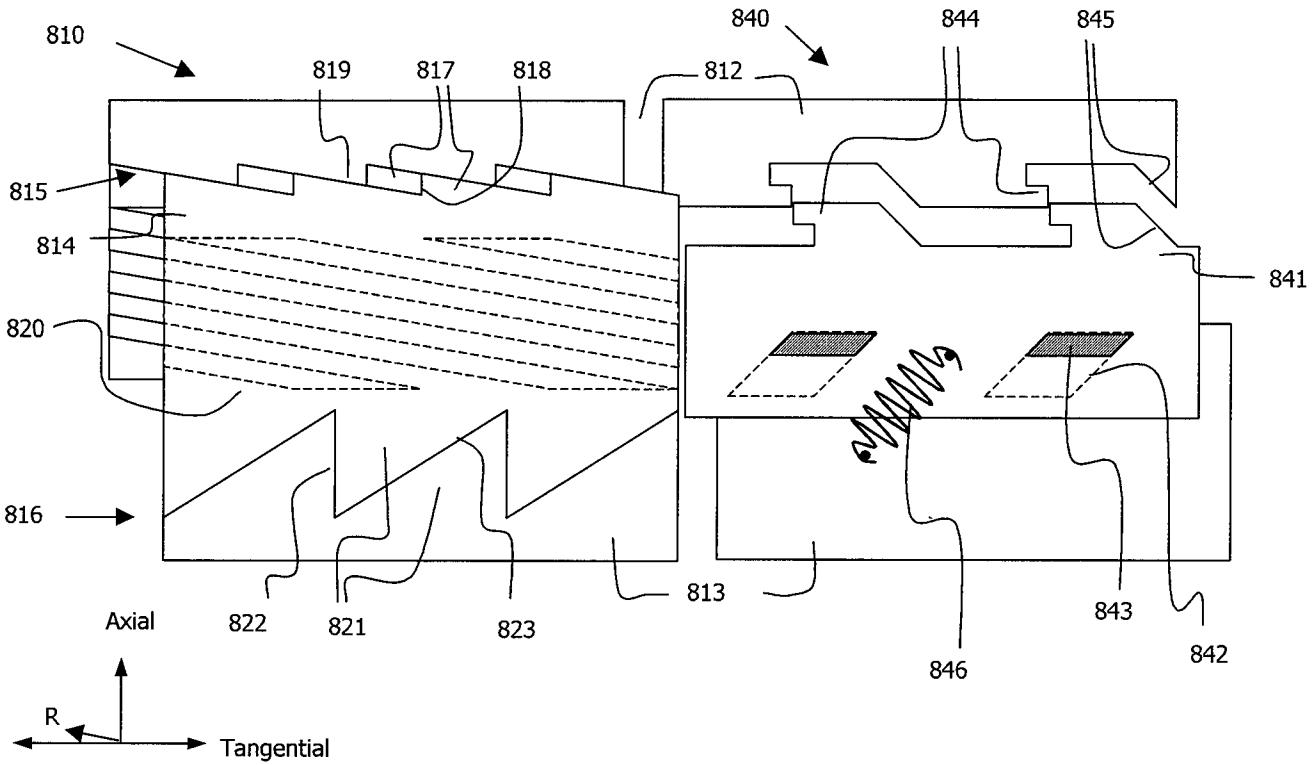

FIG. 46B is a schematic of the tri-cam architecture of FIG. 43 with latch in a two dimensional representation, shown as it would appear with right hand torque applied with latch disengaged.

Figure 46C:
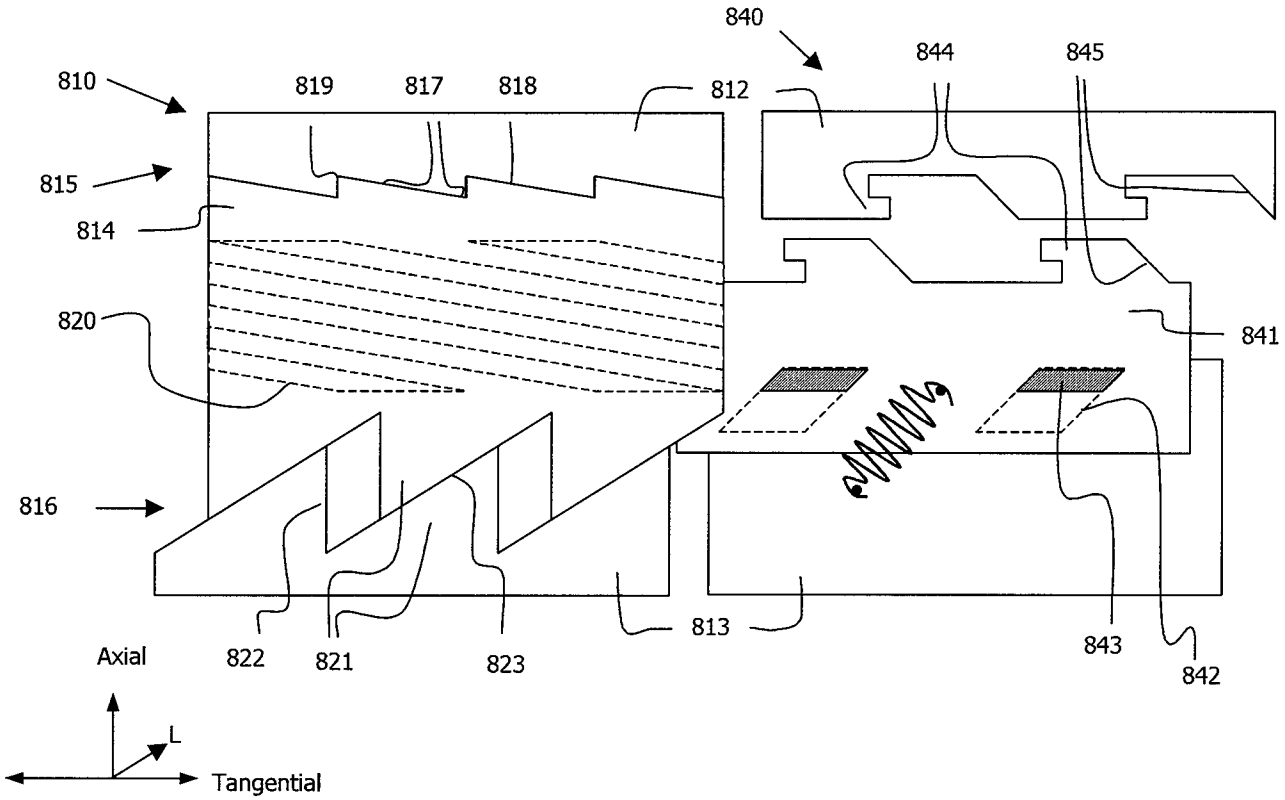

FIG. 46C is a schematic of the tri-cam architecture of FIG. 43 with latch in a two dimensional representation, shown as it would appear with latch disengaged and left hand torque applied.

Figure 47A:
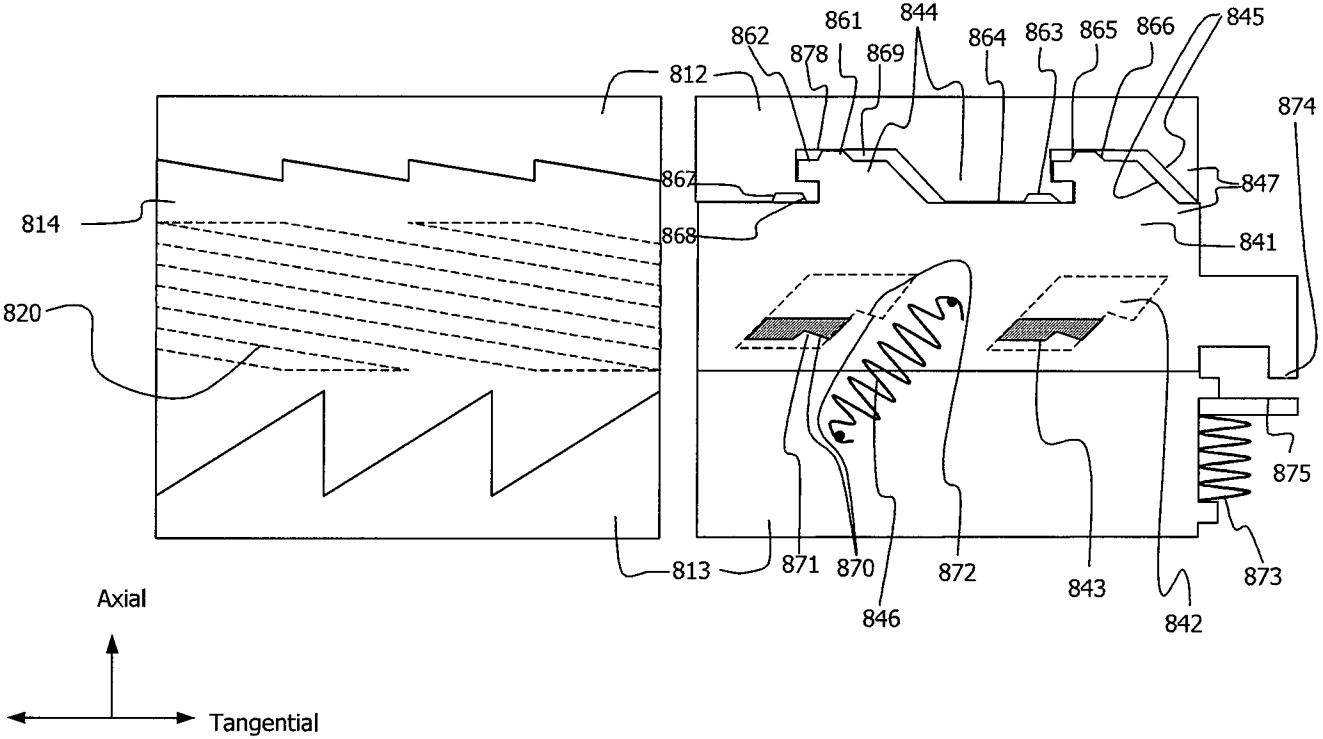

FIG. 47A is a schematic of the tri-cam architecture of FIG. 43 with a lockout capable latch in a two dimensional representation, shown as it would appear in the latched position.

Figure 47B:
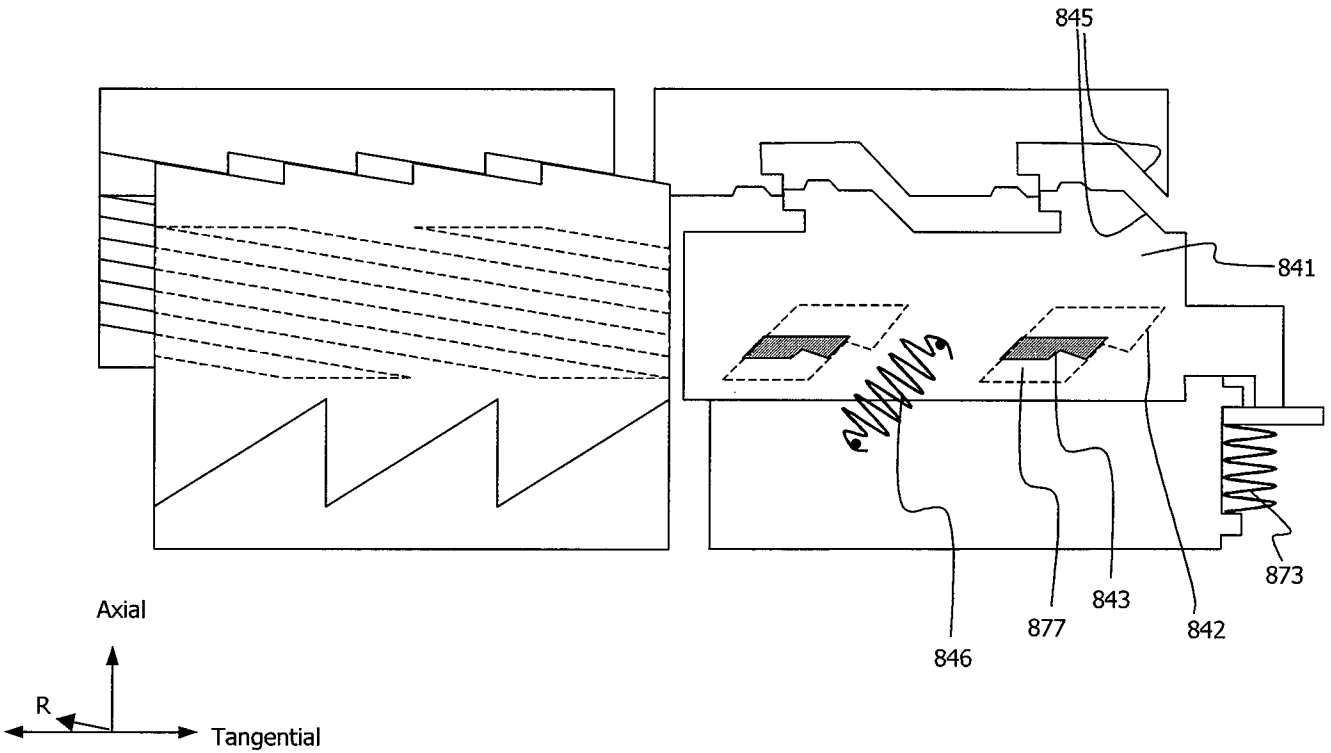

FIG. 47B is a schematic of the tri-cam architecture of FIG. 43 with a lockout capable latch in a two dimensional representation, shown as it would appear with right hand torque applied with latch disengaged.

Figure 47C:
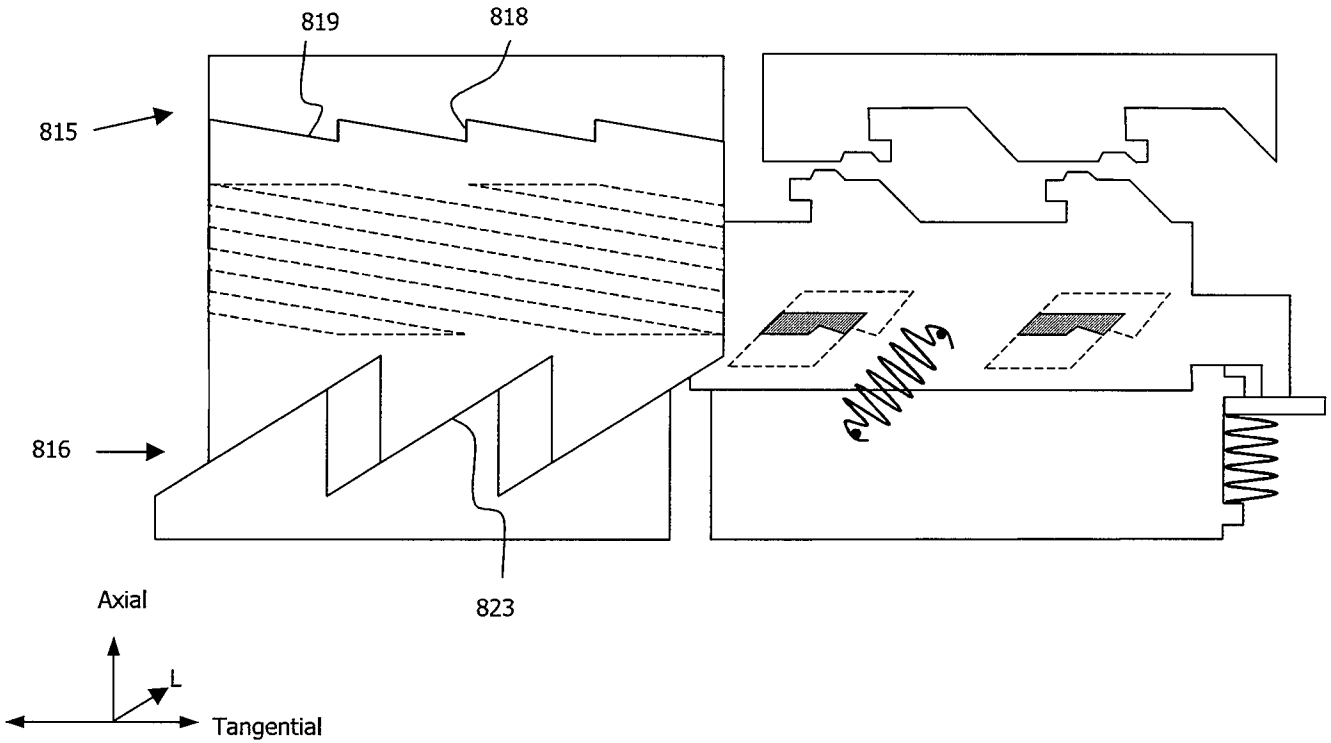

FIG. 47C is a schematic of the tri-cam architecture of FIG. 43 with a lockout capable latch in a two dimensional representation, shown as it would appear with latch disengaged and left hand torque applied.

Figure 47D:
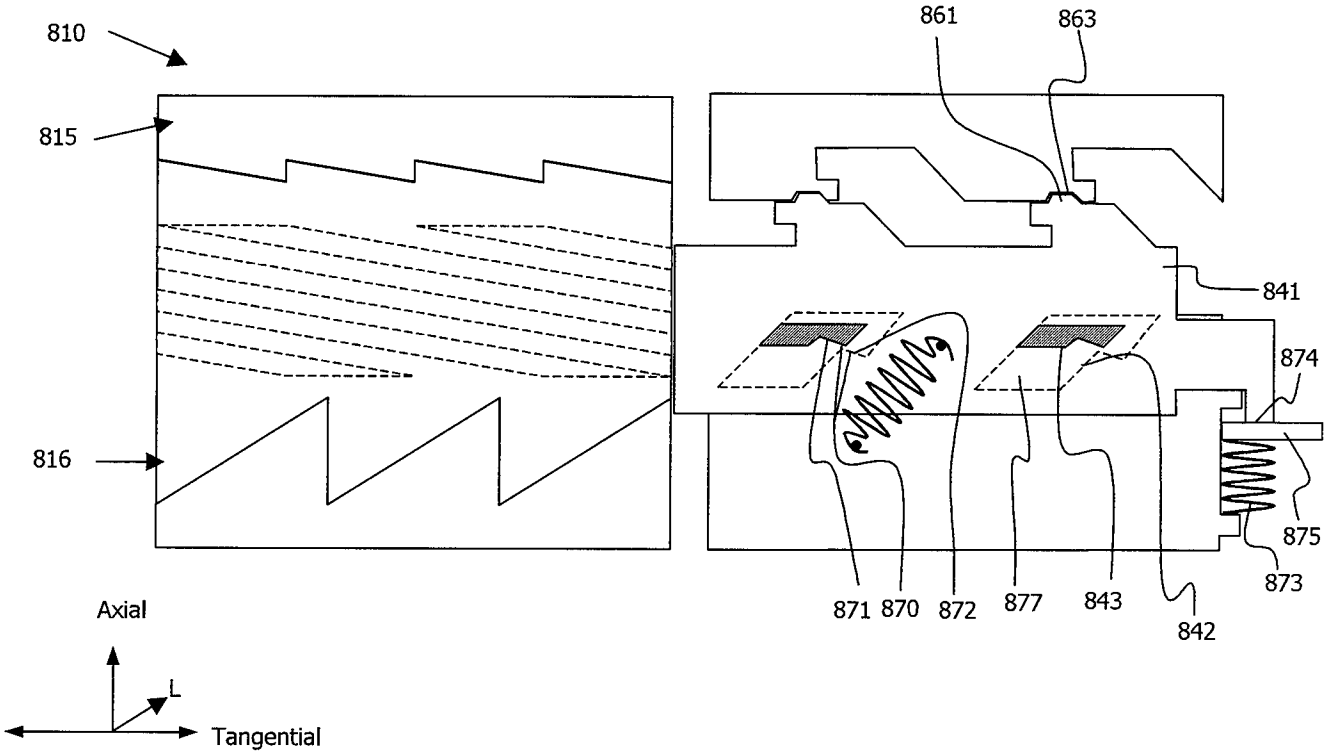

FIG. 47D is a schematic of the tri-cam architecture of FIG. 43 with a lockout capable latch in a two dimensional representation, shown as it would appear with latch disengaged and compression applied from engagement on the driven cam pair.

Figure 47E:
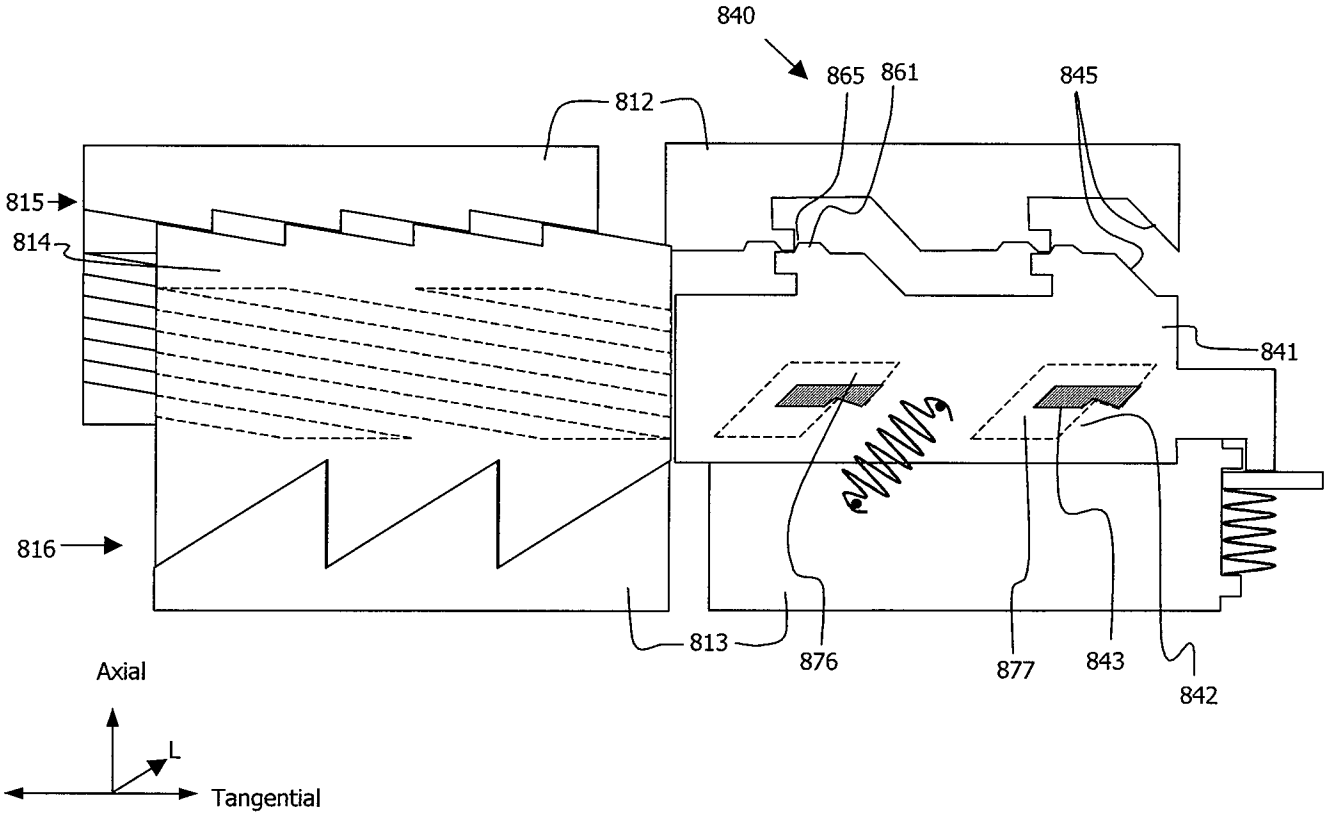

FIG. 47E is a schematic of the tri-cam architecture of FIG. 43 with a lockout capable latch in a two dimensional representation, shown as it would appear with latch disengaged and compression applied from engagement on the drive cam pair.

Figure 47F:
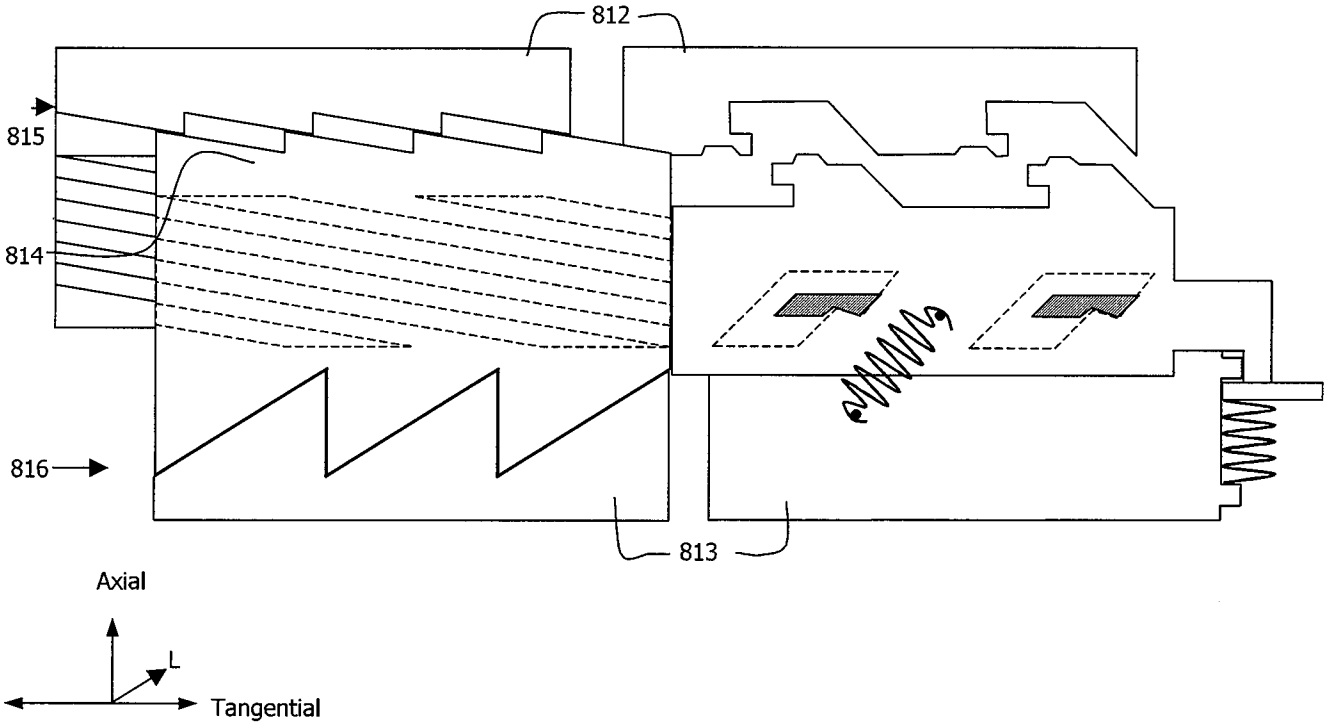

FIG. 47F is a schematic of the tri-cam architecture of FIG. 43 with a lockout capable latch in a two dimensional representation, shown as it would appear with the latch locked out and right hand torque applied.

Figure 48:
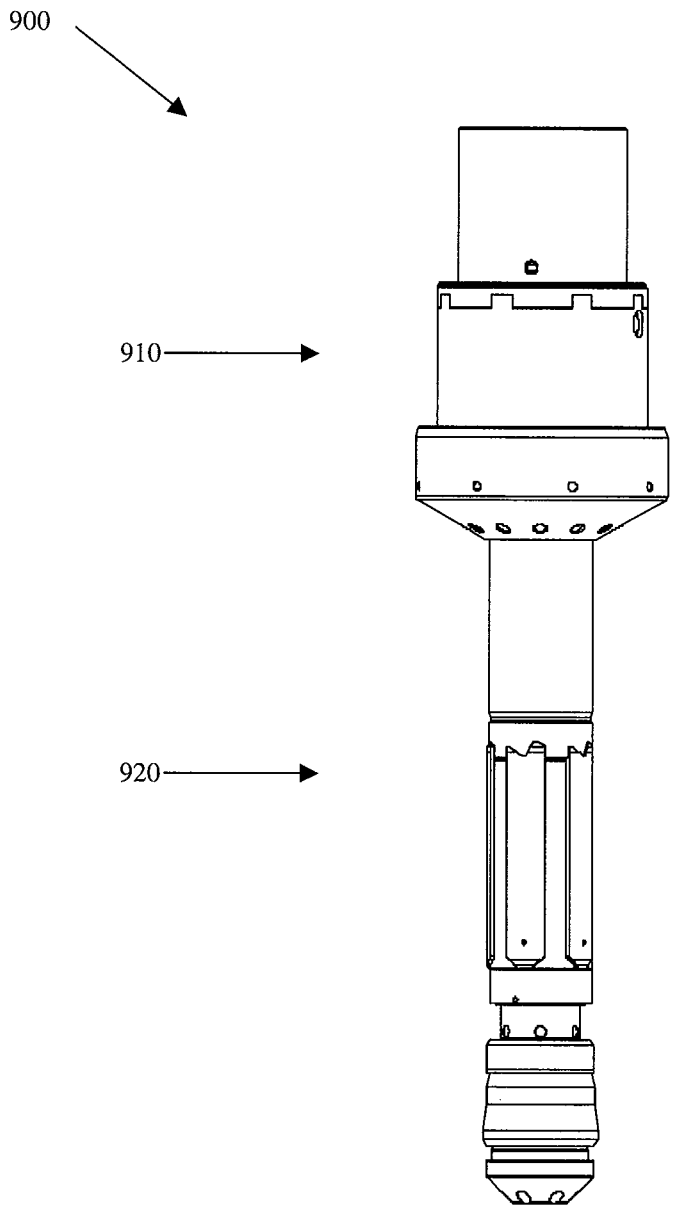

FIG. 48 is an external view of a tubular running tool with tri-cam architecture shown as it would appear in the latched position.

Figure 49:
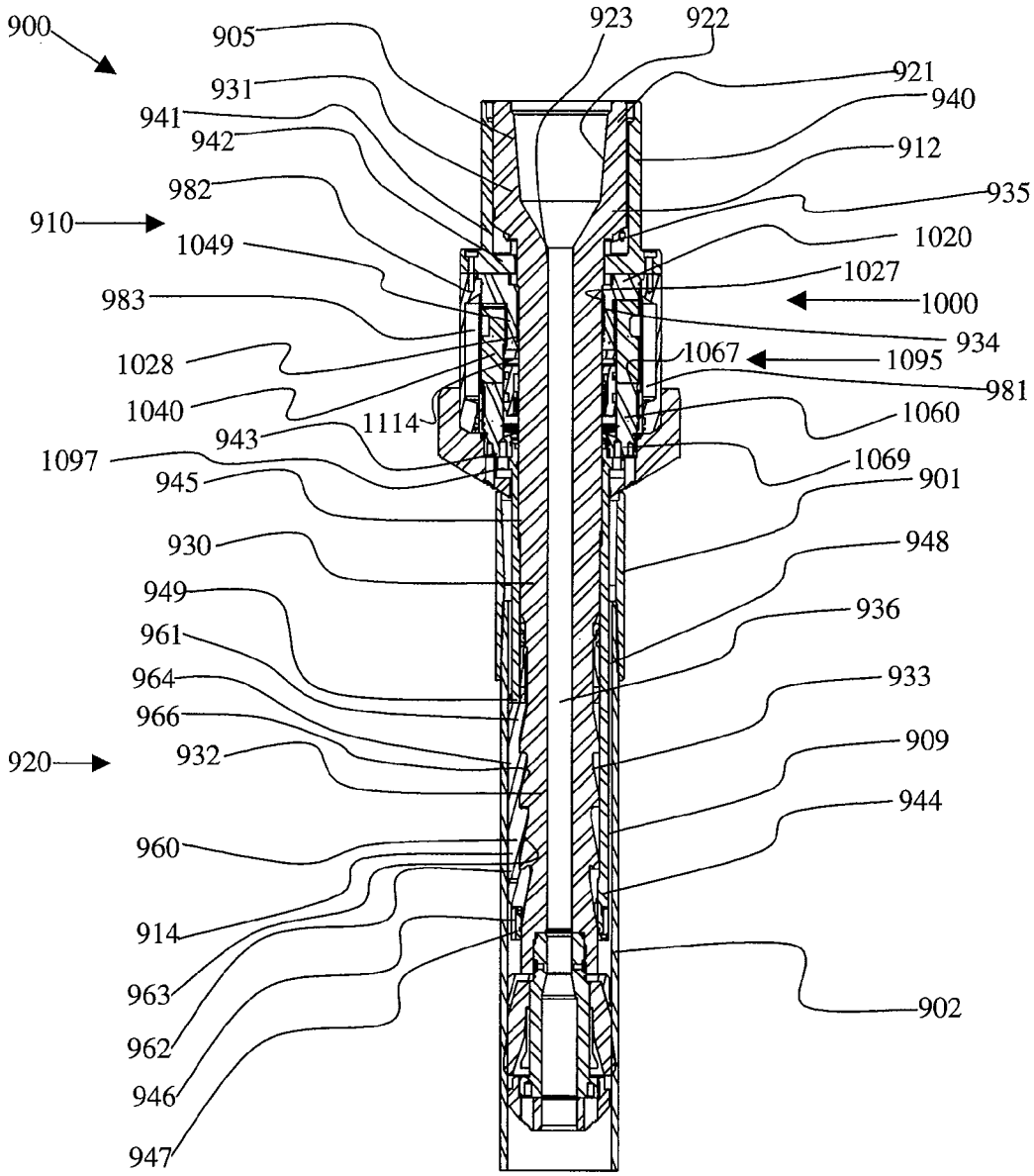

FIG. 49 is a cross section view of a tubular running tool with tri-cam architecture shown as it would appear in the latched position located internal to proximal end of a work piece.

Figure 50A:
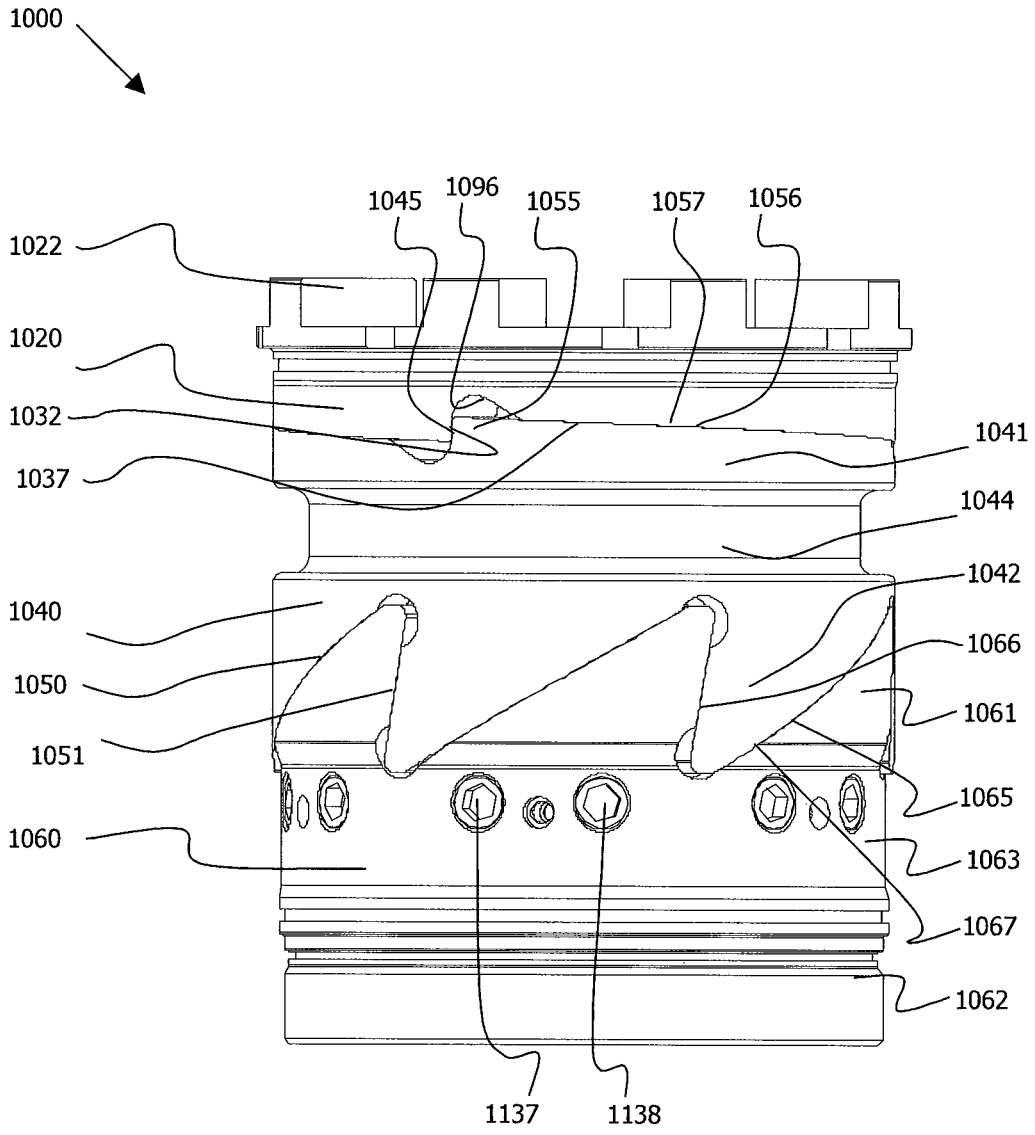

FIG. 50A is an external view of a tri-cam assembly shown as it would appear in the latched position.

Figure 50B:
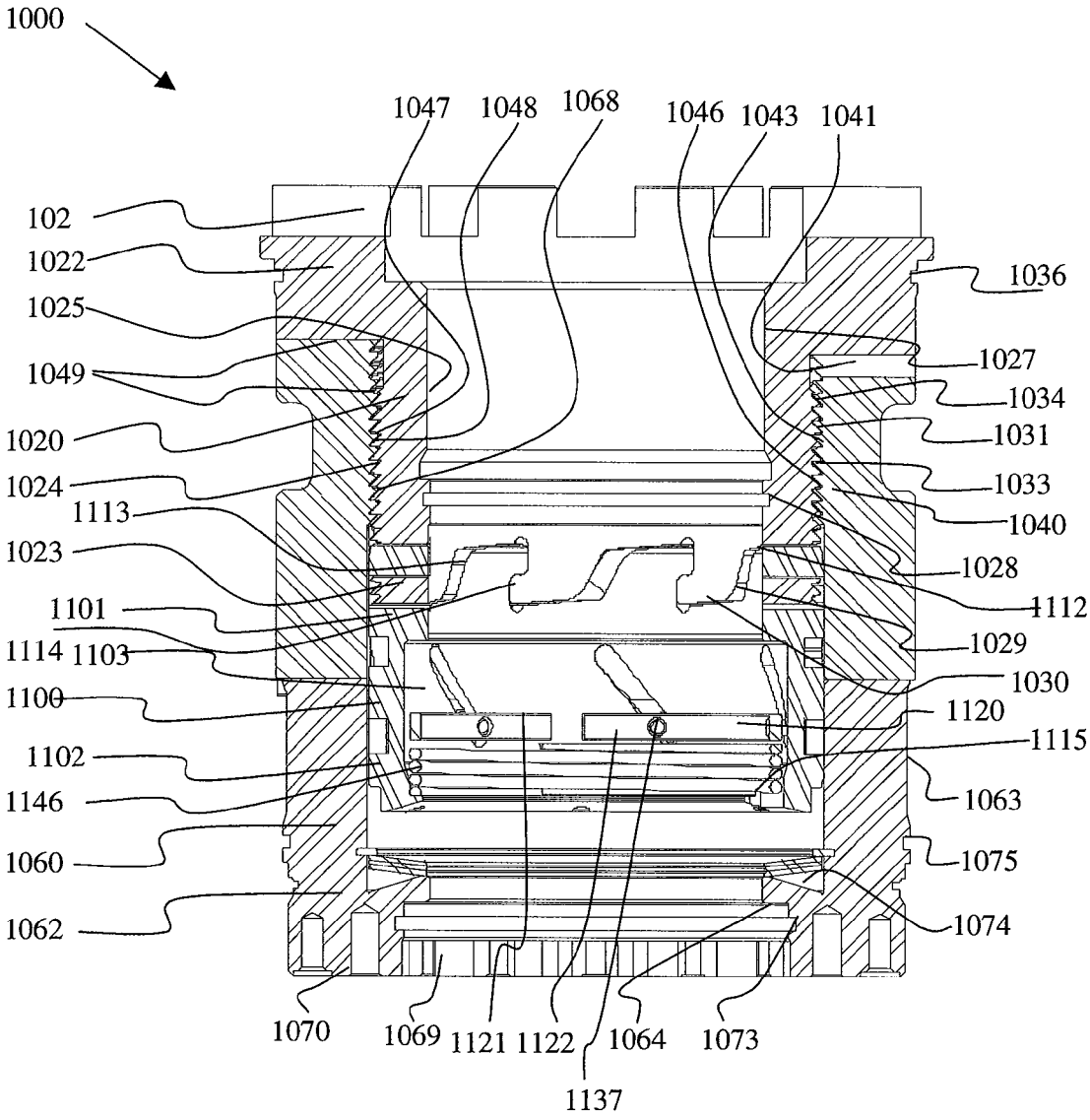

FIG. 50B is a cross section view of a tri-cam assembly shown as it would appear in the latched position.

Figure 51A:
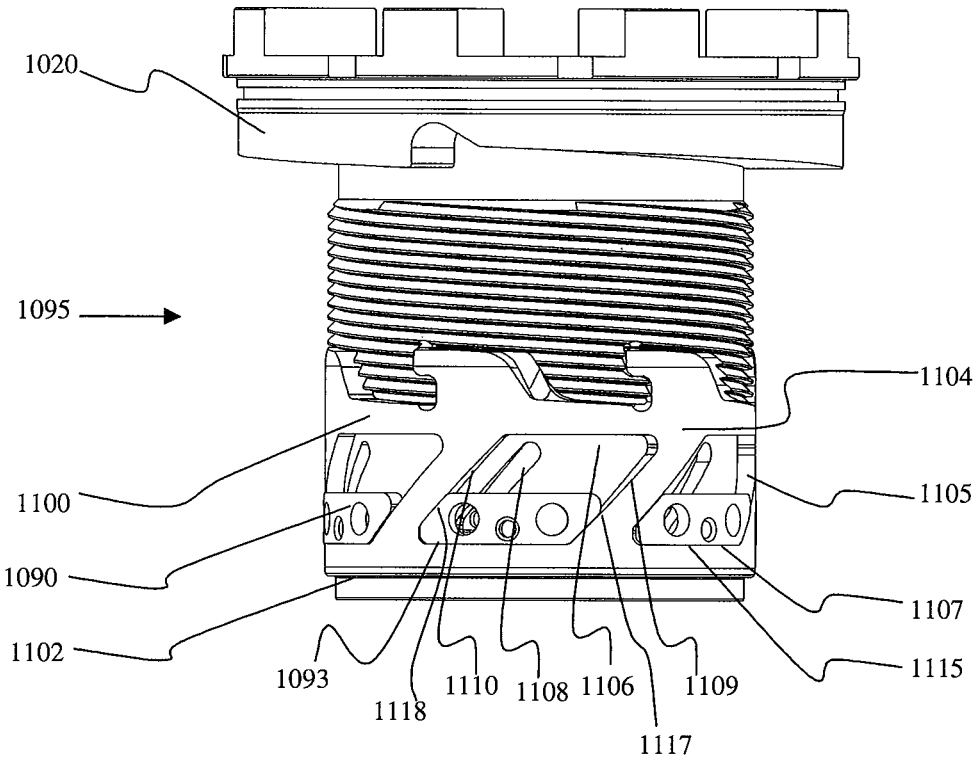

FIG. 51A is an external view of a partial latch assembly including drive cam body, latch ring and latch keys, shown as it would appear in the latched position.

Figure 51B:
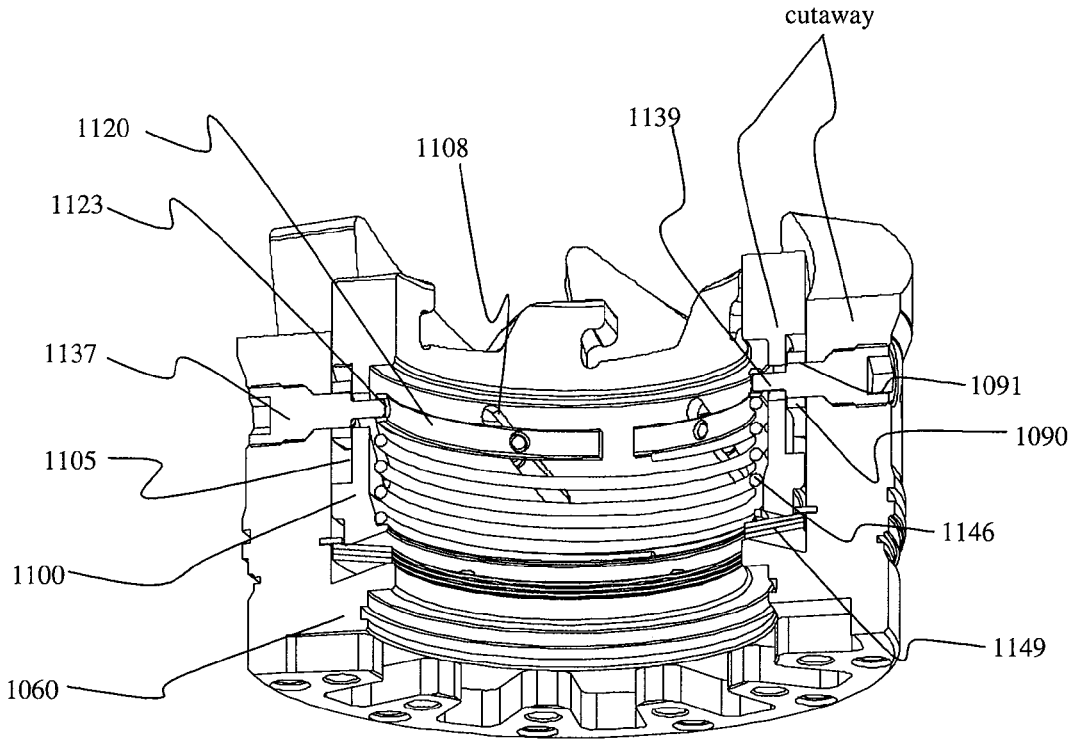

FIG. 51B is a trimetric partial section view of a partial latch assembly including driven cam body, latch ring and latch keys, shown as it would appear disengaged.

Figure 51C:
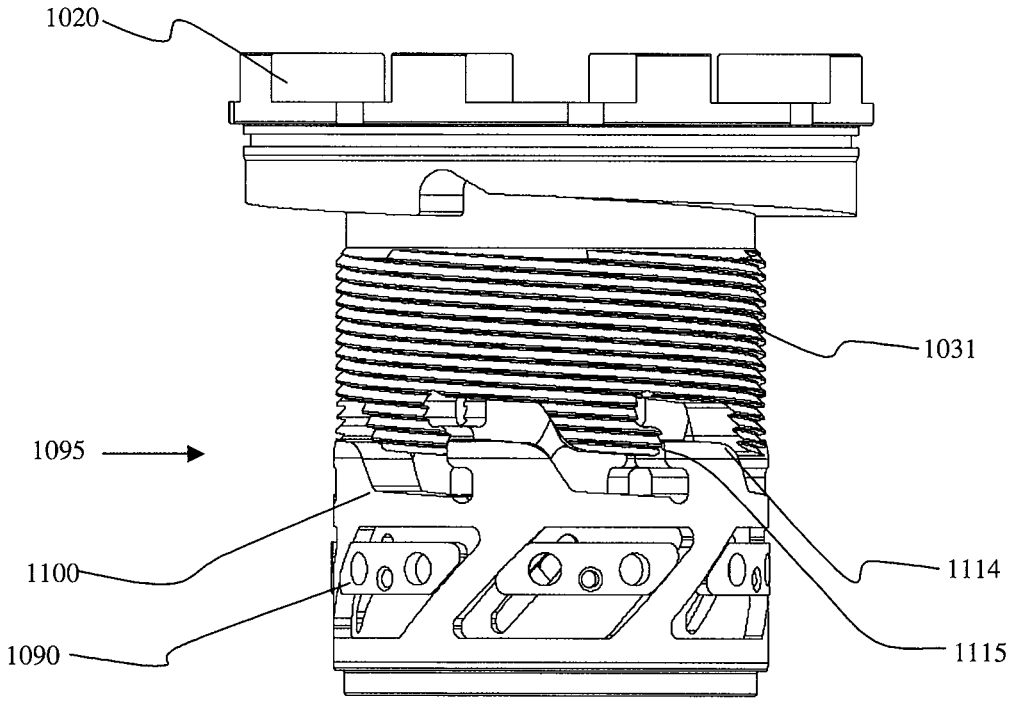

FIG. 51C is an external view of a partial latch assembly including drive cam body, latch ring and latch keys, shown as it would appear disengaged.

Figure 52A:
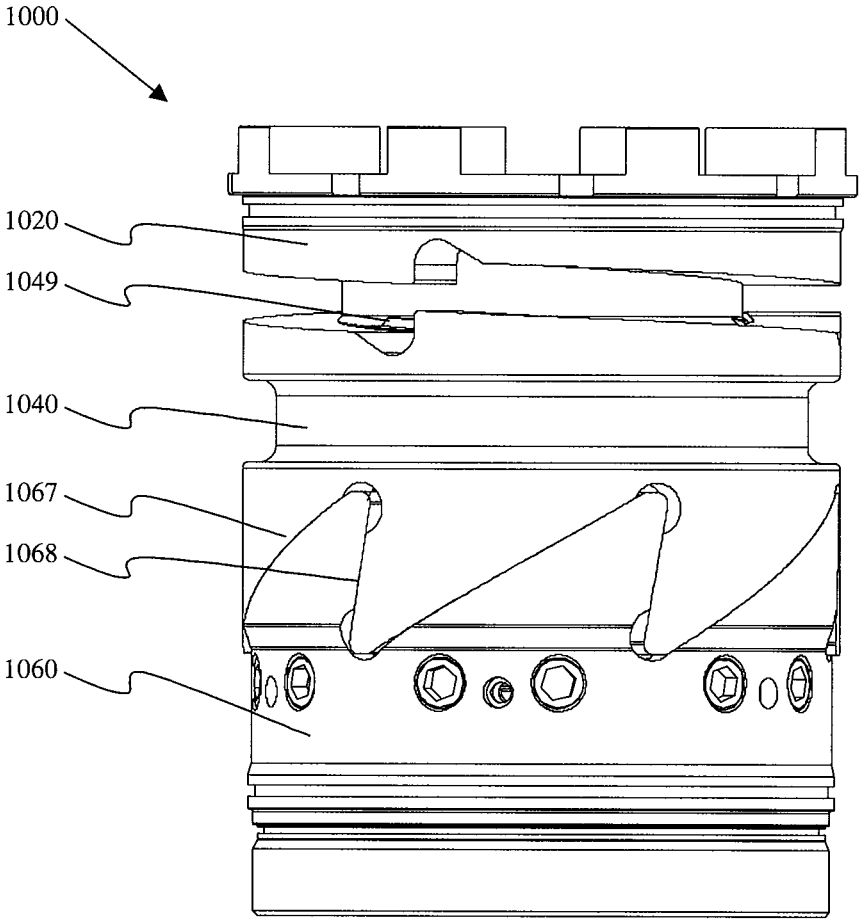

FIG. 52A is an external view of a tri-cam assembly, shown as it would appear with right hand torque applied.

Figure 52B:
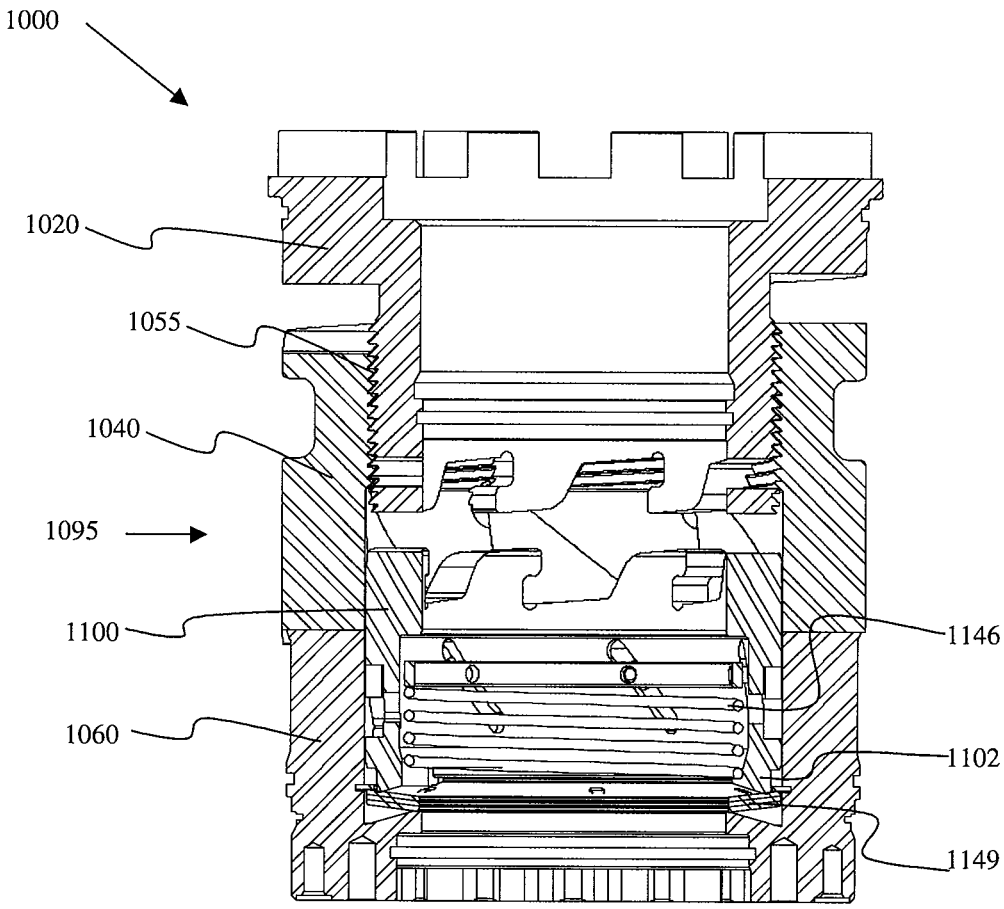

FIG. 52B is a cross section view of tri-cam assembly, shown as it would appear with right hand torque applied.

Figure 53A:
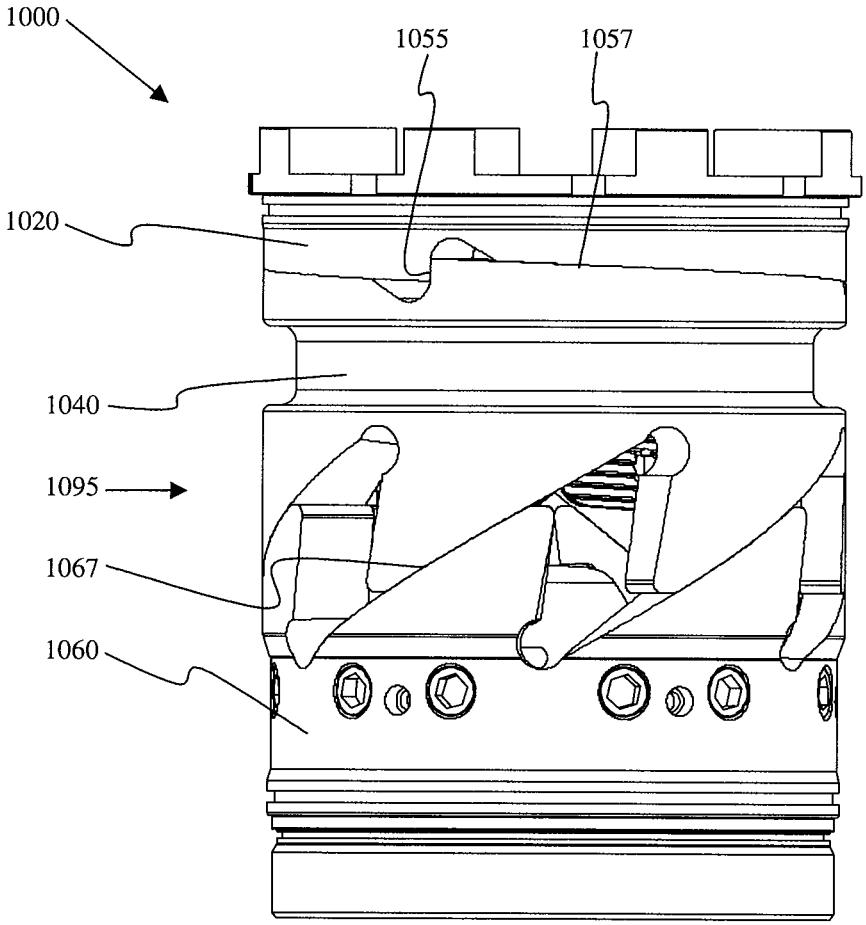

FIG. 53A is an external view of a tri-cam assembly, shown as it would appear with latch disengaged and left hand torque applied.

Figure 53B:
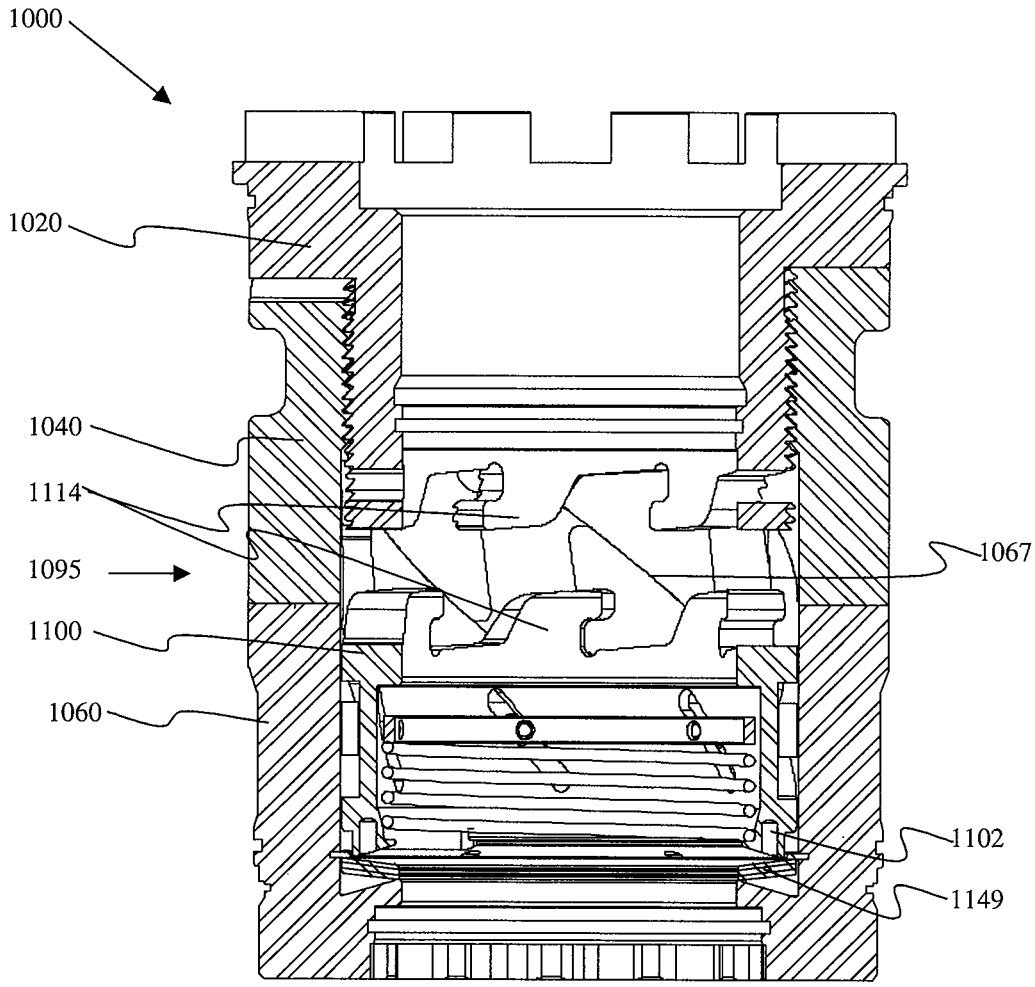

FIG. 53B is a cross section view of tri-cam assembly, shown as it would appear with latch disengaged and left hand torque applied.

DESCRIPTION OF THE PREFERRED EMBODIMENTS

General Principles

The tool is comprised of three main interacting components or assemblies: (1) a body assembly, (2) a gripping assembly carried by the body assembly, and (3) a linkage acting between the body assembly and gripping assembly. The body assembly generally provides structural association of the tool components and includes a load adaptor by which load from a drive head or reaction frame is transferred into or out of the remainder of the body assembly or the main body. The gripping assembly, has a grip surface, is carried by the main body of the body assembly and is provided with means to move the grip surface from a retracted to an engaged position in response to relative axial movement, or stroke, to radially and fractionally engage the grip surface with a work piece. The gripping assembly thus acts as an axial load or stroke activated grip element. The linkage acting between the body assembly and gripping assembly is adapted to link relative rotation between the load adaptor and grip surface into axial stroke of the grip surface. The main body is coaxially positioned with respect to the work piece to form an annular space in which the axial stroke activated grip element is placed and connected to the main body. The grip element has a grip surface adapted for conformable, circumferentially distributed and collectively opposed, tractional engagement with the work piece. The grip element is further configured to link relative axial displacement, or stroke, between the main body and grip surface in at least one axial direction, into radial displacement of the grip surface against the work piece with correlative axial and collectively opposed radial forces then arising such that the radial grip force at the grip surface enables reaction of the axial load into the work piece, where the distributed radial grip force is internally reacted, which arrangement comprises an axial load activated grip mechanism where axial load is carried between the drive head or reaction frame and work piece; the load adaptor, main body and grip element, generally acting in series.

This axial load activated grip mechanism is further arranged to allow relative rotation between one or both of the axial load carrying interfaces between the load transfer adaptor and main body or main body and grip element which relative rotation is limited by at least one rotationally activated linkage mechanism which links relative rotation between the load adaptor and grip surface into axial stroke of the grip surface. The linkage mechanism or mechanisms may be configured to provide this relationship between rotation and axial stroke in numerous ways such as with pivoting linkage arms or rocker bodies acting between the body assembly and gripping assembly but can also be provided in the form of cam pairs acting between the grip element and at least one of the main body or load transfer adaptor to thus readily accommodate and transmit the axial and torsional loads causing, or tending to cause, rotation and to promote the development of the radial grip force. The cam pairs, acting generally in the manner of a cam and cam follower, having contact surfaces are arranged in the preferred embodiment to link their combined relative rotation, in at least one direction, into stroke of the grip element in a direction tending to tighten the grip, which stroke thus has the same effect as and acts in combination with stroke induced by axial load carried by the grip element. Application of relative rotation between the drive head or reaction frame and grip surface in contact with the work piece, in at least one direction, thus causes radial displacement of the grip surface against the work piece with correlative axial, torque and radial forces then arising such that the radial grip force at the grip surface enables reaction of torque into the work piece, which arrangement comprises torsional load activation so that together with the said axial load activation, the grip mechanism is self-activated in response to bi-axial combined loading in at least one axial and at least one tangential or torsional direction.

In brief, a stroke or axial force activated grip mechanism, where the axial component of stroke causes radial movement of the grip surface into tractional engagement with the work piece, provides a work piece gripping force correlative with axial force, which tractionally resists shear displacement or sliding between the work piece and the gripping surface. The present invention provides a further rotation or torque activated linkage acting to stroke the grip surface in response to relative rotation induced by torque load carried across and reacted within the tool in at least one rotational direction, which rotation or torque induced stroke is arranged to have an axial component that causes the radial movement of the grip surface with correlative tractional engagement of the work piece and gripping force internally reacted between the work piece and grip mechanism structure.

External Torque-Activated Wedge-Grip

Tools incorporating a self-activated bi-axial tubular gripping mechanism may be arranged to grip on either the interior or exterior surface of the tubular work piece. One embodiment of the gripping tool, which will hereinafter be further described, has a gripping element in the general form of tangentially or circumferentially distributed jaws or slips acting as annular wedges disposed between the work piece and a mating annular wedge structure provided in the main body as commonly known in the art in mechanisms such as rig floor slips, referred to hereafter as an annular wedge-grip. For clarity, the exterior gripping configuration is here next described, the tool then having an interior opening where the gripping interface containing the jaws is located, and into which opening the tubular work piece is placed and gripped. This embodiment of gripping tool is adapted to structurally interface with a drive head or reaction frame through a load transfer adaptor connected to an elongate generally axi-symmetric hollow main body having an internal opening in which the tubular work piece is coaxially located. An interval of the internal opening in said main body is profiled to have two or more circumferentially distributed and collectively opposed contact surfaces of decreasing diameter or radii in a defined axial direction together defining the annular wedge structure provided in the main body or what will be referred to hereafter as a ramp surface, which ramp surface may be axi-symmetric or comprised of generally circumferentially distributed collectively opposed faces or facets and is defined in part by a taper providing the decreasing radius in one selected axial direction forming at least one annular interval with the tubular work piece which annular interval is thus characterized by a generally cylindrical interior surface and a profiled exterior ramp surface defining a direction of decreasing annular thickness in a selected axial direction. A plurality of jaws, connected by means to maintain them in axial alignment, with respect to each other, act as the grip element and are distributed in this annular interval so as to collectively oppose each other, fitting to and adapted for non-slipping and axial sliding engagement with, respectively, on one side the cylindrical exterior of the tubular work piece and on the opposed side the ramp surface, the combination of the individual distributed jaw surfaces in contact with the work piece is understood to form the grip surface as taught by the present invention. With which annular wedge grip arrangement, the jaws being in tractional contact with the work piece and sliding contact with the ramp, upon application of axial load, with correlative axial displacement to the work piece in the direction of decreasing annular thickness, the jaws, acting as annular wedges, tend to move axially or stroke with the work piece and slide on the ramp surface, and are thereby urged radially inward, correlatively increasing the radial contact forces between the jaw and the work piece; which radial and axial forces on the jaw are reacted at the ramp surface into the main body. The increase of radial force at the jaw/pipe interface in turn increases resistance to sliding as controlled by the effective friction coefficient of this interface, which resistance to sliding is referred to here as the grip capacity, and acts to react the applied axial load. For applications where gripping without sliding at the jaw/tubular interface is required the grip capacity is arranged by manipulation of geometry and contact surface tractional characteristics to exceed the applied axial load. Conversely, sufficient reduction of axial load, and correlative axial displacement or stroke having an axial component in the direction of increasing annular thickness, tends to slide the jaws on the ramp surface, in the direction of increasing annular thickness, allowing them to retract, decreasing the radial forces, and when sufficiently retracted, disengage the tool from the tubular work piece. This feedback behaviour between applied axial load and radial reaction force or gripping force, is herein referred to as unidirectional axial load activation. The aligning of the jaws may be accomplished variously such as where the jaws flexibly attach to a ring outside the plane of the jaws as in a collet, or in the plane of the jaws with hinges between jaw segments as commonly used with rig floor slips, but can be aligned both circumferentially and axially when placed in the windows of a cage as will be subsequently explained in certain configurations of the preferred embodiment. Regardless of the means of alignment, force applied directly to the jaws or through the means of alignment is generally considered herein to act on the jaws unless otherwise stated or implied.

This wedge-grip arrangement is well adapted to gripping tubulars and reacting uni-directional axial load, but cannot independently react torsional load, i.e., independent of applied axial load. It will be seen that the maximum torsional load that can be carried by the grip without slippage at the jaw/pipe interface or grip surface is at most limited by the grip force capacity in the direction imposed by the combined axial and tangential load vectors (compound friction effect), and where the ramp surface is axi-symmetric, i.e., comprised of one or more frusto-conical surfaces, may be further limited by rotational sliding or spinning allowed at the jaw/ramp surface interface unless otherwise constrained by means such as axial keys and keyways or splines and grooves. In either case, the magnitude of torque that may be reacted through the grip without sliding is dependent on the external axial load, so that substantial torque can only be reacted if substantial axial load is simultaneously present and carried by the work piece. To overcome these limitations while retaining the self activating characteristics of the wedge-grip, the method of the present invention provides means to allow rotation in at least one of the load adaptor to main body connection interface (body/adaptor) and the jaw/ramp interface (jaw/body) which simultaneously then allows relative rotation between the jaws and load adaptor (jaw/adaptor). The relative rotation of these three (3) possible component pairs, in the preferred embodiment, is then constrained by one or more cam pairs arranged to link the allowed rotation in at least one direction with axial displacement of the jaws relative to the main body in the direction of decreasing annular thickness tending to urge the jaws into greater contact with the work piece. These movements induce correlative radial, torsional and axial forces enabling transfer of torque into the work piece by internal reaction of the axial force required to activate the annular wedge grip between the jaws and main body either directly or through the load adaptor.

At least seven different configurations providing such rotation or torque activation are possible depending on how the rotational and axial movements are restrained by connections and linkages provided between the three (3) possible component pairs of jaw/body, jaw/adaptor and body/adaptor. These combinations are described below and summarized in Table 1. However, for pedagogical clarity, the simplest of these configurations, referred to herein as the base configuration, is now explained first as it can be considered to form the base case from which stem each of the other six (6) torque activated wedge grip architectures.

In this base configuration, the wedge grip ramp is axi-symmetric, allowing rotation of the jaws within the main body, the load adaptor is either integral with or otherwise rigidly attached to the main body and coaxially placed cam pair components are attached to and acting between respectively the jaws and main body, where the cam pair is arranged to interact and respond to relative applied rotation and correlative torque so as to contact each other at an effective radius and tend to induce relative axial displacement from rotation in at least one direction. The cam profile shape, over at least a portion of its sliding surface, is selected so that the angle of contact active in the cam pair acts to cause movement along a helical path having a lead or pitch to thus urge the jaws to stroke with an axial component in the direction of decreasing annular thickness under application of torque causing contact between the cam pair in the at least one direction of rotation.

Thus arranged, application of torque sufficient to cause rotational sliding of the jaws on the ramp surface, and press the cam pair into contact, simultaneously results in an axial force component, with associated displacement component acting between the main housing and the jaws and reacted through the cam pair, tending to urge the jaws radially inward against the tubular work piece in a manner analogous to the effect of axial load reacted between the main housing and the work piece, where in this instance the applied torque is fed back to increase the grip force, i.e., a self activated torque grip. However, unlike the uni-directional nature of axial load activation, bi-directional torque activation can be provided where contact between the cam and cam follower surfaces is provided in both right and left hand torque directions of sliding as is usually desirable for applications where threaded connections must be made up and broken out.

Furthermore, with this arrangement, the applied torque is reacted through and shared between the cam pair interface and the jaw/ramp interface as a function of the normal force and sliding friction force vectors arising on these contacting surfaces. It will be apparent then, that as axial load carried by the tubular work piece increases, the component of axial force and torque reacted through the cam pair, and contributing to torque activation as such, will decrease while the component of torque carried at the jaw/ramp interface will increase. The cam pair contact profiles and radius with associated pitch are selected to control the effective mechanical advantage, in both right and left hand rotational directions, according to the needs of each application to specifically manipulate the relationship between applied torque and gripping force, but also to optimize secondary functions for particular applications, such as whether or not reverse torque is needed to release the tool subsequent to climbing the cam. It will be evident to one skilled in the art that many variations in the cam and cam follower shapes can be used to generally exploit the advantages of a torque activating grip as taught by the present invention.

As will now be apparent, to obtain torque or rotation activation of an annular wedge grip, having this base configuration architecture, constrains the jaws to slide on the ramp surface in a direction generally defined by the helical pitch of the contacting cam pair profile. The radial grip force is also reacted through this jaw/ramp interface, with correlative frictional resistance to sliding, tending to reduce the effective torsional mechanical advantage of the grip in response to torque activation. The effective torsional mechanical advantage is here understood to mean the ratio of grip force to tangential force that arises from applied torque and acts at the grip surface. For this and other reasons it is advantageous in some applications to generally allow rotation between the adaptor and main body and react torque by providing means to variously constrain the relation between axial and rotational movement allowed between the already mentioned three possible interfaces of, jaw/body, jaw/adaptor and body/adaptor. The means of constraining the motion can be considered to be generalized cam pairs acting therebetween, where the constraint is defined in terms of the helix angle or pitch of the cam profile as follows:

Flat: At one limit the pitch is zero, i.e., a flat helix angle allowing rotation without axial movement.

Axial: At the other limit the pitch is infinite or nearly infinite, i.e., allowing axial or longitudinal movement without substantial rotation.

Cam: Intermediate between these two extremes the pitch or helix angle can be considered as profiled. It will be understood, that similar to other cam and cam follower pairs, the contact angle need not be constant over the range of motion controlled by the cam pair.

Free: With respect to rotational constraint, the jaw/body interface may also be left free.

According to the teachings of the present invention, these characteristic profiles may be employed in combination with each other to provide torque activation according to the various arrangements shown in Table 1.

TABLE 1

Combination of generally possible relative movement constraints acting in cam pairs provided between main component pairs of a wedge-grip mechanism providing torque activation.

| Configuration | Jaw/Body | Jaw/Adaptor | Body/Adaptor |
|---|---|---|---|
| 1 - Base | Cam | N/A | Fixed |
| 2 | Free | Cam | Cam |
| 3 | | Cam | Flat |
| 4 | | Flat | Cam |
| 5 | Axial | Cam | Cam |
| 6 | | Cam | Flat |
| 7 | | Flat | Cam |

An axi-symmetric ramp surface is required not only for the base case in Configuration (1), as already indicated, but is also implied for cases 2, 3 and 4. Configurations 5-7 support non-axi-symmetric wedge-grip configurations such as faceted ramps shown for example by Bouligny in U.S. Pat. No. 6,431,626, as well as generally axi-symmetric wedge-grip ramp surfaces having means to key the circumferential position of the jaws to the main body where such fixed alignment is preferable. It will be evident to one skilled in the art that in addition to the two general conditions of "free" and "axial", numerous variations in the jaw/body constraint are in fact possible such as helical, free over some limited range of motion, etc., all of which variations are understood to form part of the method of the present invention.

Considering now the mechanics offered by Configurations 2-7, it will be apparent that under application of torque across the tool tending to increase the grip force, little (Configurations 2-4) or no rotational sliding (Configurations 5-6) is required to occur on the jaw/ramp interface reacting the radial grip force and all the applied torque is reacted through and shared by the jaw/adaptor and body/adapter cam pairs as a function of the normal force and sliding friction force vectors arising on these contacting cam pair surfaces. These surfaces only react the axial load component of the grip force generated by sliding of the jaws on the ramp, which through appropriate selection of ramp angle can be much less than the normal force acting on the ramp surface to react the grip force and thus through appropriate selection of cam pitch and cam radius a means is provided to increase the torsional mechanical advantage of the grip mechanism for these configurations relative to that of the base configuration (Configuration 1). It will also be apparent that for Configurations 5-7 the operative helix pitch causing torque or rotational activation is in fact the sum of that provided on the jaw/adaptor and body/adaptor cams and is similarly so, for at least a range of cam helix pitches for Configurations 2-6. Thus these configurations all generally form a second group primarily offering a means to improve the torsional mechanical advantage of the grip mechanism. However, depending on the needs of individual applications, the specific mechanics and geometry of one configuration may be preferable over another.

As an alternate means to enable torque transfer though an annular wedge-grip, a separate internally reacted means of applying axial force to activate the grip element may be provided by such means as a spring, whether mechanical or pneumatic, or by one or more hydraulic actuators, said means of applying axial force acting between the jaws and the main body and tending to force or stroke the jaws in the direction of decreasing annular thickness and thus invoking the same gripping action as occurs where an external axial load is applied through the work piece to thus pre-stress the grip with an internally reacted axial force. In accordance with the method of the present invention, these methods of pre-stressing may be used together with the method of torque activation as taught herein.

Another method of torque or rotational activation of a wedge-grip like mechanism is disclosed by Appleton in WO 02/08279, where internally gripping grapples, acting as jaws, are adapted to engage with the internal surface of a work piece on one side and react against the external surface of a multi-faceted mandrel or main body on the other side, such that application of rotation in one direction tends to cause relative movement between the grapples and mandrel, where one component of the movement is radially expansive and a second is tangential. However it will be seen that unlike the self-activated bi-axial tubular gripping mechanism of the present invention, this method does not rely on axial displacement of the grip surface relative to the tool body to obtain the torque activating effect and does not enjoy the bi-directional torque activation provided by the present invention. Also unlike the torque activated wedge grip of the present invention, where application of torque tends to urge the jaws in a purely radial direction relative to the work piece, the tangential component of the movement induced by relative rotation, in the method taught by Appleton, has a tendency to distort the shape of the grip surface and locally indent the work piece being gripped, which potentially damaging and undesirable tendency, is avoided by the method of the present invention. Furthermore, the allowance for tangential displacement of individual grapples relative to the mandrel necessary for the function of this mechanism to translate relative rotation between the mandrel and grapples into a movement having a radial component, also makes the mechanism sensitive to slight variations in the relative circumferential positioning of the grapples on the mandrel when the tool is set. It will be apparent to one skilled in the art that adequate means to provide such precise circumferential positioning is not disclosed in WO 02/08279. However, this deficiency can be remedied by the method of the present invention where a cage is provided, and jaws are carried in the windows of the cage generally replacing the grapples. Using this method of carrying the jaws, and where the mating surfaces between the individual jaws and mandrel are arranged to have an included angle, the grip mechanism can also be made to be bi-directionally torque activated within a single stage.

In tools incorporating a self-activated bi-axial tubular gripping mechanism employing a wedge-grip architecture, the ability to axially align and stroke the jaws in unison is generally not only required to symmetrically grip the work piece while transferring load, but in many applications it may also be required to move the jaws radially into and out of engagement with the work piece. The radial range of movement provided will depend on the application to accommodate requirements such as, variations in pipe size and for externally gripping tools, the ability to pass over larger diameter intervals such as couplings in a casing string when moving the work piece into, out of, or through the interior opening of the tool, depending on whether the tool is configured to only accept an end of the tubular work piece or configured with an open bore to allow through passage of the tubular work piece.

Similarly, control of stroke position in support of actuating the grip may be variously configured depending on the application requirements. Springs and gravity may be used to bias the grip open or closed, separately or in combination with secondary activation such as say hydraulic or pneumatic devices to thus set and unset the jaws. In many applications the jaws are set and unset by hand, as commonly practiced with slips around casing deployed with a slip bowl on the rig floor. Where the jaws are biased to be closed under action of a spring or gravity force, a latch may be provided to act between the jaws or jaw and cage assembly, which latch is arranged to hold the jaws open against the spring load while positioning the work piece within the grip, and means provided to release the latch allowing the spring or gravity forces to stroke the jaws into engagement with the work piece and set the tool. Similarly, means to disengage and relatch the jaws may also be provided.

To support applications requiring greater retraction displacement of the jaws, means can therefore be provided to maintain the jaws in contact with the ramp surface when stroking in a range out of contact with the work piece, which means can be by forces of attraction acting across the interfacial region between the jaw and main body ramp surface, radial force or hoop forces provided by springs acting on or between the jaws urging them outward or by secondary guiding cams such as T-bolts in a T-slot. Forces of attraction across the interfacial contact region can be from surface tension of the lubricant disposed therein, suction created by provision of a seal near the perimeter of the jaw contact region tending to expel said lubricant when compressed but preventing re-entry when unloaded, or magnetic by means of magnets attached to either the jaw or main housing and arranged to act there between. Radial force on the inside surface of the jaws can be provided by a garter or similar radially acting spring placed in a groove provided in the jaw inside surface so as not to crush the spring by contact with the work piece.

As already indicated, means of aligning the jaws in tools incorporating a wedge-grip architecture may be accomplished variously such as by radially flexible links connecting to a ring or similar body, outside the plane of the jaws where the ring is constrained to remain planar while stroking as in a collet or by arms as taught by Bouligny (U.S. Pat. No. 6,431,626B1), or in the plane of the jaws with hinges between jaw segments as commonly used with rig floor slips. These means of connection maintain the jaws in axial alignment with respect to each other to ensure their separate interior surfaces are generally coincident with the same cylindrical surface while their exterior surfaces are coincident and in contact with the interior ramp surface of the main body, i.e., to coordinate their radial movement with respect to their axial movement when in contact with the ramp surface of the main body and displaced or stroked in directions of decreasing or increasing annular thickness, with respect to the main body. In some cases, connecting components, such as arms, are also employed to transfer axial load to set or stroke the jaws. Such components may be pressed into duty to also transfer torsional load when used as a means to transfer load to the jaws under torsional load activation, as taught by the method of the present invention, where they offer sufficient torsional strength and stiffness, but according to the teachings of the preferred embodiment of the present invention, the jaws can be aligned both circumferentially and axially by a cage as will now be explained.

In accordance with another broad aspect of the present invention, a cage is provided as a means to axially align the jaws in tools incorporating a self-activated bi-axial tubular gripping mechanism employing a wedge-grip architecture. Said cage has an elongate generally tubular body and is placed coaxially inside the main body, extending through the same annular space as the jaws, the cage having openings or windows in which the jaws are located where the dimensions and shape of the windows and jaws are arranged so that their respective edges are close fitting, and yet allow the jaws to slide inward and outward in the radial direction as they are urged to do so by contact with the ramp surface; the cage also having generally axi-symmetric ends extending beyond the interval occupied by the jaws. The choice of materials and dimensions for the cage and jaws is selected so that the assembly of jaws in the cage together provide a suitably torsionally strong and stiff structure for transfer of load from the cam pair acting on the jaws under application of torque causing activation of the jaws. Because the jaws are close fitting in the windows of the cage, they tend to prevent contaminants from passing between there respective edges, however seals can be provided to act between the jaw and window edges, and between the cage ends and main body, to further and more positively exclude contaminants and contain lubricants in the region where sliding between the jaws and main body occurs.

Where torque is required to activate or set a tubular running tool, as for example required to mechanically set a cage grip tool described in U.S. Pat. No. 6,732,822 B2, means to react the setting torque is required when connecting the running tool to a joint of pipe that is not connected to the string. Where the tubular running tool is deployed on a rig having mechanical pipe handling arms, these arms typically clamp the pipe in a position enabling the tubular running tool to be inserted into or over the pipe end and react the torque required to set.

To support applications where such torque reaction means may not be readily available, it is a further purpose of the present invention to provide a tubular or casing clamp tool having a bi-axially activated tubular gripping mechanism where the gripping element is a base configuration torque activated wedge-grip, incorporated into a compression load set casing clamp tool configured to generally support and grip the lower end of a joint of casing and react torque into the rig, having a main body and load adaptor at its lower end configured to react to the rig structure, preferably by interaction with the upper end of a casing string supported in the rig floor, the so called casing stump, and having at its upper end either an internal or external wedge-grip element adapted for respective insertion into or over the lower end of a tubular work piece. The ramp surface taper of main body and grip element is configured to grip in the direction of stabbing or compression; a bias spring is provided to act between the jaws and main body, configured to bias the jaws open, with respect to the work piece, the spring force selected to readily hold the jaws open under gravity loads but readily allow the jaws to stroke and grip under the available set down load of the work piece; the jaws or cage and jaw assembly is provided with a land located below the jaws and engaging with the lower end of the work piece, so as to react compressive load applied by transfer of a portion of the work piece and top drive weight sufficient to compress the bias spring and thus simultaneously stroke the jaws and correlatively move radially into engagement with the work piece whereupon any additional axial load reacted into the tool pre-stresses the grip element. Thus configured, the casing clamp tool is simply compression set and unset by control of weight transferred from the otherwise supported work piece.

There will now be described in detail particular tool configurations applying the above described teachings in practical configurations.

External Grip Tubular Running Tool

Figure 1:
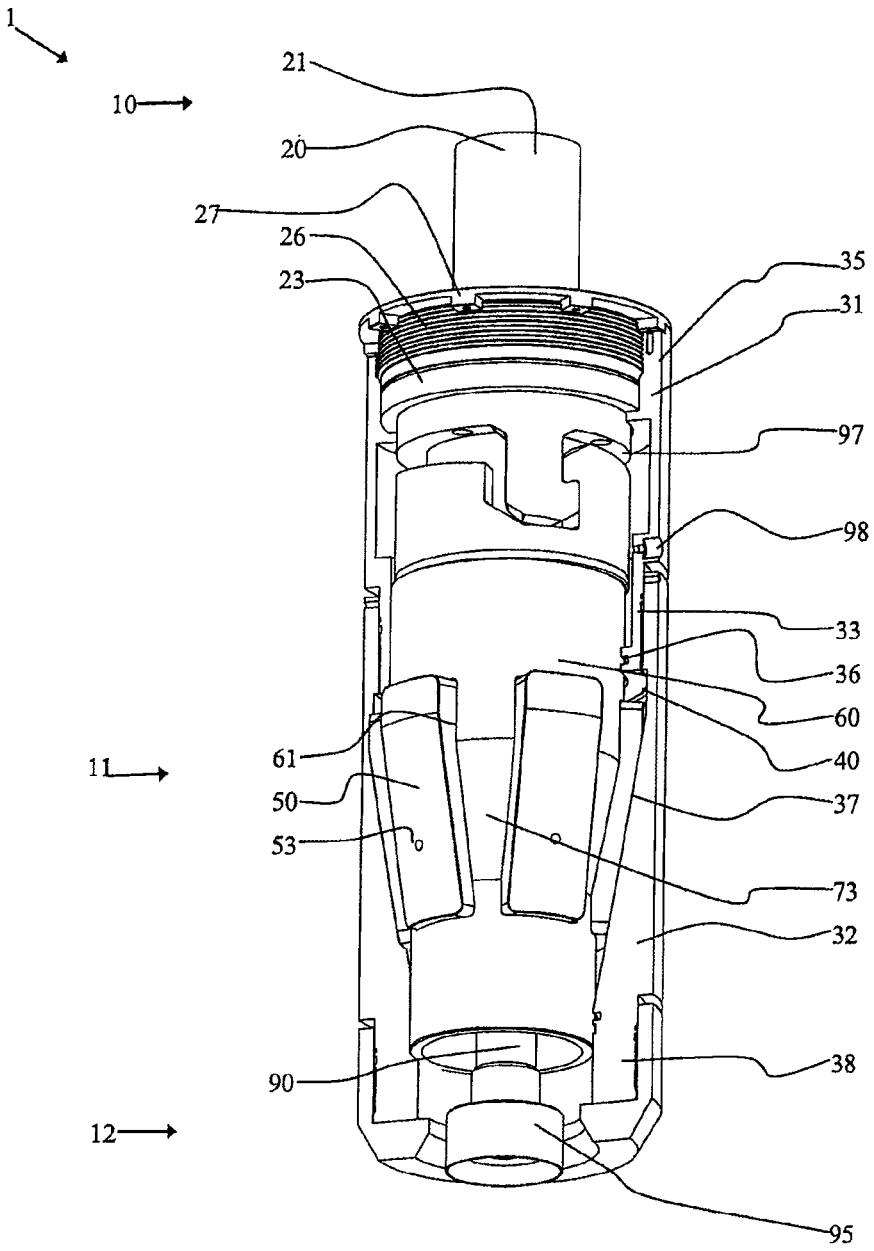
FIG. 1 is a partial cutaway isometric view of a tubular running tool provided with an external bi-axially activated wedge-grip mechanism in its base configuration architecture (latched position w/o casing).
Figure 2:
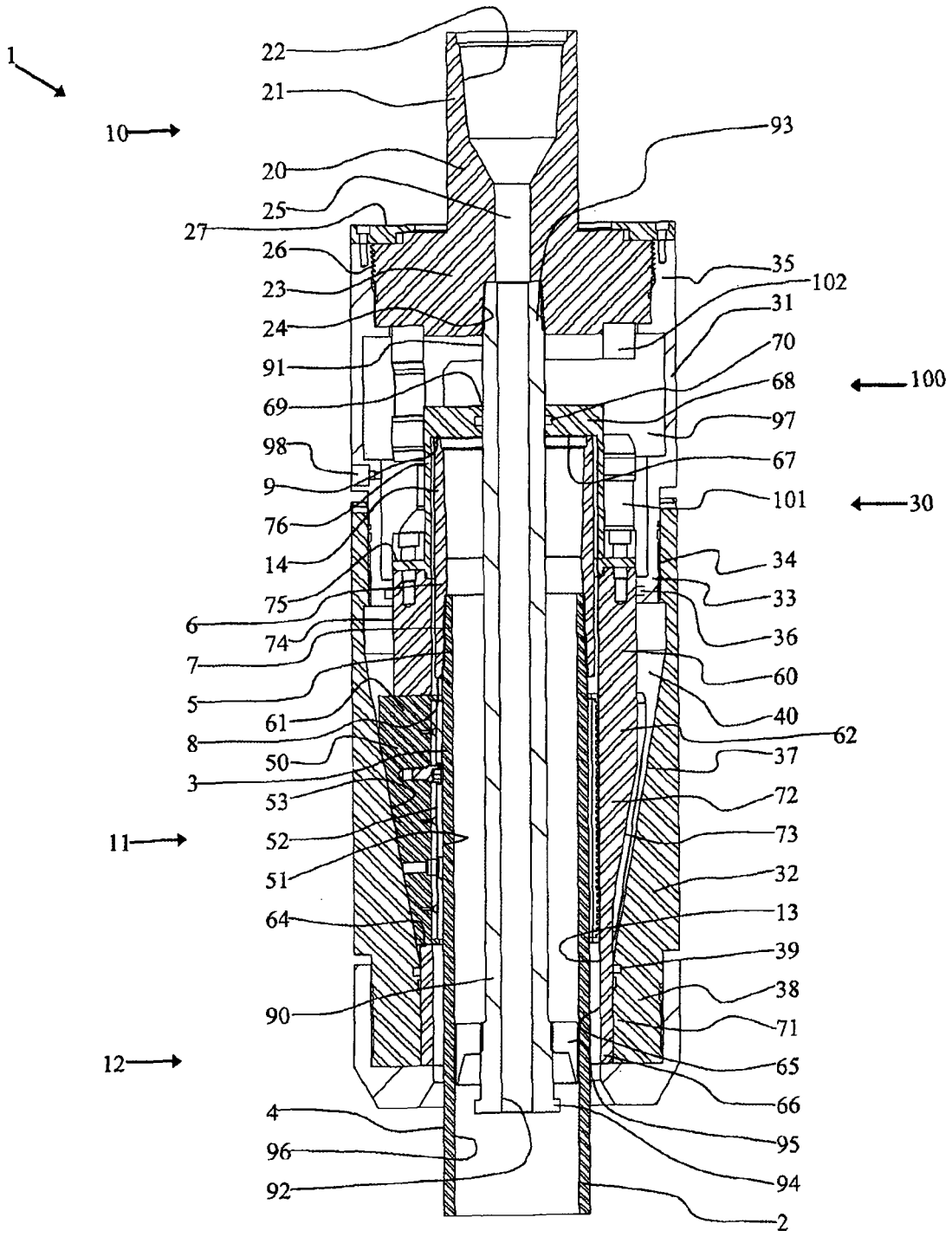
FIG. 2 is a cross-section view of tubular running tool shown in FIG. 1 as it appears in its set position gripping the proximal end of a threaded and coupled segment of casing

Referring to FIGS. 1 through 9, there will now be described a preferred embodiment, of gripping tool, referred to here as an "external tubular running tool". The external tubular running tool has its grip element provided as a wedge-grip and is incorporated into a mechanically set and unset tubular running tool, embodying the base configuration torque activation architecture. This 'base configuration wedge-grip' bi-axially activated tubular running tool is shown in FIG. 1, generally designated by the numeral 1, where it is shown in an isometric partially sectioned view as it appears configured to grip on the external surface of a tubular work piece, hence this configuration is subsequently referred to as an external grip tubular running tool. Referring now to FIG. 2, this exterior gripping configuration of the preferred embodiment is shown in relation to tubular work piece 2 as it is configured for running casing strings comprised of casing joints or pipe segments joined by threaded connections arranged to have a 'box up pin down' field presentation, where the most common type of connection is referred to as threaded and coupled. Work piece 2 is thus shown as the upper end of a threaded and coupled casing joint having a pipe body 3 with exterior surface 4 and upper externally threaded pin end 5 preassembled, by so called mill end make up, to internally threaded coupling 6 forming mill end connection 7. It is generally preferable to transfer torsional loads directly into the pipe body 3, by contact with exterior surface 4, and not through the coupling 6 to prevent inadvertent tightening or loosening of the mill end connection 7; hence in its preferred embodiment the tool is configured to grip the pipe body 3 below the bottom face 8 of the coupling 6, the top face 9 of coupling 6 thus being landed at least one coupling length above the grip location. It will be understood that reference to the presence of a coupling on the upper end of the work piece is not an essential requirement for the functioning of this preferred embodiment of the present invention as a tubular running tool, nonetheless, as will become clear later, the upset presence of the coupling can be advantageously employed.

Referring still to FIG. 2, tubular running tool 1 is shown in its set position, as it appears when engaged with and gripping the tubular work piece 2 and configured at its upper end 10 for connection to a top drive quill, or the distal end of such drive string components as may be attached thereto, (not shown) by load adaptor 20. Load adaptor 20 connects a top drive to an external bi-axially activated gripping element assembly 11 having at its lower end 12 an interior opening 13 where the external gripping interface is located and into which interior opening 13 the upper or proximal end 14 of a tubular work piece 2 is inserted and coaxially located.

Load adaptor 20 is generally axi-symmetric and made from a suitably strong material. It has an upper end 21 configured with internal threads 22 suitable for sealing connection to a top drive quill, lower end 23 configured with lower internal threads 24, an internal through bore 25 and external load thread 26.

Main body 30, is provided as a sub-assembly comprised of upper body 31 and bell 32 and joined at its lower end 33 by threaded and pinned connection 34, both made of suitably strong and rigid material, which material for bell 32 is preferably ferrous. Load adaptor 20 sealingly and rigidly connects to upper body 31 at its upper end 35, by load thread 26 and torque lock plate 27, which is keyed to both load adaptor 20 and upper body 32, to thus structurally join load adaptor 20 to main body 30 enabling transfer of axial, torsional and perhaps bending loads as required for operation. Upper body 31 has a generally cylindrical external surface and a generally axi-symmetric internal surface carrying seal 36. Bell 32 similarly has a generally cylindrical external surface and profiled axi-symmetric internal surface characterized by; frusto-conical ramp surface 37 and lower seal housing 38 carrying lower annular seal 39, where the taper direction of ramp surface 37 is selected so that its diameter decreases downward, thus defining an interval of the annular space 40, between the main body and the exterior pipe body surface 4, having decreasing thickness downward.

A plurality of jaws 50, illustrated here by five (5) jaws, are made from a suitably strong and rigid material and are circumferentially distributed and coaxially located in annular space 40, close fitting with both the pipe body exterior surface 4 and frusto-conical ramp surface 37 when the tubular running tool 1 is in its set position, as shown in FIG. 2; where the internal surfaces 51 of jaws 50 are shaped to conform with the pipe body exterior surface 4, and are typically provided with rigidly attached dies 52 adapted to carry internal grip surface 51 configured with a surface finish to provide effective tractional engagement with the pipe body 3, such by the coarse profiled and hardened surface finish, typical of tong dies; where the external surfaces 53 of jaws 50 are shaped to closely fit with the frusto-conical ramp surface 37 of the bell 32 and have a surface finish promoting sliding when in contact under load. The jaws 50 may also be provided with rare earth magnets (not shown) imbedded in their exterior surface, to create a force of attraction between the jaws and the ferrous material of bell 32 as one means to cause the jaws to retract during stroking that occurs to unset and disengage the tubular running tool 1 from the work piece 2. Alternately, the dies 52 may be provided in the form of collet fingers, where the spring force of the collet arms (not shown) is employed to provide a bias force urging the jaws to retract.

Figure 3:
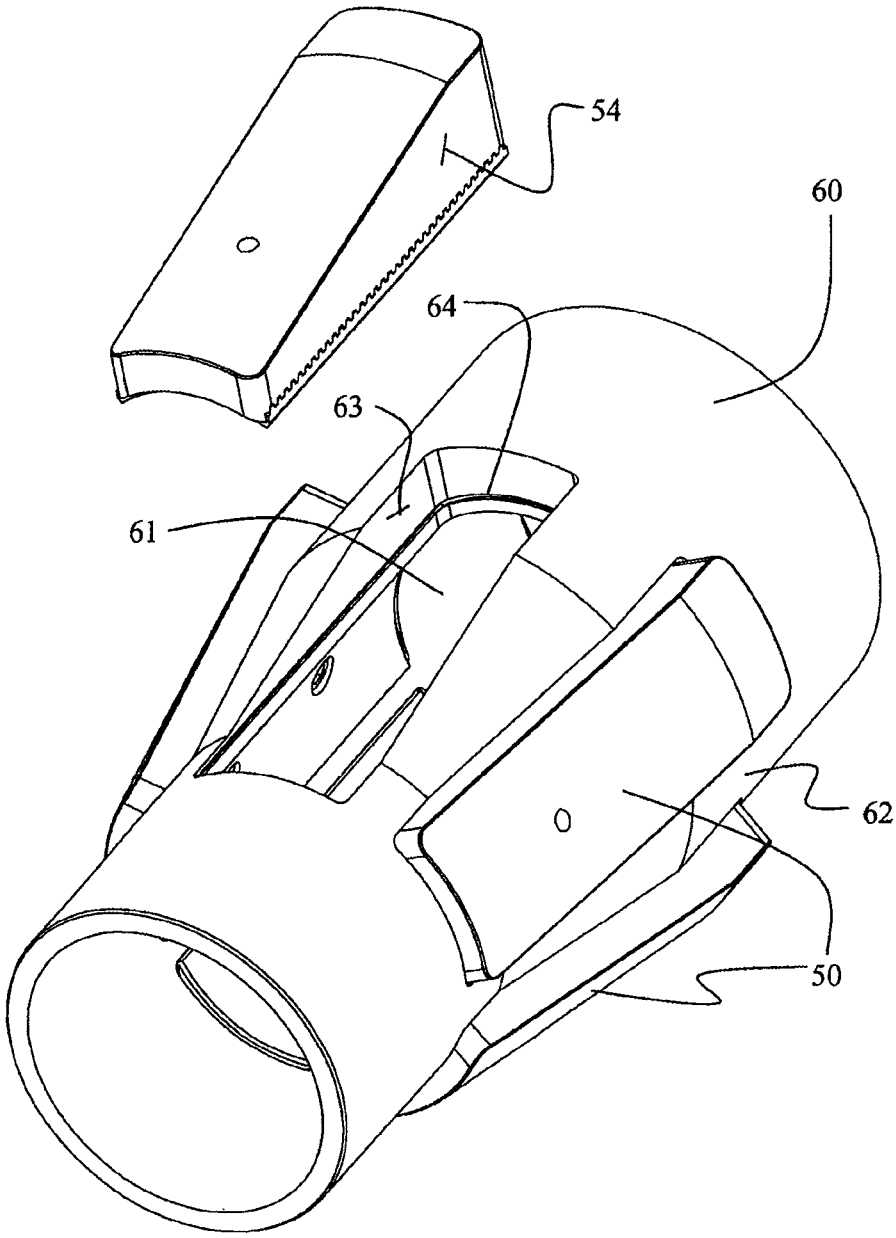
FIG. 3 is an isometric partially exploded view of jaws and cage assembly for tubular running tool shown in FIG. 1.

Cage 60, made of a suitably strong and rigid material, carries and aligns the plurality of jaws 50 within windows 61 provided in the cage body 62, which sub-assembly is coaxially located in the annular space 40, its interior surface generally defining interior opening 13, and its exterior surface generally fitting with the interior profile of the main body 30. Referring now to FIG. 3 where the sub-assembly of cage 60 and jaws 50 are shown in a partially expanded isometric view with one of the five (5) jaws displaced out of the window. Jaws 50 and windows 61 have respective external and internal edge surfaces 54 and 63 arranged to be in close fitting radially sliding and sealing engagement, which sealing engagement is provided by seals 64 carried within the internal edge 63 of the cage windows 61. Except for windows 61 provided in the cage body 62, cage 60 is generally axi-symmetric, and referring again to FIG. 2, has a cylindrical inside surface 65 extending from its lower end 66 upward to internally upset land surface 67 located at the upper end 68 of cage 60 at a location selected to contact and axially locate the top coupling face 9, of work piece 2, within interior opening 13, so that the jaws 50 grip the pipe body 3 below the coupling bottom face 8. Upper end 68 of cage 60 has an internal upper cage bore 69 carrying stinger seal 70.

The exterior surface of cage body 62 is profiled to provide intervals and features now described in order from bottom to top:

Lower end 66 having a cylindrical exterior forming lower seal surface 71, slidingly engaging with lower annular seal 39;

Window interval 72 with frusto-conical exterior surface 73 generally following but not contacting the frusto-conical ramp surface 40, the wall thickness and outside diameter of window interval 72 thus increasing upward to a location where the diameter becomes constant forming cylindrical upper seal surface 74 engaging seal 36, above the diameter of cage body 62 decreases abruptly to provide upward facing cam shoulder 75; and Cylindrical cam housing interval 76 extending to upper end 68.

Referring still to FIG. 2, a tubular stinger 90 is located coaxially on the inside of tubular running tool 1 and has a generally cylindrical outside surface 91 and through bore 92, upper end 93 and lower end 94. Upper end 93 is sealingly attached to the lower internal threads 24 of load adaptor 20 from which point of attachment tubular stinger 90 extends downward through upper cage bore 69, where its outside surface 91 slidingly and sealing engages with stinger seal 70. The lower end 94 of tubular stinger 90 thus extends into the interior of tubular work piece 2 and may be further equipped with an annular seal 95, shown here as a packer cup, sealing engaging with the internal surface 96 of the work piece 2, thus providing a sealed fluid conduit from the top drive quill through the bores of load adaptor 20 and the tubular stinger bore 92 into the casing, to support filling and pressure containment of well fluids during casing running or other operations. In addition, flow control valves such as a check valve, pressure relief valve or so called mud-saver valve (not shown), may be provided to act along or in communication with this sealed fluid conduit.

It will also now be evident that seals 36 and 39, together with the window seals 64, cage 60 and main body 30, also contain the ramp surface in the enclosed annular space 40. This containment of the sliding surfaces of the jaws within an environmentally controlled space facilitates consistent lubrication by exclusion of contaminants and containment of lubrication which containment is separately valuable in applications, such as offshore drilling, where spillage of oils and greases has adverse environmental effects. Preferably, means to allow annular space 40 to 'breathe' is provided in the form of a check valve (not shown) placed through the wall of either the cage 60 or main body 30 and located to communicate with the annular space 40 and external environment.

A sealed upper cavity 97 is similarly formed in the interior region bounded by load adaptor 20, upper body 31, cage 60 and stinger 90 where sliding seals 36 & 39 allow the cage to act as a piston with respect to the main body. Gas pressure introduced into sealed cavity 97 through valved port 98 therefore acts as a pre-stressed compliant spring tending to push the cage down relative to the main body.

Thus configured with the tool set, the jaws 50 are seen to act as wedges between main body 30 and work piece 2, under application of hoisting loads, providing the familiar uni-directional axial load activation of a wedge-grip mechanism, whereby increase of hoisting load tends to cause the jaws to stroke down and radially inward against the work piece 2, increasing the radial grip force enabling the tubular running tool 1 to react hoisting loads from the top drive into the casing. Gas pressure, in upper cavity 97 similarly increases the radial gripping force of the jaws tending to pre-stress the grips when the tool is set and augments or is additive with the grip force produced by the hoisting load.

Figure 4:
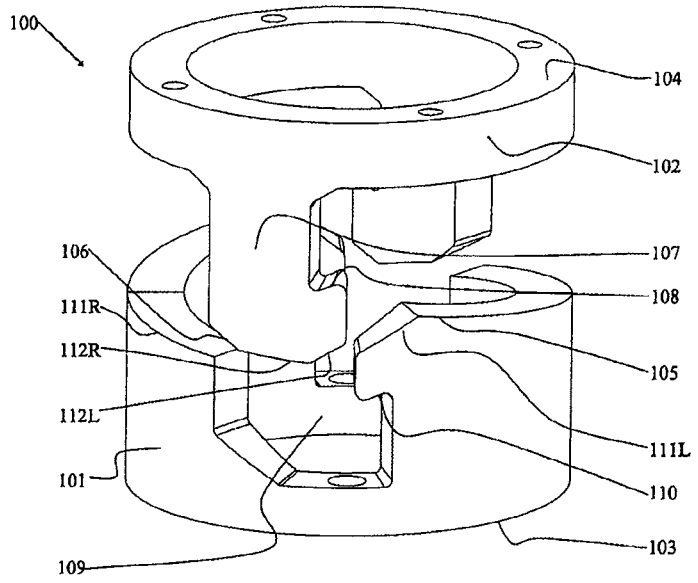
FIG. 4 is an isometric view of the cam pair assembly in the tubular running tool shown in FIG. 1 in their set position.
Figure 5:
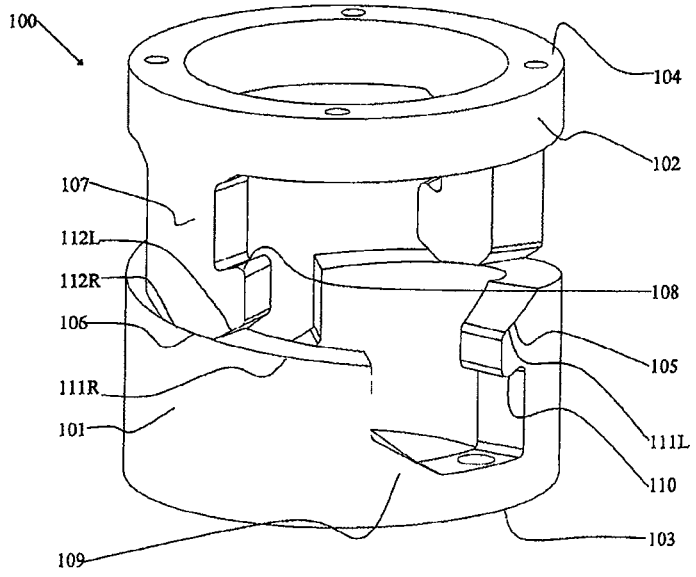
FIG. 5 is an isometric view of the cam pair assembly shown in FIG. 4 in their right hand torque position.
Figure 6:
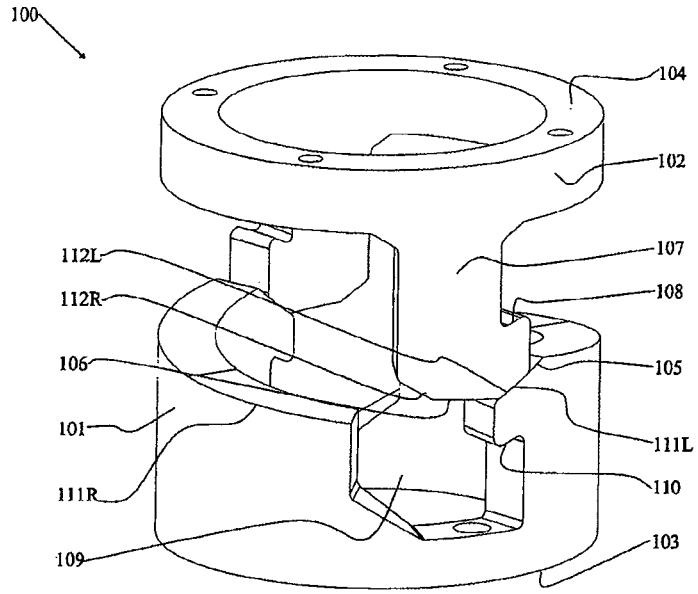
FIG. 6 is an isometric view of the cam pair assembly shown in FIG. 4 in their left hand torque position.

Cam pair 100 comprised of cage cam 101 and body cam 102 which are generally tubular solid bodies made from suitably strong and thick material and axially aligned with each other. Cam pair 100 is located in the annular space of upper cavity 97, coaxial with and close fitting to, cam housing interval 76 of cage 60. Cage cam 101 is located on and fastened to upward facing cam shoulder 75 of cage 60 and body cam 102 is located on and fastened to the lower end 23 of load adaptor 20. Referring now to FIG. 4, cam pair 100 are shown in an isometric view as cage cam 101 and body cam 102 are in relation to each other with the tubular running tool 1 in its initial set position, having flat outward facing end faces 103 and 104 respectively, and circumferentially profiled inward facing end surfaces 105 & 106 respectively. Body cam 102 has one or more downward protruding lugs 107, here shown with two (2) lugs, each lug 107 with profiled end surface 106 and a latch tooth 108. Cage cam 101 has pockets 109 corresponding to the lugs 107 also having corresponding latch teeth 110. Latch teeth 108 and 110 act as hook and hook receiver with respect to each other. Between the pockets 109, cage cam 101 has right and left hand helical surfaces 111R & 111L arranged to align axially with the mating helical surfaces 112R & 112L forming part of the profiled end surface 108 of body cam 102 when the tubular running tool 1 is unlatched.

Figure 7:
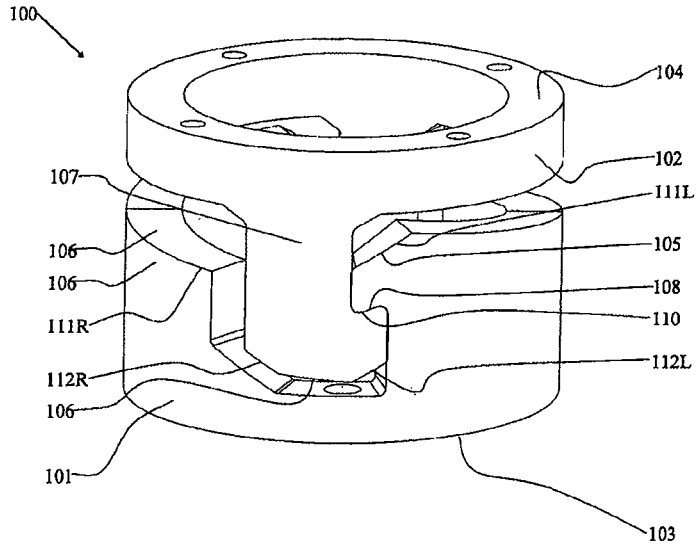
FIG. 7 is an isometric view of the cam pair assembly shown in FIG. 4 in their latched position.

The interaction between cage cam 101 and body cam 102 is now described with reference to FIGS. 4, 5, 6 & 7 for axial and rotational or tangential movements of the cam pair 100, where these motions are related to the tubular running tool functions of set, right hand torque (make up), left hand torque (break out) and unset. As shown in FIG. 4, with the tool just set the profiled ends 105 & 106 of cage cam 101 and body cam 102 respectively are in general, not engaged. The effect of right hand rotation, shown in FIG. 5, brings helical surfaces 111R and 112R and thereby tends to push the cam and cam follower apart as in response to right hand rotation as tends to occur under application of make up torque. Similarly the effect of left hand rotation, shown in shown in FIG. 6, brings helical surfaces 111L and 112L into contact and thereby also tends to push the cam and cam follower apart as required for torque activated break out. The pitches for mating helical surfaces 111R and 112R and 111L and 112L are selected generally to control the mechanical advantage of the applied torque to grip force according to the needs of the application, but in general are selected to promote gripping without sliding. FIG. 7 shows the cam pair 100 latched by engagement of latch teeth 108 and 110, where the motion to thus engage the latch is combined downward travel and left hand rotation which motions are reversed to release the latch.

Figure 8:
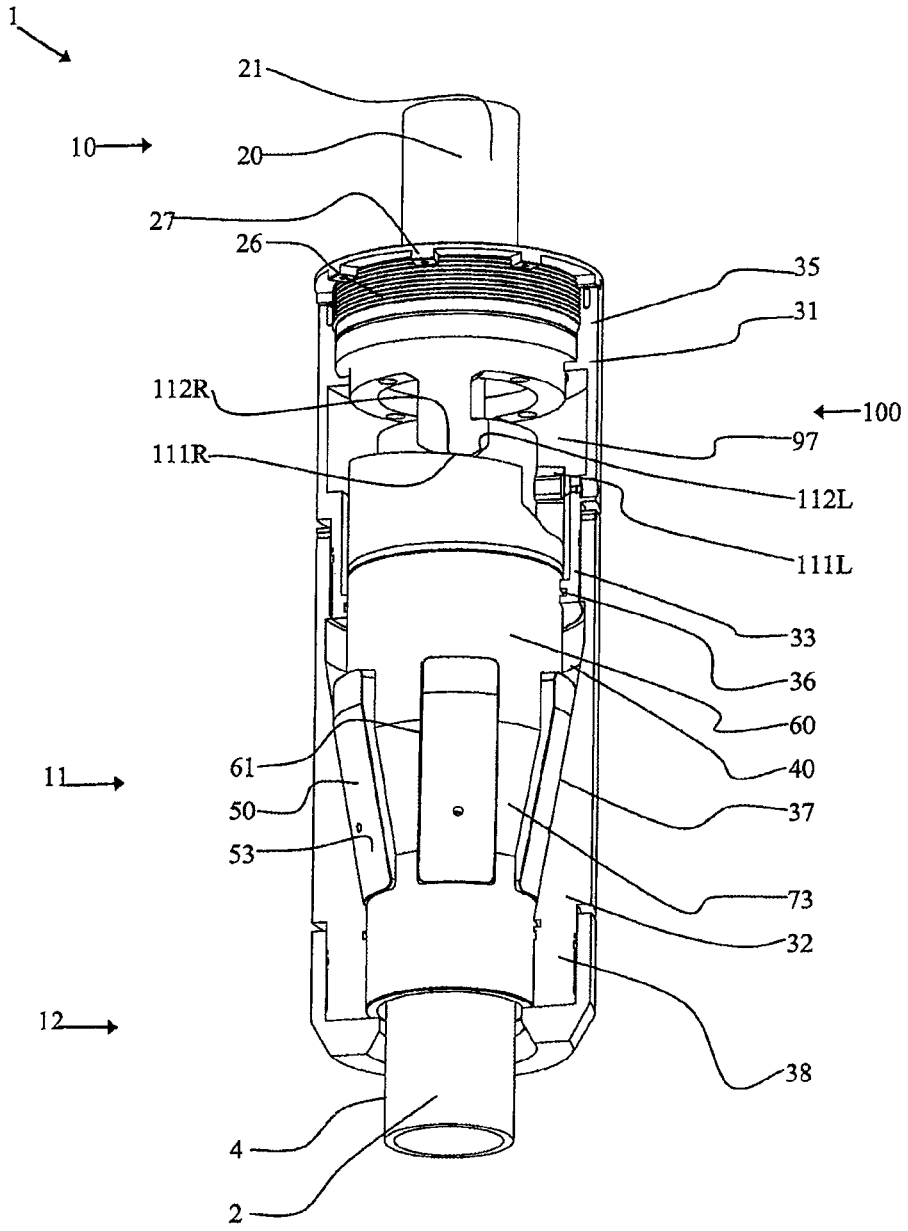
FIG. 8 is a partial cutaway isometric view of a tubular running tool shown in FIG. 2 as it appears under right torque causing rotation and torque activation.

It will now be apparent that because cage cam 101 and body cam 102 are fastened to the cage 60 and main body 30 respectively, they constrain their relative motions in the manner just described. Referring now to FIG. 8, where the tubular running tool 1 is shown in a partial cutaway view exposing the cam pair 100 and grip element 11, comprised of the sub-assembly of cage 60 and jaws 50, as it would appear set with the cage 60 referenced to and landed on casing by contact between coupling top face 9 and cage land 67, and under application of right hand torque applied by a top drive to the load adaptor 20, where the casing is considered fixed. The position of cam pair 100 in this case corresponds to that shown in FIG. 5 where, referring still to FIG. 8, it will be apparent that the applied right hand torque tends to cause sliding on the helical surfaces 111R and 112R forcing them apart and concurrently causes relative movement between the jaws 50 and frusto-conical ramp surface 37 on the same helical pitch the axial component of which movement strokes the ramp 37 of bell 32 upward relative to the jaws 50 causing them to displace radially inward and thus invoke a grip force between the jaws and work piece, which grip force reacts the applied torque as a tangential friction force at the jaw/casing interface of grip surface 51. Similarly, applying left hand torque causes relative rotation of the cam pair 100 in that direction and brings helical surfaces 111L and 112L into contact, as shown in FIG. 6, which again has the effect of increasing the jaw radial gripping force, enabling the tool break out function, which responses together are seen to provide bi-direction torque activation of the grip force in this preferred embodiment. However, uni-directional torque activation can be provided by selecting a sufficiently large pitch for the helix of one pair of helical contacting cam surfaces, 111R:112R or 111L:112L, should an application require this variation in function. The geometry and frictional characteristics of the cam pair 100 and the jaw/ramp contact at jaw exterior surface 53 and ramp 37, relative to that of the geometry and tractional capacity of the tangential friction force, thus operative at the jaw/casing interface grip surface 51, are all arranged to prevent slippage at the interface grip surface 51 by promoting slippage between the jaw exterior surface 53 and ramp 37 and in the cam pair 100, over the range of applied torque required by the application. The cam and cam follower contact profiles with associated angles of engagement, i.e., mechanical advantage, in both right and left hand directions, as the cam tends to climb and more generally ride on the cam follower, are thus selected according to the needs of each application to specifically manipulate the relationship between applied torque and gripping force, but also to optimize secondary functions for specific applications, such as whether or not reverse torque is needed to release the tool subsequent to climbing the cam. It will now be evident to one skilled in the art that many variations in the cam and cam follower shapes can be used to generally exploit the advantages of a torque activating grip as taught by the present invention.

Figure 9:
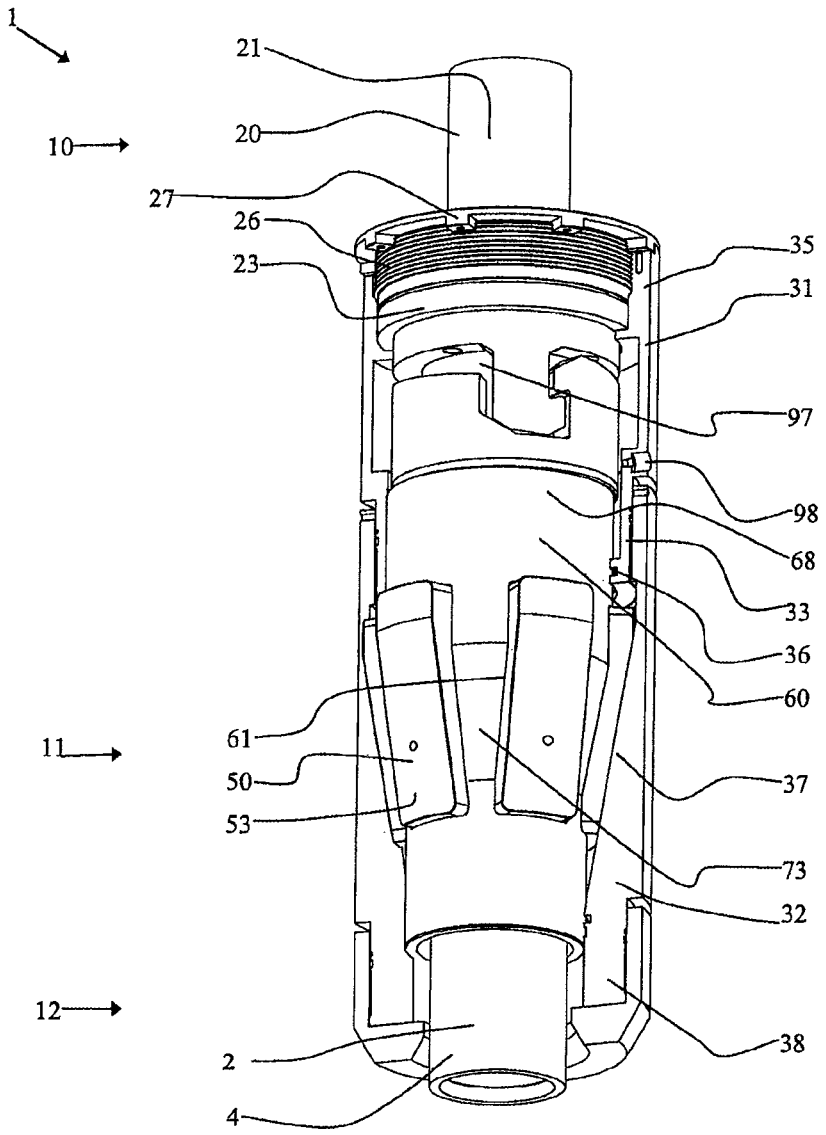
FIG. 9 is a partial cutaway isometric view of a tubular running tool shown in FIG. 2 as it appears under compressive load to unset and latch the tool open (retracted position).

Referring now to FIG. 9, application of compressive load to load adaptor 20 by the top drive, sufficient to overcome the spring force generated by gas pressure in upper cavity 97, is reacted externally by contact between coupling top face 9 and cage land 67, displacing the main body downward relative to the work piece 2 and allowing the jaws 50 to retract and draw away from the work piece 2 thus unsetting or retracting the tubular running tool, which position is latched by left hand rotation causing engagement of the latch teeth. The compressive displacement is limited by contact between the lower end 23 of load adaptor 20 and the upper end 68 of cage 60. Upon removal of the compression load, the engaged latch reacts the spring force locking the grip element to the main body and holding the jaws open, thus disengaging the tool from the work piece allowing it to be removed from the casing appearing then as shown in FIG. 1. Referring back to FIG. 7, it will be apparent that the hook and hook receiver need not be integral with, the profiled end surfaces 105 and 106 as shown here in this embodiment but, referring now to FIG. 2, may be provided to act between, for example, the lower end 66 of cage 60 and the lower seal housing end 38 of bell 32. The tubular running tool 1 is mechanically set and unset using only axial and rotational displacements, with associated forces, provided by the top drive without requiring actuation from a secondary energy source such as hydraulic or pneumatic power supplies; and thus enables rapid engagement and disengagement of the tool to the tubular work piece, reduces complexity associated with connection to and operation of secondary energy sources and improves reliability by eliminating dependence on such secondary energy sources.

Variations of Torque Activation Cam Architectures

The base configuration of a torque activated wedge-grip provided for the grip element in the preferred embodiment of a tubular running tool may be varied or adapted to implement the other configurations of this general architecture as listed in Table 1. These variations are now described by reference to FIGS. 10 through 13 representing the tubular running tool in simplified form. For reference, FIGS. 10A and B then show the 'base configuration' tool of the preferred embodiment, as shown in detail in FIGS. 1 through 9 and already described, but in a simplified form to more readily appreciate the architectural features of the torque activated wedge grip mechanism. FIGS. 11A and B, 12A and B and 13A and B then show the architectural variations of the various cam pair configurations. Also to aid comparison, each of the A and B Figure pairs of 10 though 13 show the tool as it appears in both its retracted or 'unset' and rotationally activated or right hand 'torqued' positions. The cam pairs are configured for bi-directional, i.e., right and left hand rotation, but only the active position under right hand torque is shown.

Base Configuration

Figure 10A:
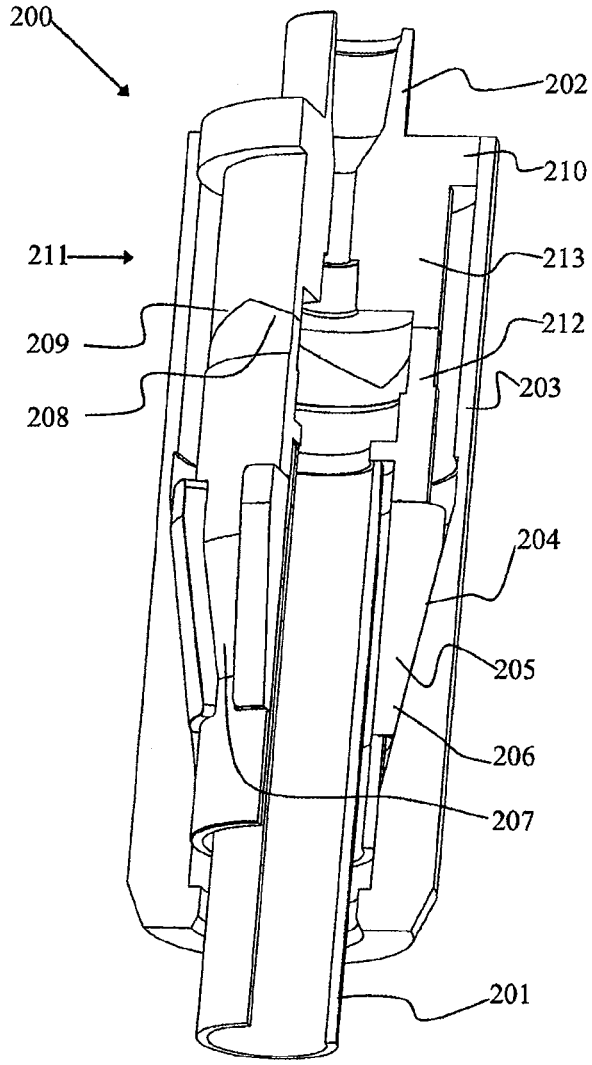
FIGS. 10 A and B are two partial cutaway isometric views showing a simplified representation of the tubular running tool, configured as it is shown in FIG. 2 with a wedge-grip mechanism in its base configuration architecture, in its unset (retracted) and set positions respectively.
Figure 10B:
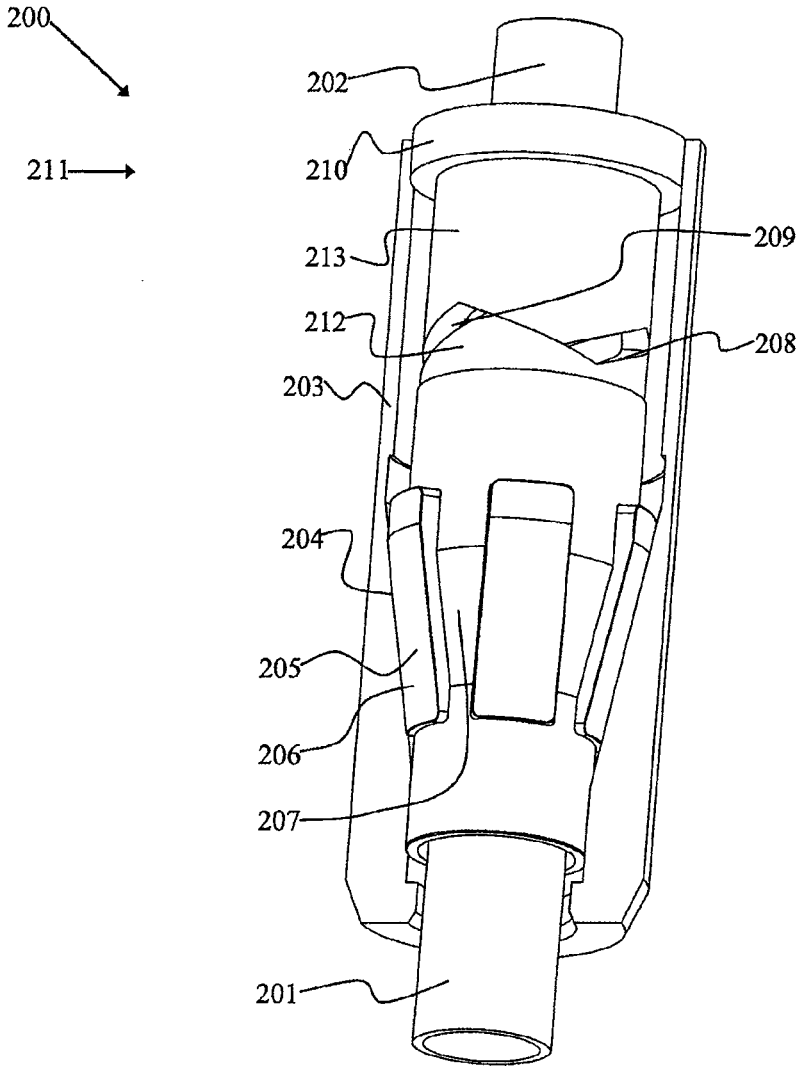

Referring now to FIG. 10A, a simplified external grip tubular running tool, embodying the base configuration of torque activated wedge-grip for the grip element is shown, generally indicated by the numeral 200. Tubular running tool 200 is engaged with work piece 201; has a load adaptor 202 with a lower end face 209, rigidly connected to a main body 203 through load collar 210; main body 203 has an internal axi-symmetric ramp surface 204, generally supporting and engaging with wedge-grip element 205; grip element 205 comprised of jaws 206 axially and rotationally slidingly engaging with ramp surface 204 and aligned and carried in cage 207 having an upper end 208 facing and opposed to the lower end 209 of load adaptor 202. Cam pair 211 is comprised of cage cam 212 and body cam 213 which are provided respectively on the opposing faces of upper end 208 of cage 207 and lower end face 209 of load adaptor 202, where the cam profile is a 'saw tooth', which will be seen to provide the same general helical functions coupling axial stroke to left and right hand rotation, as already explained with reference to FIGS. 5 and 6, which action provides bi-directional torque activation of the tubular running tool 200.

Comparing now FIGS. 10A and B which show two views of tubular running tool 200, where the A view shows the tool as it would appear in its set position prior to torque activation and the B view shows the tool as it would appear under application of torque causing rotation and activation of the cam mechanism. In the A view the effect of relative rotation, as would occur from rotation of the load adaptor 202 relative to the work piece 201, is evident in that the cam pair 211 are offset tending to pry apart cage 207 and load adaptor 202 carrying main body 203 and thus drive jaws 206 inward into further engagement with work piece 201 as required to produce a grip force. This action also results in relative helical movement of the jaws 206 and grip element 205 generally with respect to the main body 203, evident in FIGS. 10A and B by comparison of the position of jaws 206 relative to the sectioned main body 203 in the two views. The mechanics of this configuration providing torque activation is the same as that already described in the detailed description of the preferred embodiment of a tubular running tool.

Configuration 2(&5) Flat/Cam

Referring now to FIG. 11A, a simplified variation of the preferred embodiment is shown where a tubular running tool, generally indicated by the numeral 220, is configured in correspondence to Configuration two (2) of Table 1. Tubular ruing tool 220 is engaged with work piece 201; has a load adaptor 222 with a lower end face 229 and upward facing shoulder 230, arranged to fit coaxially inside main body 203 and is retained therein by load collar 231; load collar 231 has a lower end face 232 and is rigidly connected to main body 203. As already described, main body 203 together with grip element 205 act as a wedge-grip mechanism. Cam pair 235, forming the jaw/adaptor cam pair of configuration 2 of Table 1, is comprised of cage cam 236 and lower adaptor cam 237 which are provided respectively on the opposing faces of upper end 208 of the cage 207 and lower end 229 of the load adaptor 222. Cam pair 240, forming the body/adaptor cam pair of configuration 2 in Table 1, is comprised of body cam 241 and upper adaptor cam 242 which are provided respectively on the opposing faces of lower end face 229 of load collar 231 and upward facing shoulder 230 of load adaptor 222. In this configuration cam pair 240 is provided with flat or zero pitch profiles thus allowing rotation on this interface, while yet transferring axial load, in the manner of a swivel; and cam pair 235 is here again profiled as a 'saw tooth', providing the same left and right hand mating helical functions as the base configuration shown in FIG. 10 thus defining the helical pitch relating rotation to axial stroke causing torque activation.

Comparing now FIGS. 11A and B which show two views of tubular running tool 220 where again the A view shows the tool as it would appear in its set position prior to torque activation and the B view shows the tool as it would appear under application of right hand torque causing rotation and activation of the cam mechanism. In the B view the effect of relative rotation, as would occur from rotation of the load adaptor 222 relative to the work piece 201, is evident in that the jaw/adaptor cam pair 235 are again offset along a right hand helix tending to pry apart cage 207 and load adaptor 222 carrying main body 203 upward and thus drive jaws 206 inward into further engagement with work piece 201 as required to produce a grip force. However unlike the base configuration shown in FIGS. 10A and B, the configuration 2 shown here in FIGS. 11A and B results in little rotation of the jaws 206 relative to the main body 203 because rotation is allowed between the load adaptor 222 and main body 203 on flat profiled cam pair 240. In this configuration the incremental torque required to provide incremental grip force need only overcome the combined resistance to rotation of cam pairs 235 and 240 as they react and respond to the axial component of the grip force reacted on the ramp surface 204 and not the complete grip force active on this surface as required for the base configuration. For certain applications this greater mechanical advantage may be required to ensure the grip does not slip and thus warrants the somewhat greater associated mechanical complexity of this mechanism.

Referring to FIG. 11A, means to prevent relative rotation of the jaws 206 with respect to the ramp 204, while yet allowing axial displacement, may be readily provided by, for example, axial keys and keyways (not shown) acting between the main body, or where the ramp surface 204 and mating jaws 206 are provided in a non-axi-symmetric form such as multi-faceted flat surfaces as used for example in a tool described by Bouligny in U.S. Pat. No. 6,431,626 B1. By such means it will be seen that this Configuration 2 becomes configuration 5 of Table 1, where the jaw/body interface is constrained to generally move axially but in other respects the mechanical function is similar to that shown here for Configuration 2. Similarly Configurations 3 and 4 described next become Configurations 6 and 7 when similarly axially restrained by such means.

Configuration 3(&6) Cam/Cam

Figure 12A:
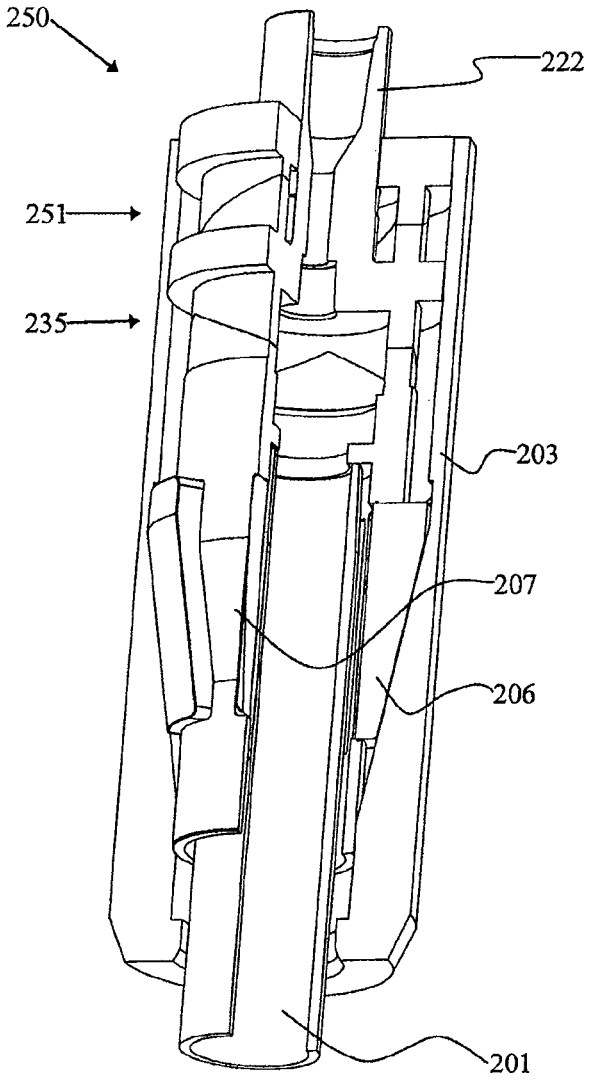
FIGS. 12 A and B are a tubular running tool as shown in FIG. 10A with a cam/cam wedge-grip torque activation architecture, in its unset (retracted) and set positions respectively.
Figure 12B:
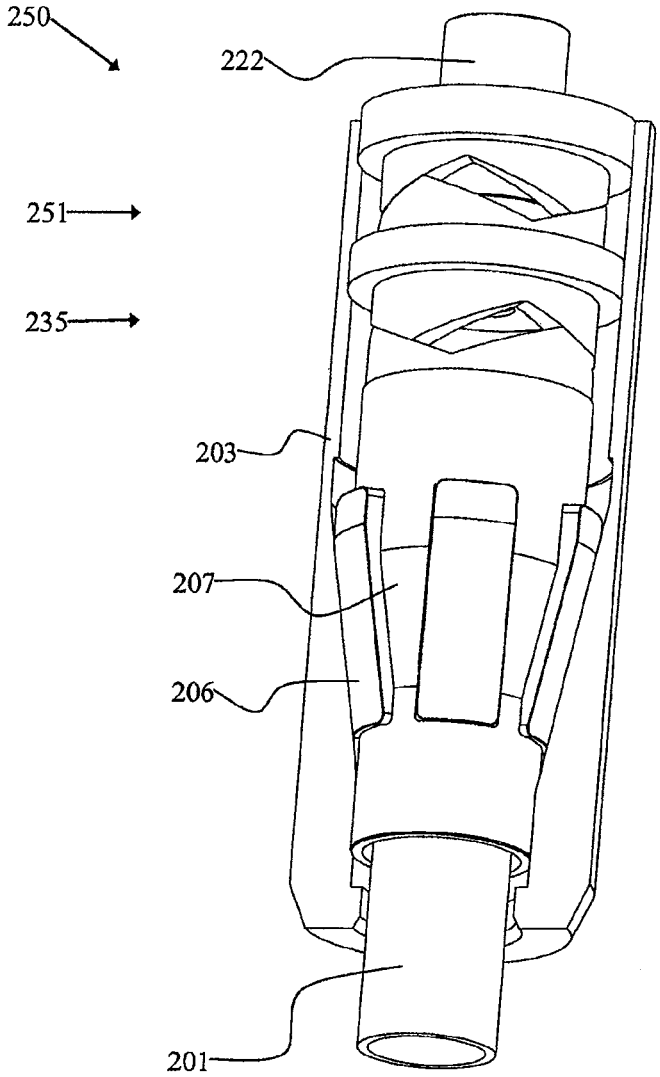

Referring now to FIG. 12A, a simplified further variation of the preferred embodiment is shown where a tubular running tool, generally indicated by the numeral 250, is configured in correspondence to Configuration three (3) of Table 1. This configuration is the same as that already described for Configuration two (2) with reference to FIGS. 11A and B, except that, referring still to FIG. 12A, cam pair 251 is also provided with mating profiles having a non-zero pitch, shown here again as a 'saw-tooth' shape, which act in coordination with the pitches of and cam pair 235 to be generally additive; thus defining the helical pitch relating rotation to axial stroke causing torque activation.

Comparing now FIGS. 12A and B which show two views of tubular running tool 250 where again the A view shows the tool as it would appear in its set position prior to torque activation and the B view shows the tool as it would appear under application of right hand torque causing rotation and activation of the cam mechanism. In the B view the effect of relative rotation, as would occur from rotation of the load adaptor 222 relative to the work piece 201, is evident in that both the jaw/adaptor cam pair 235 and adaptor/body cam pair 251 are offset along a right hand helix tending to pry apart cage 207 and load adaptor 222 and load adaptor 222 and main body 203 together carrying main body 203 upward and thus drive jaws 206 inward into further engagement with work piece 201 as required to produce a grip force. This will be seen as similar to the mechanics achieved with Configuration two (2) as shown in FIGS. 11A and B, when only considering torsional loads and associated rotation, but, referring again to FIGS. 12A and B, results in somewhat dissimilar behaviour when hoisting loads are also carried, because, as will be apparent to one skilled in the art, these loads result in different force vectors operative on the two cam surfaces, and may thus be used to vary the overall grip response to combined hoisting, torsional and gravity loads to better meet the needs of various applications.

Configuration 4(&7) Cam/Flat

Figure 13A:
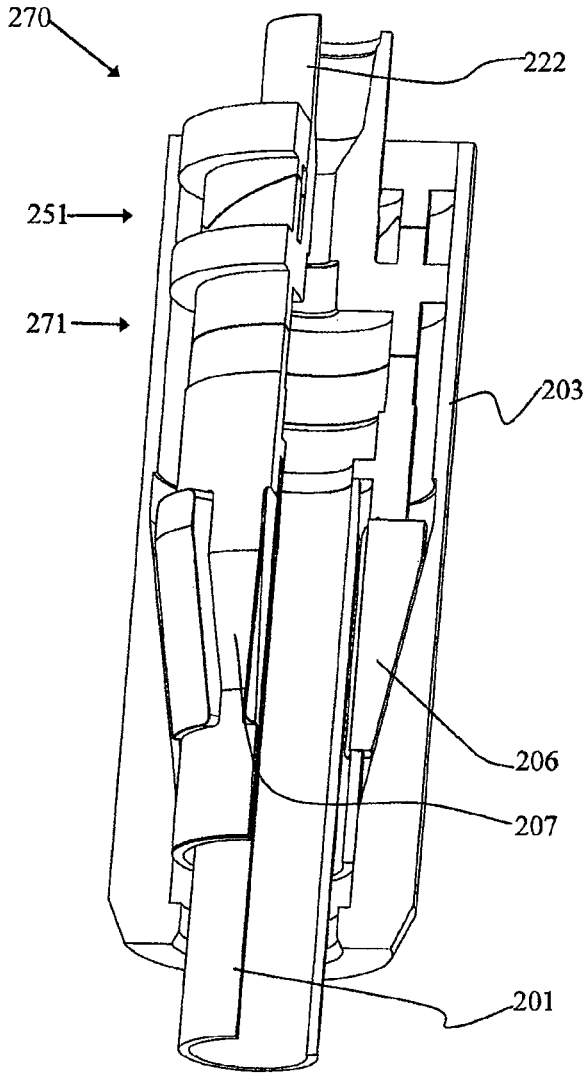
FIGS. 13 A and B are a tubular running tool as shown in FIG. 10A with a cam/flat wedge-grip torque activation architecture, in its unset (retracted) and set positions respectively.
Figure 13B:
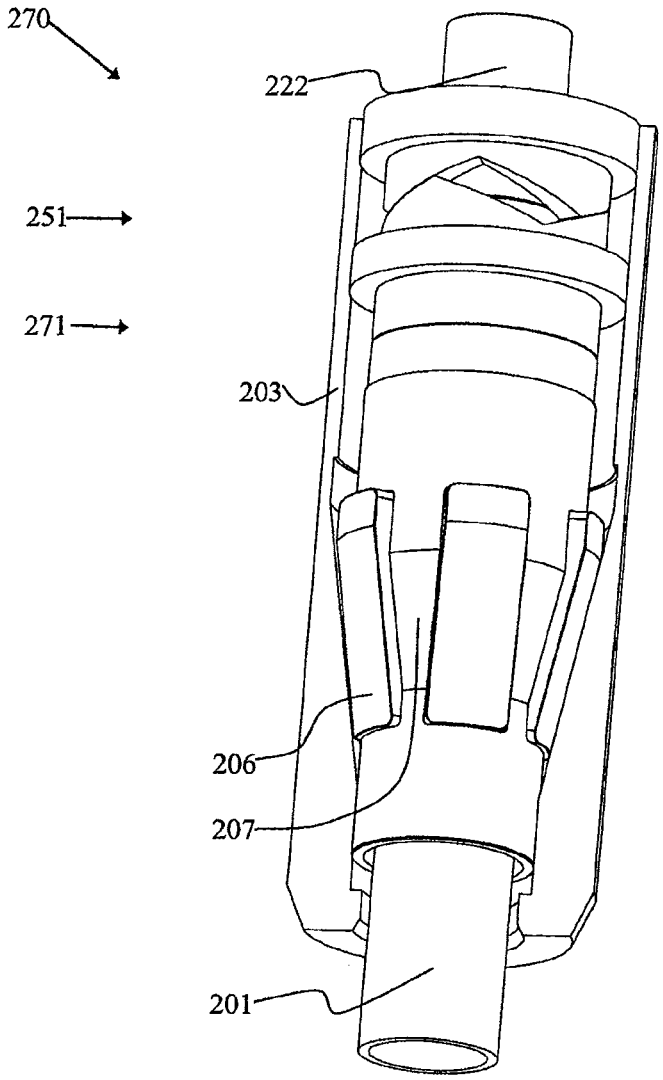

Referring now to FIG. 13A, in accordance with the preferred embodiment, another variation of a tubular running tool incorporating the architecture of Configuration four (4) of Table 1 is shown in simplified form, and is generally indicated by the numeral 270. In this configuration the jaw/adaptor and adaptor/body cam pairs are provided as cam pair 271 and cam pair 251 respectively. In this case cam pair 251 again has a saw-tooth profile while cam pair 271 is profiled to be flat. Comparing now FIGS. 13A and B, the tool is again shown in two views where the A view shows the tool in its set position and the B view in its torqued position. Under rotation, the response to torque activation is seen to closely resemble that of Configuration 2; however, the effects of axial load transfer and gravity, and other geometry variables in the context of certain applications may make this configuration preferable.

Internal Gripping CRT Incorporating Axi-Symmetric Wedge Grip

In an alternative embodiment, this 'base configuration wedge-grip' bi-axially activated tubular running tool is provided in an internally gripping configuration, as shown in FIG. 14, and generally designated by the numeral 300, where it is shown in an isometric partially sectioned view as it appears configured to grip on the internal surface of a tubular work piece, thus also referred to here as an internal grip tubular running tool. This alternate configuration shares most of the features of the externally gripping tubular running tool of the preferred embodiment already described; therefore it will be described here more briefly.

Referring now to FIG. 15, tubular running tool 300 is shown inserted into work piece 301 and engaged with its interior surface 302; having an elongate generally axi-symmetric mandrel 303, which in this configuration functions as the main body. Mandrel 303 having an upper end 304, in which load adaptor 305 is integrally formed, a lower end 306, a centre through bore 307 and a generally cylindrical external surface 308 except where it is profiled to provide ramp surface 309 distributed over a plurality of individual frusto-conical intervals 310 here shown as four (4). A plurality of circumferentially distributed and collectively radially opposed jaws 320, shown here as five (5), are disposed around ramp surface 309; jaws 320 have internal surfaces 321 profiled to generally mate to and slidingly engage with ramp surface 309, and external surfaces 322, typically provided with rigidly attached dies 323; dies 323 having external surfaces collectively forming grip surface 324 configured with a shape and surface finish to mate with and provide effective tractional engagement with the pipe body 301, such as provided by the coarse profiled and hardened surface finish, typical of tong dies; external surfaces 324 together forming grip element surface 325 in tractional engagement with the interior surface 302 or work piece 301.

Generally tubular cage 326, having upper and lower ends 327 and 328 respectively, is coaxially located between the exterior surface 308 of mandrel 303 and interior surface 302 of work piece 301, referring now to FIG. 16, having windows 329 in its lower end 327 in which the jaws 320 are placed and thus axially and tangentially aligned, the assembly of jaws 320 and cage 326 forming wedge-grip element 330. The external surfaces 324 of dies 323 may be provided to extend circumferentially beyond the external surfaces 322 of jaws 320 to form extended edges 331 having a thickness selected to act as cantilevers to both reduce the circumferential gap between regions of die external surfaces 324 and preferably allow some deflection when pushed into contact with the work piece interior surface 302 as required for gripping, enabling control of the contact stress distribution and hence reduce the tendency to distort and excessively indent the interior surfaces 302 of work pieces being handled by tubular running tool 300. Dies 323 may be provided in the form of collet fingers attached to the ends of edges 331, where the spring force of the collet arms (not shown) is employed to provide a bias force urging the jaws to retract and generally retaining them in windows 329.

Jaws 320 can also be retained where the jaws having upper and lower ends 370 and 371 respectively are provided with retention tabs 372 extending upward on their upper ends 370, and referring now to FIG. 15, where the retention tabs 372 are arranged to engage the inside of cage 326 when the jaws 320 are installed in windows 329 and are positioned at their intended limit of radial extension; and at their lower ends 371 to be similarly retained by retainer ring 373 attached to and carried on the lower end 328 of cage 326 overlapping with lower ends 371 of jaws 320. As a further means to urge retraction of the jaws, split ring 374 is provided attached to mandrel 303 above ramp surface 309 and trapped inside cage 326 and arranged so that when relative downward axial movement of the mandrel 303 required to retract the jaws 320 occurs, retention tabs 372 slide under split ring 374 tending to force jaws 320 inward.

Referring still to FIG. 15, upper end 327 of cage 326 is rigidly attached to generally tubular cage cam 340 having upward facing profiled end surface 341. Body cam 342 is similarly tubular with downward facing profiled end surface 343 generally interacting with the upward facing profiled surface 341 of cage cam 340 to act as a cam pair 344 providing torque activation in the manner of the base configuration of Table 1, and providing latching as already described with reference to FIGS. 4-7. Body cam 342 is upset at shoulder 345 at its upper end 346 and attached to the upper end 304 of mandrel 303 by means of internal threads 347 and lock ring 348 keying mandrel 303 to body cam 342 forming a rigid yet adjustable structural connection Referring still to FIG. 15, land ring 350 is attached to the upper end 327 of cage 326 and is dimensioned to act as a land or stop for the proximal end 351 of work piece 301. Generally tubular pressure housing 360 having a lower end 361, upper end 362 and internal seal bore 363, is also attached at its lower end 361 to the upper end 327 of cage 326 and extends upward to contain cam pair 344 where its seal bore 363 sealingly and slidingly engages with seal 364 provided on body cam 342. Sealed cavity 365 is thus bounded by pressure housing 360, mandrel 303 and cam pair 344, sliding seal 364 and a further upper cage sliding seal 365 provided between the exterior surface 308 of mandrel 303 and upper end 327 of cage 326, the diameter of sliding seals 364 arranged to be greater than the diameter of sliding seal 365 so that pressured gas may be introduced to this cavity through valved port 367 to act as a compliant pre-stressed spring force tending to displace mandrel 303 upward relative to cage 326, providing one means to preferably pre-stress the grip element 325 when the jaws are set. The lower end 306 of mandrel 303 is provided with an annular seal 315, shown here as a packer cup, sealing engaging with the internal surface 302 of work piece 301, thus providing a sealed fluid conduit from the top drive quill through bore 307 of mandrel 303 into the casing, to support filling and pressure containment of well fluids during casing running or other operations. In addition, flow control valves such as a check valve, pressure relief valve or so called mud-saver valve (not shown), may be provided to act along or in communication with this sealed fluid conduit.

Thus configured, interior gripping tubular running tool 300, functions in a fully mechanical manner, very similar to that already described in the preferred embodiment of exterior gripping tubular running tool 1, where it is latched and unlatched by rotation, the gas spring preferably providing pre-stress to set the jaws. Referring now to FIG. 17, the tool is shown as it would appear under application of right hand torque causing rotation and activation of the cam mechanism.

Internal Gripping CRT Incorporating Helical Wedge Grip

In a yet further alternate embodiment, a bi-axially activated tubular running tool may be configured to have a helical wedge grip. This variant embodiment is illustratively shown in FIG. 18 as an internal gripping bi-axially activated tubular running tool employing a torque activation architecture characterized here as Configuration 6(see Table 1) and generally designated by the numeral 400, where it is shown in an isometric partially sectioned view as it appears retracted and configured to insert into a tubular work piece. This alternate configuration shares many of the features of the internally gripping axi-symmetric wedge grip tubular running tool 300 embodiment already described, therefore it will be described here with emphasis on the different architectural features.

Referring now to FIG. 19, tubular running tool 400 is shown inserted into work piece 401 and engaged with its interior surface 402; having an elongate mandrel 403, which in this configuration functions as the main body.

Mandrel 403 made from a suitably strong and rigid material and having a centre through bore 404, [0122]a lower end 405, and having intervals sequentially above the lower end 405 of generally increasing diameter said intervals comprised of: dual ramp surface interval 406, characterized by a downward tapered helical profile 407 generally shaped as a tapered threadform with lead, taper, helix direction, load flank angle and stab flank angle all selected in accordance with the needs of a given application, but shown here in the preferred embodiment as a right hand V-thread formed by load and stab flank surfaces 409 and 410 respectively together forming dual ramp surface 411, where the load and stab flank angles or axial radial flank tapers are selected to be similar to those typically employed for the frusto-conical surfaces of slips, cage thread interval 412 in which are placed external carrier threads 413 having a lead matching those of helical profile 407, [0125]axial splined interval 414, and [0126]shoulder interval 415 having a diameter upset from that of axial splined interval 414 to form load shoulder 416, and having [0127]an upper end 417 with upper face 418 into which are placed radial dog grooves 419. Thus described, mandrel 403 is shown in FIG. 20 in an isometric view to better illustrate the non-axi-symmetric features of this component.

Referring again to FIG. 19, a plurality of circumferentially distributed and collectively radially opposed jaws 420, shown here as five (5), are disposed around dual ramp surface 411; jaws 420 have internal surface 421 profiled to generally mate to helical profile 407 and slidingly engage with dual ramp surface 411, and external surfaces 422, typically provided with rigidly attached dies configured with a shape and surface finish to mate with and provide effective tractional engagement with the pipe body 401, but as shown here, such tractional die surface may also be provided integrally with the jaws 420 on their external surfaces 422, together forming grip element surface 425 in tractional engagement with the interior surface 402 of work piece 401.

Generally tubular and rigid cage 426, having upper and lower ends 427 and 428 respectively and internal surface 433, is coaxially located between the exterior surface 408 of mandrel 403 and interior surface 402 of work piece 401, having windows 429 in its lower end 427 in which the jaws 420 are placed and thus axially and tangentially aligned, so that the assembly of jaws 420 and cage 426 forming helical wedge-grip element 430 is maintained in controlled relative axial and tangential orientation when engaged with the dual ramp surface 411 of mandrel 403 to coordinate the movement of the individual jaws 420 so that relative right hand rotation of the mandrel 403 tends to synchronously radially expand grip surface 425 and left hand rotation correspondingly retracts grip surface 425. Helical wedge-grip element 430, with reference to FIG. 16, will now be recognized as generally analogous to the axi-symmetric wedge-grip element 330, of tubular running tool 300, with other details pertaining to the die structure as already described with reference to wedge-grip element 330.

Referring again to FIG. 19, directly above windows 429 cage 426 is provided with internal carrier threads 431 in mating engagement with external carrier threads 413 of mandrel 403 where the fit, placement and backlash of these mating carrier threads is arranged to generally maintain the axial position of wedge grip element 430 relative to mandrel 403 such that the 'thread' crests of the respective mating internal surface 421 and dual ramp surface 411 are kept coincident at the mid-position of the backlash. Thus arranged, application of right hand rotation of mandrel 403 relative to cage 426 will tend to urge jaws 420 radially outward and into engagement with work piece 401, the amount of rotation needed to provide the required radial expansion being controlled by selection of the pitch and thread taper of helical profile 407, to thus set the tool or jaws, where the backlash between internal carrier threads 431 and external carrier threads 413 is selected to allow sufficient displacement between the mandrel 403 and lower cage 425 to accommodate subsequent axial load activation of the jaws 420 in contact with work piece 401 generally in the manner of a wedge-grip. However unlike a conventional wedge grip architecture, according to the teaching of the present invention, this helical architecture can be selectively arranged to provide axial load activation for loads applied through mandrel 403 in both tension (hoisting) and compressive axial directions by appropriate selection of the angles for load and stab flank surfaces 409 and 410 respectively, so that as shown here where both angles are shallow with respect to the axis, bi-directional load activation is provided. It will now be apparent to one skilled in the art that the geometry variables of lead, taper magnitude and direction, helix direction, load flank angle and stab flank angle of tapered helical profile 407 may all be selected in accordance with the needs of a given application to control the relationships between the control and load variables of applied rotation, torque, axial displacement and axial load and the dependent radial displacement and grip force acting at grip element surface 425 to meet the gripping needs of many applications. The mechanics of this helical wedge grip mechanism will now also be seen to modify that of a conventional wedge-grip architecture which only provides uni-directional axial load activation so that this embodiment of the present invention enjoys the advantage of selectively providing bi-directional axial load activation, in addition to other benefits which will become apparent as this embodiment is further described below.

Referring still to FIG. 19, upper end 427 of cage 426 is internally upset and provided with internal tracking threads 432. Above cage 426 and also co-axially mounted on mandrel 403 cage cam 440 is provided having an interior bore 442, a lower end 441 and an upper profiled face 443 where interior bore 442 is axially splined to mate with axial splined interval 414 of mandrel 403 with which it slidingly engages, lower end 441 is provided with external tracking threads 444 engaging with internal tracking threads 432 of cage 426.

Again co-axially mounted on mandrel 403 and above cage cam 440, generally tubular upper cam 450 is provided having a lower end 451, with lower profiled face 452, upper end 453 and hollow internal surface 454. Internal surface 454 is internally upset at lower end 451 to form upward facing shoulder 455 and carries load thread 457 at its upper end 452, and is arranged to be close fitting with shoulder interval 416 of mandrel 403. Lower profiled face 452 is matched to and interactive with upper profiled face 443 of cage cam 440 thus together forming adaptor/jaw cam pair 456, profiled here illustratively as a 'saw-tooth' and corresponding to the adaptor/jaw cam pair of configuration 5 of Table 1.

Coaxially located above mandrel 403, generally axi-symmetric load adaptor 460 is provided, having an open centre 461 and upper and lower ends 462 and 463 respectively and lower face 464. Open centre 461 is suitably adapted for connection to a top drive quill at upper end 462, and at lower end 463 adapted for rigid connection to tubular stinger 470. Into the lower face 464 of load adaptor 460 radial dogs 465 are placed and arranged to match the radial dog grooves 419 in the upper face 416 of mandrel 403 and further to best take advantage of the available backlash between internal carrier threads 431 and external carrier threads 413, arranged to only allow engagement when the peaks and valleys of adaptor/jaw cam pair 456 'saw-tooth' profile are aligned. Lower end 463 of load adaptor 460 is further adapted to rigidly connect to upper cam 450 through load thread 457 and torque lock ring 466, which is attached to load adaptor 460 and keyed to both load adaptor 460 and upper cam 450, together with load thread 457 enabling the transfer of axial, torsional and perhaps bending loads between load adaptor 460 and upper cam 430 as required for operation. Tubular stinger 470, made from a suitably strong and rigid material has an upper end 471 a stinger bore 472 and lower end 473, where upper end 471 is adapted to rigidly connect to the lower end 463 of load adaptor 460 and lower end 473 configured to carry stinger seal 474 and to be close fitting with the centre through bore 404 of mandrel 403 at its upper end 417. Thus described, it will be apparent that the assembly of load adapter 460, upper cam 440, tubular stinger 470 and lock ring 466 together act as a rigid body and are referred to as the adaptor assembly 467.

This adaptor assembly 467 is coaxially mounted on mandrel and arranged so that tubular stinger 470 extends into the through bore 404 of mandrel 403 with which it sealingly and slidingly engages, upward facing shoulder 464 mates with load shoulder 416 of mandrel 403 limiting the extent of upward sliding allowed, providing tensile axial load transfer and forming adaptor/body cam pair 468 corresponding to the flat profiled adaptor/jaw cam pair of configuration 5 of Table 1. Lower face 464 of load adaptor 460 mates with upper face 416 of mandrel 403 limiting the downward stroke, providing compressive load transfer, and when rotated into alignment so that radial dogs 426 which are arranged to match the radial dog grooves 417 are engaged, also enable rotation and the transfer of torsional load from the adaptor assembly 467 into the mandrel 403.

Referring still to FIG. 19, land shoulder 475 is provided in the upper end 427 of cage 426 and is dimensioned to act a land or stop for the proximal end 476 of work piece 401. Generally tubular pressure housing 480 having an upper end 481 and lower end 482, is sealingly and rigidly attached at its upper end 481 to the lower end 451 of upper cam 450 its lower end 481 carries seal 483 and is arranged to be in sealing and sliding engagement with upper end 427 of cage 426. Sliding and rotating seals 486 and 487 are also provided where seal 486 in shoulder interval 416 of mandrel 403 acts to seal with internal surface 454 of upper cam 450 and seal 487 in mandrel 403 directly above cage thread interval 412 seals with the internal surface 433 of cage 426 so that together with stinger seal 474 these seals will be seen to create a sealed cavity 484 bounded by pressure housing 480, adaptor assembly 467, mandrel 403 and cage 426. The diameter of sliding seals 483 and 487 are arranged so that pressured gas introduced to cavity 484 serves to act as a compliant pre-stressed spring force tending to displace mandrel 403 upward relative to cage 426, providing one means to preferably pre-stress grip element surface 425 in the direction of hoisting (axial tension) when the tool is set.

As already described (with reference to FIG. 15 for internal axi-symmetric wedge-grip tubular running tool 300), referring still to FIG. 19, the lower end 406 of mandrel 403 is provided with an annular seal 415, shown here as a packer cup, sealing engaging with the internal surface 402 of work piece 401, thus providing a sealed fluid-conduit from the top drive quill through load adaptor 460, tubular stinger 470, and mandrel 403 into the work piece 401, to support filling and pressure containment of well fluids during casing running or other operations. In addition, flow control valves such as a check valve, pressure relief valve or so called mud-saver valve (not shown), may be provided to act along or in communication with this sealed fluid conduit.

Thus configured, interior torque activated helical wedge grip tubular running tool 400, functions in a fully mechanical manner, similar to that already described in the embodiment of exterior and interior axial wedge grip tubular running tools 1 and 300. In both axial and helical wedge grip configurations, rotation movements are used to set and unset the tool typically with modest axial compression applied. However with the helical wedge grip the unset or retracted position is not maintained by a latch, instead rotation applied to the load adaptor to set and unset the tool acts through the engaged radial dogs 465 and radial dog grooves 419 provided in lower face 464 of load adaptor 460 and upper face 416 of mandrel 403 respectively to rotate the mandrel relative to helical wedge-grip element 430 and thus extend (set) or retract (unset) the jaws by means of the tapered helical wedge grip mechanics as already described. Once set, lifting up with the top drive will disengage radial dogs 465 and radial dog grooves 419 allowing adaptor/body cam pair 468 and adaptor/jaw cam pair 456 to interact so as to provide bi-directional torque activation as already described in reference to tubular running tool 220 shown in FIG. 11. In each of these embodiments a gas spring is preferably provided to bias or pre-stress the jaws when set. Referring now to FIG. 21, the tool is shown as it would appear under application of right hand torque causing rotation and activation of the cam mechanism.

Where such bi-directional torque activation is not required, mandrel 403 can be provided with upper end 417 configured to connect directly to the top drive, in which case the torque activation is only provided in the direction of the helical profile 407, here shown as right hand. In this configuration, the adaptor assembly 467 is not required, and cage 425 can be provided without internal tracking threads 432 at its upper end 427.

Alternate Means to Set and Unset Tubular Running Tools

While such fully mechanical operation of tubular running tools, provided in accordance with the teaching of the present invention, avoids the added operational and system complexity associated with powered control of a tubular running tool that must accommodate rotation, such fully mechanical tools do entail the need to coordinate rotation of the top drive to set and unset the tool which consequently also relies on at least some torque reaction into the work piece. Particularly for the operation of setting the tool, in certain applications, yet more utility can be gained where powered means are provided to at least set the tool without the need for torque reaction into the work piece, characteristically a single casing joint that might otherwise need to be constrained or 'backed up'.

Travelling Powered Shaft Brake

This may be accomplished by various means including an architecture which might be characterized as a travelling powered shaft brake, provided to interact with any of the mechanical tubular running tools 1, 300 and 400 of the present invention but illustratively shown in FIG. 22 as shaft brake assembly 700 adapted for use with the internal grip tubular running tool 300. Referring now to FIG. 23, shaft brake assembly 700 is comprised of brake body 701 rotatably mounted and carried on land ring 350 by bearing 702, where brake body 701 is further provided with one or more hydraulic actuators 703 (two shown) comprised of pistons 704 sealingly and slidingly carried in cylinders 705, provided in the brake body 701, pistons 704 having outer end faces 706 in communication with hydraulic fluid introduced through ports 708, and inner end faces 709 carrying brake pads 710 adapted to frictionally engage with the outer cylindrical, surface of land ring 350. One or more reaction arms 711 are rigidly attached to brake body 701 and provided to structurally interact with the top drive or rig structure so as to react torque, where hydraulic fluid control lines are also provided (not shown) and connected to ports 708 from the top drive, both in a manner known to the art.

Thus configured, and operated with no hydraulic pressure applied to the ports 708, shaft brake assembly 700 is free to rotate and the operation of tubular running tool 300 is identical to that already described where tractional engagement between land ring 350 and the proximal end 351 of work piece 301 is required to provide the reaction torque to set and unset the tool. It will be seen that application of pressure to ports 708 during setting and unsetting tends to clamp or lock wedge grip element 330 to brake body 701 and reaction arm 711 and hence the reaction torque required to set and unset the tool is provided through the reaction arm to the rig structure and not through the work piece. Thus avoiding the need to react torque into the work piece tending to prevent undesirable possible rotation of a single joint typically stabbed into the upward facing coupling box of the so called 'casing stump', being the proximal end of the installed casing string supported at the rig floor.

Power Retract

Another means to provide powered control of the set and unset function of torque activated axial wedge grip tools of the present invention, such as external gripping tool 1 and internal gripping tool 300, is powered manipulation of slips. This is generally known to the art as a means to both set and retract the slips of devices such as elevators or spiders employing a wedge-grip architecture. Such power actuation typically relies on one of, or a combination of, pneumatic, hydraulic or electric power sources. In the preferred embodiments of the present invention, such power manipulation is preferably provided to either power retract the tool, or to power release the tool from the latch position where in both cases the tool yet relies on a passive spring force to set the tool providing a 'fail safe' behaviour. These alternate means to provide powered control of the set and unset functions are now illustrated as they might be adapted for use with the internal grip tubular running tool 300.

Referring now to FIG. 24, tool 300 is shown having a power retract module added, generally referred to by the number 720. In this configuration, the tool 300 is otherwise configured as already described except that cam pair 344 is provided without latch teeth. Referring now to FIG. 25, power retract module 720 is mounted coaxially on mandrel 304 comprised of a retract actuator body 721 on which is mounted a rotary seal body 722 suitably configured to support rotation. Retract actuator body 721 is elongate and generally axi-symmetric having an upper end 723 a lower end 724 an exterior stepped surface 725 and an interior stepped bore 726. At upper end 723, stepped bore 726 sealing and slidingly engages with mandrel 304 below which the diameter of step bore 726 is upset to also sealingly and slidingly engage with the body cam 342 and extend downward to lower end 724 which carries threads 727 rigidly connecting with the upper end 362 of pressure housing 360.

Exterior stepped surface 725 has a profile generally matching that of the internal stepped bore 726 having a cylindrical interval 728 extending down from upper end 723 and ending in shoulder 729 where generally tubular rotary seal body 722 is mounted on cylindrical interval 728 and retained by snap ring and groove 730 at upper end 723. Rotary seal body 722 having upper and lower ends 731 and 732 and interior surface 733 is arranged to be close fitting on cylindrical interval 727 with seals 734 and 735 and perhaps bearings (not shown) in interior surface 733 at upper and lower ends 731 and 732 arranged to accommodate rotation while yet sealing fluid introduced through port 736 in rotary seal body 722 and thence to the interior stepped bore 726 through port 737.

Thus configured, pressured fluid introduced through port 737 acts upon the annular area defined by the diameter change of step bore 726 applying an upward force to actuator body 721, and referring now to FIG. 26, tending to move actuator body 721 upward relative to mandrel 304 with sufficient force to overcome any spring force tending to pre-stress the grip element 325 when in the set position, such spring force preferably provided by gas pressure introduced through port 367 as already described, and thus tends to hold grip surface 324 retracted if not otherwise carrying load. Referring now to FIG. 25, it will be apparent that pressure to port 736 is only required to hold the tool retracted, but is also the position when sustained rotation is not typically required in operation, thus the rotary seal body 722 need not rotate significantly under pressure, simplifying the demands on rotary seals 734 and 735; and furthermore, any inadvertent loss of retract pressure causes the tool to tend to engage the grip providing a desirable 'fail safe' behaviour. The ability to thus set and unset (retract) the tool 300 by manipulation of fluid pressure at port 736 thus removes the need for torque reaction into the work piece to latch or unlatch the tool as required for the fully mechanical configurations.

Power Trigger

Referring now to FIG. 27, tool 300 is shown having a power release module added, generally referred to by the number 750, where tool 300 is shown in its latched position. Referring now to FIG. 28, power release module 750 is mounted coaxially on body cam 342 and comprised of release actuator 751, rotary seal body 752 and actuator guide key ring 753. Release actuator 751 is generally axi-symmetric having an upper end 754, a lower end 755, exterior surface 756 and interior step bore 757. Interior step bore 757 is arranged at lower end 755 to sealingly and slidingly engage with body cam 342 below shoulder 345; next above lower end 755, interior step bore 757 is upset at upward facing shoulder 758 an amount corresponding to the upset of shoulder 345 and extends upward to create seal bore interval 759 which again sealingly and slidingly engages with body cam 342; above seal bore interval 759 interior step bore 757 rigidly connects with guide key ring 753 at upper end 754 located above lock ring 348. Guide key ring 753 has a lower face 780 and interior surface 781 slidingly keyed to mandrel 304. Rotary seal body 752 is mounted on the exterior surface 756 of release actuator 751 and generally configured to function as a rotating seal in a similar manner to that already described for power retract module 720, providing a sealed fluid path to the sealed region between interior step bore 757 and body cam 342 through port 782. Thus assembled the length between the lower face 780 of guide key ring 753 and upward facing shoulder 758 is arranged to be greater than the length from shoulder 345 of body cam 342 to lock ring 348 an amount defining the stroke of release actuator 751 which is allowed to extend downward as urged by pressured fluid entering port 782 until guide key ring 753 contacts lock ring 348, the actuator extend position, or retract upward under application of upward force until facing shoulder 758 contacts shoulder 345, the actuator retract position, but is prevented from rotating with respect to body cam 342 by guide key ring 753.

Referring again to FIG. 27 release actuator 751 is further configured at its lower end 755 to carry one or more profiled downward facing dogs 783 with tapered faces 784 oriented in a right hand helix direction and arranged to generally align with tapered edges 786 of upward facing grooves 785 placed in the upper end 362 of pressure housing 360 when the cam pair 344 is in its latched position and actuator 751 is in its retract position. Thus configured, and referring now to FIG. 29 when release actuator 751 is stroked from its retracted to its extended position, tapered faces 784 of dogs 783 are brought into engagement with matching tapered edges 786 where the taper angle is selected to promote slipping and hence induces the body cam 342 to rotate to the right with respect to cage cam 340, which action disengages the latch allowing the tool to move to its set position without the need for torque reaction into the work piece. The stroke of actuator 751 is arranged to be sufficient to thus release the latch of cam pair 344 but not so great as to allow the dogs 783 to interfere with the relative motion of cam pair 344 when engaged in the make up or break out positions. The angle of tapered edge 786 is further selected so that under application of left hand torque actuator 751 tends to be urged to retract, thus if hydraulic fluid is allowed to drain from port 782 the tool can be relatched but if not, relatching of the tool is prevented. This behaviour provides a means to selectively prevent inadvertent latching of the tool by remote control of the hydraulic line status, reducing the chance of accidental grip release.

Preferred Embodiments of Either Internal Tubular Running Tools in Combination with Supplemental Lifting Elevator, Articulation and Float To further enhance the utility of interior gripping tubular running tools such as tool 300 or 400, in applications such as casing running, as in the other embodiments, the tool may be provided with a supplemental lifting elevator as disclosed by Slack et al in U.S. Pat. No. 6,732,822 B2, where the stroke required to set and unset the tubular running tool may be used to open and close the elevator.

Similarly, the utility of both interior and exterior configurations of tubular running tools 400, 300 and 1 respectively, may be further enhanced, for some applications, when connected to the top drive through an articulating drive sub as disclosed in U.S. Pat. No. 6,732,822 B2 and its continuation in part application Ser. No. 10/842,955.

External Gripping CRT Incorporating Internal Expansive Element

In a yet further embodiment of the present invention, the load adaptor of the gripping tool is provided as an assembly with an expansive member that also engages a work piece surface in response to axial load. This embodiment is next described in its preferred configuration where the gripping element engages the exterior surface of the tubular work piece and the expansive element the interior surface of the work piece at a location preferably opposite that engaged by the grip element to thus support the tubular wall from its tendency to collapse under the influence of the exterior grip force and simultaneously augment the grip capacity of the tool. This embodiment of a tubular running tool is illustratively shown in FIG. 30 as it would apply to a Configuration 2 architecture (from Table 1), and is generally designated by the numeral 600. For continuity and pedagogical clarity, tubular running tool 600 is generally shown here as a modification of the somewhat simplified embodiment shown in FIG. 11 and already described in reference to externally gripping torque activated tubular running tool 220. Furthermore, since the changed architectural features mostly affect the load adaptor, this element will be described next.

Referring still to FIG. 30, tubular running tool 600 is coaxially inserted into the proximal end of work piece 601; has a load adaptor sub-assembly 602 comprised of mandrel 603, reaction nut 604, expansive element 605 and cam body 606 all coaxially mounted on and carried by mandrel 603.

Referring now to FIG. 31, mandrel 603 is elongate and generally axi-symmetric made from a suitably strong and rigid material having an upper end 607 a lower end 608 and a centre through bore 609, and having intervals sequentially upward from the lower end 608 of generally increasing exterior diameter comprised of: reaction thread 610 above which generally tubular stinger 611 extends upward to axial splines 612 ending in a diameter upset creating downward facing mandrel shoulder 613, above which the exterior diameter remains cylindrical to upper end 607 which is suitably adapted for connection to a top drive quill by box connection 614.

Cam body 606 is generally axi-symmetric, having an upper end 615 a lower end 616, an upper face 617, exterior surface 618 and a generally cylindrical interior surface 619; interior surface 619 having axial spline grooves 620 at upper end 615 and being generally sized to fit closely over tubular stinger 611 of mandrel 603 where axial spline grooves 620 are arranged to mate and slidingly engage with mandrel axial splines 612, which upward axial sliding is constrained by contact between upper face 617 and downward facing mandrel shoulder 613; exterior surface 618 being generally cylindrical upward from lower end 616 to a location in its mid-body 621 where the diameter is upset to form downward facing cam face 622, the exterior surface then extending cylindrically upward and again upset at upper end 615 to be close fitting inside main body 650.

Referring now to FIG. 32, expansive element 605 is preferably provided as a coaxial subassembly comprised of generally tubular upper and lower spring end sleeves 630 and 631 respectively, separated by a plurality of coaxial closely spaced helical coils 632;

made from a suitably strong yet elastically deformable material, preferably rectangular in cross-section, having close fitting smooth edges 633 and axially coincident radiused coil ends 634 together forming a generally tubular helical spring element 635;

spring end sleeves 630 and 631 are provided with inward facing scalloped ends 636 mating with radiused coil ends 637 and outward facing upper and lower flat end faces 638 and 639 respectively; thus arranged expansive element 605 is a generally tubular assembly generally defined by the diameters of cylindrical external and internal surfaces 640 and 641 respectively, where the diameter of external surface 640 is selected to fit closely inside the drift allowance of work piece 601 and the diameter of internal surface 641 is close fitting to the exterior of tubular stinger 611.

Referring again to FIG. 31, expansive element 605 is coaxially placed on the tubular stinger 611 of mandrel 603 where it is retained by generally tubular internally threaded reaction nut 604 which threadingly engages with mandrel reaction thread 610.

Thus assembled, load adaptor sub-assembly 602 is arranged to fit coaxially inside main body 650 and is retained therein by load collar 651; load collar 651 is rigidly connected to main body 650 and has a lower end face 652 engaging with upper face 617 of cam body 606 to form cam pair 653 corresponding to the flat or zero pitch body/adaptor cam pair of configuration 2 in Table 1. As already described with reference to tubular running tool 220, main body 650 has an internal axi-symmetric ramp surface 654, generally supporting and engaging with wedge-grip element 655; grip element 655 comprised of jaws 656 axially and rotationally slidingly engaging with ramp surface 654 and aligned and carried in cage 657 having an upper end 658 provided with cage cam 659 facing and opposed to the cam face 622 of cam body 606 with which it mates to form cam pair 660, the jaw/adaptor cam pair of configuration 2 of Table 1, where the cam profile is here provided as a 'saw tooth'. In this configuration, and referring now to FIG. 33A, flat cam pair 653 allows rotation between the main body and load adaptor, while yet transferring axial load, in the manner of a swivel; and the saw tooth profile of cam pair 660, provide the same left and right hand mating helical functions as the base configuration, thus defining the helical pitch relating rotation to relative axial stroke between the ramp surface 654 and jaws 656 causing torque activation of the wedge grip, as shown in FIG. 33A, where the tubular running tool 600 is shown as it would appear under application of right hand torque causing rotation and activation of the cam mechanism, and under application of hoisting load.

The effect of relative rotation and torque transfer, between mandrel 603 and work piece 601, is evident in that the jaw/adaptor cam pair 660 are rotationally offset along a right hand helix tending to pry apart cage 657 and cam body 606 forcing main body 650 upward and thus drive jaws 656 inward into further engagement with work piece 601 as required to produce a grip force. (The effect of left hand rotation will be seen to engage the left hand mating helix surfaces of the saw tooth profile provided by cam pair 660 with a similar effect.) Referring again to FIG. 31, when mandrel 603 is connected to a top drive through connection 614, right or left hand torque applied by the top drive is thus transferred into the mandrel 603 and through the splined connection formed between mandrel axial splines 612 and spline grooves 620 into the cam body 606, where a first portion is reacted through frictional sliding on upper face 617 into the main body 650 and a second portion through cam pair 660; however, both portions of the torque load are then reacted into the grip element 655 and thence to the work piece 601.

The effect of hoisting load and the manner of its transfer into the work piece is described now by reference to FIG. 33A, where the axial load path followed from the top drive is seen to pass down through the mandrel 603, through reaction nut 604, and up to the lower spring end sleeve 631, which tends to place spring element 635 in compression. Under compression, helical coils 632 tend to deform elastically so as to shorten, possibly twist, i.e., rack, and expand radially outward and into contact with the interior surface of work piece 601 thus forcing their edges 633 to bear against each other inducing a compressive hoop stress in spring element 635 with resultant radial contact stress or pressure load against the work piece 601 which radial contact stress correlatively tractionally resists axial sliding on the interface between spring element 635 and the work piece 601 resulting in axial load transfer from the spring element to the work piece as governed by the interfacial tractional shear stress capacity. The relationship between applied compressive load and resultant radial load and twist is controlled, in part, by the selection of helix angle, which in the preferred embodiment, is so selected to be slightly less than 45 degrees with respect to the cylinder axis, which selection provides a hoop stress nearly equal to the applied axial stress, which bi-axial stress state tends to maximize load capacity. The unloaded diameters of cylindrical external and internal surfaces 640 and 641, respectively, of expansive element 605 are further selected to ensure that under compressive load tending to expand the radiused coil ends 637 of spring element 635, the area in mating engagement with inward facing scalloped ends 636 of spring end sleeves 630 and 631 is yet sufficient to carry the requisite compression load.

Insofar as the compressive force on the bottom of spring element 635 tends to cause it to slide upward with respect to work piece 601, the interfacial shear stress transfers a portion of the axial load so that the axial load carried along the length of spring element 635 is monotonically reduced from the bottom to top of spring element 635 in a logarithmic manner, analogous to that of the tension in a rope wound onto and reacting with a rotating capstan, where it will be apparent that a longer element results in a greater load reduction from bottom to top. The portion of axial compressive load remaining at the top of spring element 635 is reacted up to and into cam body 650 and from there is carried down through main body 650 and wedge-grip element 655 into the work piece 601 where the jaws 656 of grip element 655 are preferably arranged to engage and radially load the exterior surface of the tubular work piece 601 directly outside the interval under internal radial load from contact with spring element 635 to thus 'pinch' the tubular wall avoiding the tendency to collapse under the influence of the exterior grip force or similarly bulge under the action of the internal expansive grip force, where the combination of axial load transfer on both internal and external surfaces augment the grip capacity of the tool.

Figure 33B:
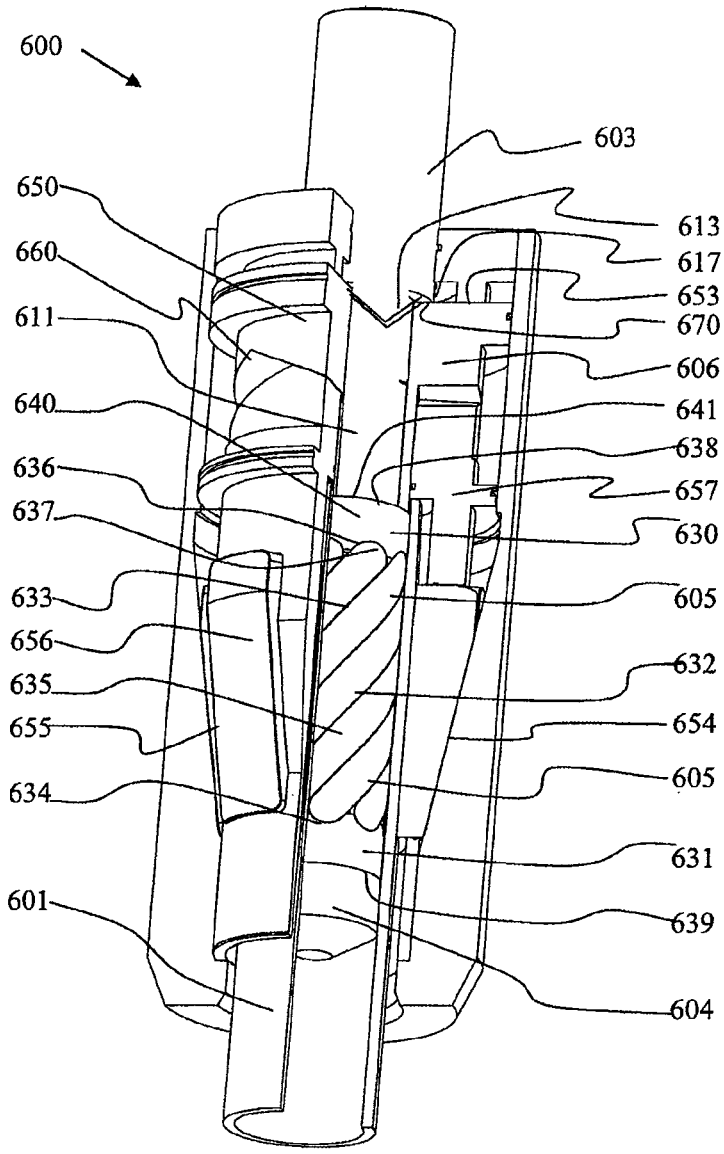

Thus configured, it will now be apparent to one skilled in the art that this embodiment of the present invention may be selectively adapted to meet the needs of many applications. For example, to provide adequate hoisting capacity for typical tubular well construction and servicing applications the mechanical advantage required to provide satisfactory performance and reliability from tubular hoisting tools relying solely on a wedge grip architecture results in a grip surface structure and contact stress that characteristically leads to marking or surface indentation of the work piece. This is undesirable but difficult to overcome within reasonable lengths given the mechanics of the wedge grip alone. However, according to the method of the present invention the wedge grip capacity is augmented by the support and grip capacity of an expansion element where the length, helix angle and other variables can be selected to greatly reduce the load carried by the wedge grip element tending to greatly reduce the radial force induced by hoisting and marking and further supporting the use of reduced marking or so-called non-marking dies generally.

Where such applications might benefit from further reduced chance of marking from torque induced load on jaws 656, splines 612 and spline grooves 620 can be omitted, and referring now to FIG. 33B, replaced by profiling mating surfaces of mandrel shoulder 613 and upper face 617 of cam body 606 with a saw tooth profile to form mandrel/expansive cam pair 670, which cam pair then tends to act to axially stroke expansive element 605 under application of torque inducing a portion of the applied torque to be reacted through expansive element 605 and into the work piece 601 thus reducing the torque transferred through jaws 656.

Torque Activated External Grip Rig Floor Slip Tool

In the preferred embodiment of the present invention, incorporating a self-activated bi-axial gripping mechanism into a tool generally referred to as a rig floor reaction tool 500, suitable for uses that generally encompass and include the functionality of rig floor slips, the gripping element is provided as a set of modified slips 505 acting as a wedge-grip, activated according to the architecture of Configuration 4 as identified in Table 1. Referring now to FIG. 34, rig floor reaction tool 500 is shown with removable slips 505 engaged with tubular work piece 501. Referring now to FIG. 35, rig floor reaction tool has an elongate, hollow and generally axi-symmetric load adaptor 502, configured at its lower end 511 to land on and structurally interface with the rig and rig floor, at the rig floor opening through which tubular strings are conveyed into and out of the well bore to thus transfer axial and torsional loads carried by tubular work piece 501 acting as the proximal segment or joint of such tubular strings; an elongate generally tubular and axi-symmetric main body 503 coaxially placed within and supported by load adaptor 502; main body 503 is made of a suitable strong and rigid material, has a generally cylindrical exterior surface 530, lower end face 531, upper end face 532, and an internal axi-symmetric frusto-conical ramp surface 504 of decreasing radius in the axial downward direction, where the wall thickness of main body 503 is selected to enable it to function as the "slip bowl" in a wedge-grip mechanism generally axially and rotationally slidingly engaging with the removable slips 505 as they tractionally engage the tubular work piece 501 and react load applied to or carried by the work piece.

Referring now to FIG. 36, slips 505 are in the usual fashion comprised of a plurality of segments or jaws 506, somewhat arbitrarily shown here shown as three (3), axially aligned and joined by two sets of pinned hinges 507P enabling the slips 505 to be wrapped and unwrapped from work piece 501 for installation and removal respectively, in a manner well known to the art. Means to positively align the un-pinned jaw pair axially, when the slips 505 are wrapped onto the pipe, is preferably provided, as by the lugs of an unpinned hinge 507U. Flexible handling links (not shown) are also preferably attached to the slips, in a manner known in the art, to support their installation and removal into and out of the slip bowl. According to the method of the present invention, slips 505 are provided with axially aligned jaw cam dogs 508 rigidly attached to and projecting radially from the exterior of each jaw 506 near their upper ends 509.

Referring again to FIG. 35, load adaptor 502, made of a suitable strong and rigid material, is generally cylindrical on its exterior surface, has an internal upward facing shoulder 510 at its lower end 511, a generally cylindrical bore over the length of its body 512, close fitting to the exterior surface 530 of main body 503, and is rigidly attached at its upper end 513 to upper adaptor cam plate 520. Referring now to FIG. 34, adaptor cam plate 520 is similarly made from a suitably strong, thick and rigid material and generally configured as an inward facing flange at the top of, and functionally acting as part of, load adaptor 502; adaptor cam plate 520 having a lower end face 521, a bore 522 large enough to admit the upper ends 509 of slip jaws 506 when the slips 505 are wrapped on the work piece 501, but small enough not to admit the jaw cam dogs 508, except at locations where notches 523 are provided in the upper adaptor cam plate 520 at evenly distributed circumferential locations to generally match the distribution of the jaw cam dogs 508. This arrangement then allows installation or removal of the slips 505 respectively into or out of the annular space between ramp surface 504 and work piece 501, as the slips 505 are rotated to align the jaw cam dogs 508 with the notches 523 in upper adaptor cam plate 520.

Referring again to FIG. 35, upward facing shoulder 510 of load adaptor 502 carries, and is rigidly attached to, lower adaptor cam 514; lower adaptor cam 514 is made from a suitable strong and rigid material of generally tubular shape of a thickness generally matching the lower end face of 531 of main body 502, having its upper face 515 profiled to match and mate with the similarly profiled lower end face 531 of main body 503 to form body/adaptor cam pair 540 of configuration 4 in Table 1 comprised then of body cam 541 and lower adaptor cam 542. As will be apparent from a review of Table 1, the term "cam pair" encompasses variants in which the cam pair has zero pitch intended to allow only rotational movement without an accompanying axial displacement. Referring now to FIG. 14, the profile of cam pair 540 again follows a 'saw tooth' shape, which provides the same general helical functions, coupling axial stroke to left and right hand rotation, as already explained with reference to FIGS. 5 and 6, which shape provides bi-directional torque activation in this preferred embodiment of rig floor reaction tool 500.

Thus configured, and referring now to FIG. 37, rig floor reaction tool 500 responds to right hand rotation applied to work piece 1 by movement constrained by the pitch of the mating right hand helix surfaces of the saw tooth profile provided by cam pair 540, thus causing the main body to rotate and move axially upward bringing the jaw cam dogs 508 into contact with lower end face 521 of upper adaptor cam plate 520 thus forming the jaw/adaptor cam pair 524 of configuration 4 of Table 1 and reacting further axial component of the helical movement caused by rotation into downward stroke of the slips 505 in the slip bowl ramp surface 504, causing the wedge-grip force to increase and thus react torque. It will be apparent that the dimensions of the various interacting components are selected to ensure the jaw cam dogs 508 will both land below the upper adaptor cam plate 520 when the slips are set, not contact the upper face end 532 of main body 503, and not intersect the notches 523 when the tool 500 is rotation activated. However, to more systematically ensure the jaw cam dogs 508 align with the notches 523 provided in the upper adaptor cam plate 520, particularly after the application of torque which may possibly cause the slips 505 to rotate in the ramp surface 504 of main body 503 under say conditions of inadequate lubrication, the upper face end 532 may be arranged to generally extend to overlap with the interval in which the jaw cam dogs 508, but have pockets (not shown) in which the jaw cam dogs 508 can locate when the slips are set. This means of keying the jaw cam dogs 508 to the main body 503 results in an architecture consistent with configuration 5 of Table 1 where the jaws are generally constrained to prevent relative rotation but yet move axially with respect to the main body 503.

This configuration of rig floor reaction tool 500 further ensures the weight of main body 512 in combination with the string weight carried by work piece 501 acts through the cam pair 540 returns the main body 512 to its set position when torque loads causing rotation are removed. For applications where gravity loads are not axially aligned with the tool, as for example on slant rigs or pipeline horizontal directional drilling (HDD) rigs, or otherwise insufficient, means to otherwise orient and reset the position of cam pair 540 may be provided such as a compression spring (not shown) to act between upper end face 532 of main body 503 adaptor cam plate 520.

Rig floor reaction tool 500 is used in tubular running operations in a manner similar to rig floor slips, where the slips 505 are set in the slip bowl or ramp surface 504, around the proximal segment of the tubular string (work piece 501) being handled, to support the string weight through the rig floor, and removed when the string weight is supported through the derrick and the string is being raised or lowered into the well bore. However, unlike conventional slips, where torque applied to the work piece 501 in either direction with the slips set, as occurs in operational steps such as connection make up or break out, tends to cause unrestrained rotation of the slips in the slip bowl, torque applied to the work piece 501 supported by rig floor reaction tool 500, initially tends to cause rotation of the main body 512 relative to load adaptor 502 on the surface of mating surfaces of cam pair 540, which rotation is arrested by contact between the mating surfaces of cam pair 524 then causing torque activation as already described. This initial rotation and hence onset of torque activation only occurs if the tangential force of the applied torque exceeds the reaction torque generated by the axial load carried by cam pair 540 which relationship is controlled by selection of the helix pitches of cam pair 540 in combination with other geometry and frictional variables to promote adequate torque activation at low axial load and simultaneously prevent excess torque activation at high axial load which might otherwise crush the work piece under the action of the radial forces generated by the wedge-grip mechanism.

In an operation using a top drive to assemble a tubular or casing string, comprised of conventionally oriented box up pin down threaded pipe segments, the tubular running tool and the rig floor reaction tools of the present invention may both be used to advantage as will now be described with reference to both FIGS. 1 and 34, for the external grip configuration of the tubular running tool 1 of FIG. 1 and the similarly externally gripping rig floor reaction tool 500 of FIG. 34.

With tubular or tubular running tool 1, attached to a top drive and in its latched position, a rig floor reaction tool 500 positioned to act as rig floor slips supporting a portion of a partially assembled casing string, a pipe segment, being tubular work piece 1, is positioned coaxially under the tubular running tool 1 and separately supported as by a handling system or say single joint elevators.

The tubular running tool 1 is then lowered over the upper proximal end of the tubular work piece 2 until it contacts the land surface 67 of the cage 60. Further lowering of the tool 1 tends to transfer the spring load onto the top drive providing tractional engagement between the top end of the work piece 2 and the land surface 67.

The top drive is next rotated in a direction to disengage the latch teeth 108 and 110 which action tends to rotate the main body 30 relative to the cage 60, as it is restrained from rotation by its tractional engagement with the work piece 2, which tractional engagement is arranged to be greater than the rotational drag of the seals and jaws 50 on the main body 30.

After rotation sufficient to disengage the latch teeth 108 and 110, the top drive is moved upward causing the main body 30 to move axially upward relative to the cage 60 which tends to remain in contact, at its land surface 67, with the work piece 2, under the action of the gas spring force assisted by gravity. This relative upward axial motion or stroking of the main body 30 forces the jaws 50 inward and continues until the inside grip surface 51 of the jaws 50 engage with the tubular work piece 2. Further upward movement fully transfers the remaining gas spring load from the top drive to be reacted across the jaws 50 so as to activate and pre-stress them, gripping the work piece 2 in cooperation with axial hoisting load which may now be applied to lift the tubular work piece 2 or pipe segment independent of the handling arm or single joint elevators.

The top drive and perhaps other tubular handling equipment is next manipulated to coaxially align with and engage the pin thread at the lower end of the work piece 2 pipe segment into the mating box threads at the proximal end of work piece 501 being itself the proximal joint of the casing string already assembled, extending in to the well bore and supported axially at the drill floor by a rig floor reaction tool 500, where unlike operations using conventional slips, back up tongs are not required, saving time and reducing human risk.

The top drive is next rotated and make up torque transferred through the tubular running tool 1, which torque if of sufficient magnitude will cause the jaws 50 to slide relative to the main body 30 and rotate until the cage cam 101 engages the body cam 102 attached to the main body 30 substantively preventing further relative rotation between the jaws 50 and main body 30 while torque activating the grip force, i.e., tightening the grip in proportion to the applied torque, tending to prevent slippage between the jaws 50 and work piece 2 pipe segment enabling make up of the threaded connection to the prescribed torque.

Concurrently, the similar torque activated gripping behaviour of the rig floor reaction tool 500 reacts this torque at the rig floor where some rotation of the main body may occur. After make up torque is released, the main body rotation occurring in the rig floor reaction tool tends to reverse. Here again, the step of removing the back up tongs as required when using conventional slips is eliminated.

Hoisting load of the tubular string is now transferred through the axially load activated grip of tubular running tool 1, as the string is raised to release the slips 505 and the string subsequently lowered into the well bore the length of the most recently added pipe segment and the slips 505 again set to support the string weight preparatory to disengagement of the tubular running tool 1. As for engagement, disengagement of the tool 1 will typically require a combination of rotational and axial movements with associated loads. The exact relationship is defined by the torque activating cam profile and details of the load history. Where the cam helix angle or pitch is selected to have a modest mechanical advantage, the jaws 50 will tend to pop-back or release as external load is released in which case application of axial load alone will tend to complete this action. It will be apparent that these and many other variables controlling the geometry, frictional and other characteristics of the tool may be manipulated to meet the load carrying, space, weight and functional requirements of tubular running applications.

Torque Activated Collet Cage Grip Tubular Running Tool

An internal gripping tubular running tool is disclosed by the present inventor in U.S. Pat. No. 6,732,822, having a grip architecture that employs an axially load activated expansive element ("pressure member") to expand a collet-cage ("flexible cylindrical cage") into tractional contact with the interior surface of a tubular work piece. While the tubular running tool and collet-cage grip architecture described there enjoys many advantages, it does not enjoy the advantages of torque activation provided by the method of the present invention. It is therefore a yet further purpose of the present invention to provide a tubular running tool having such a collet-cage gripping assembly with torque activation. This embodiment of a tubular running tool is shown in FIG. 38 and generally designated by the numeral 700. Since details of this grip mechanism and general use in a running tool are already described in U.S. Pat. No. 6,732,822 the description here will give emphasis to the components and mechanics supporting torque activation.

Referring now to FIG. 39, tool 700 is shown in cross-section as it would appear inserted into tubular work piece 701 where collet cage gripping assembly 702 is engaged with the interior surface 703 of work piece 701. Collet cage gripping assembly 702 is comprised of generally axi-symmetric and tubular collet cage 704, having upper and lower ends 705 and 706 respectively exterior surface 721 and mid-body 707, coaxially assembled with load nut 708, expansive element 605 and setting stud 709, which three components are generally tubular, close fitting with and located on the interior of collet cage 704 in order from lower to upper. Referring now to FIG. 38, mid-body 707 of collet cage 704 is slit with generally square wave slits 719 to form strips 720 attached at upper and lower ends 705 and 706 respectively so that this interval acts as a double-ended collet, i.e., two individual collets with finger ends attached, and is provided with grip surface 722 on exterior surface 721. Referring again to FIG. 39, expansive element 605 is configured as already described with reference to FIG. 32. Referring again to FIG. 39, lower end 706 of collet cage 704 is provided with an internal upset, creating profiled upward facing shoulder 710 mating with the lower end face 711 of load nut 708 together forming body/grip cam pair 712 profiled here as a sawtooth. The upper end face 713 of load nut 708 mates with the lower end face 639 of expansion element 605 providing flat body/expansion cam pair 715. Setting stud 709 threadingly engages with collet cage 704 at the interior of upper end 705 through setting threads 716, and is arranged so that its lower end face 717 mates with the upper face 638 of expansive element 605 as setting stud 709 is rotated so as to tighten against expansive element 605. Generally axi-symmetric and elongate mandrel 730, acting here as the main body, is provided, having upper and lower ends 731 and 732, and is coaxially placed inside gripping assembly 702. Mandrel 730 is rigidly connected at its lower end 732 to load nut 708, and is suitably adapted at its upper end 731 for connection directly or indirectly, as through a load adaptor or actuator sleeve, to a top drive quill, but shown here as box connection 733, having a bore 734 and means to seal with the interior surface 703 of work piece 701 at its lower end 732, supporting communication of fluids into and out of the work piece 701 when connected to a tubular string being run into our out of a borehole. Means are also provided to tighten setting stud 709, where such means include, manual torque wrenching, power torque wrenching which can be provided separately or integral with the tool 700 and mechanically through the operation of an actuator sleeve as described in U.S. Pat. No. 6,732,822.

Thus configured, expansive element 605 is confined at its lower end face 639 by upward facing shoulder 710 so that tightening of setting stud 709 tends to compress expansive element 605, which axial load is reacted through collet cage 704, causing spring element 635 to radially expand against the interior of mid-body 707 of collet cage 704 and with continued tightening of setting stud 709 then also expand the mid-body 707. The exterior surface 721 of collet cage 702 is arranged to be close fitting with the interior surface 703 of work piece 701, prior to tightening of setting stud 709 so that gripping element may be inserted into work piece 701, tightening of setting stud 709 then resulting in expansion of grip surface 722 into engagement with work interior surface 703 to set the tool 700. As described in U.S. Pat. No. 6,732,822, hoisting load applied through mandrel 730 tends to further axially stroke mandrel 730 relative to grip surface 722 increasing the radially force on grip surface 722 pressing it into tractional engagement with work piece 701 and resisting slippage. However, as not there disclosed, and referring now to FIG. 40, under application of right hand rotation or torque load to mandrel 730, load nut 708 tends to rotate relative to the lower end 706 of collet cage 704, which rotation results in axial displacement through the action of saw tooth body/grip cam pair 712, and according to the teaching of the present invention, provides torque activation by tending to stroke the mandrel 730 relative to grip surface 722. Similarly, the saw-tooth profile also supports torque activation from left hand torque.

Tri-Cam Axial Extension to Provide Gripping Tool with Improved Operational Range and Capacity.

The linkage acting between the body assembly and gripping assembly is adapted to link relative rotation between the load adaptor and grip surface into axial stroke of the gripping assembly and hence radial stroke of the grip surface. The axial load activated grip mechanism is thus arranged to allow relative rotation between one or both of axial load carrying interfaces between the load adaptor and main body or main body and grip element which relative rotation is limited by at least one rotationally activated linkage mechanism which links relative rotation between the load adaptor and grip surface into axial stroke of the grip element and hence radial stroke of the grip surface. The linkage mechanism or mechanisms may be configured to provide this relationship between rotation and axial stroke in numerous ways such as with pivoting linkage arms or rocker bodies acting between the body assembly and gripping assembly but can also be provided in the form of cam pairs acting between the grip element and at least one of the main body or load transfer adaptor to thus readily accommodate and transmit the axial and torsional loads causing, or tending to cause, rotation and to promote the development of the radial grip force. The cam pairs, acting generally in the manner of a cam and cam follower, having contact surfaces are arranged in the preferred embodiment to link their combined relative rotation, in at least one direction, into axial stroke of the grip element in a direction tending to tighten the grip, which axial stroke thus has the same effect as and acts in combination with axial stroke induced by axial load carried by the grip element. Application of relative rotation between the drive head or reaction frame and grip surface in contact with the work piece, in at least one direction, thus causes radial stroke or radial displacement of the grip surface into engagement with the work piece with correlative axial, torque and radial forces then arising such that the radial grip force at the grip surface enables reaction of torque into the work piece, which arrangement comprises torsional load activation so that together with the said axial load activation, the grip mechanism is self-activated in response to bi-axial combined loading in at least one axial and at least one tangential or torsional direction.

In the description which follows, we adopt the convention of referring to the "drive" and "driven" cams as a convenience to provide a reference for the relative motions and forces described. These are not to be understood as restrictive with respect to application so that in general the cam systems being described can be inverted.

Referring now to FIG. 42A, cam assembly 801 is shown schematically in a two dimensional representation where the axial and tangential directions are shown as ordinate and abscissa respectively in the plot provided with FIG. 42A. Tangential position thus represents circumferential location and tangential displacement represents rotation. Cam pair 804 is represented by mating multi-start right hand helical load surfaces 805, shown here as two starts with an intermediate helical angle, and two start left hand helical load surfaces 806, shown here with relatively shallow helix angle, i.e., smaller pitch than helical load surfaces 805, where the intersection of helical load surfaces 805 and 806 form cusps or peaks 807. It is apparent that as relative rotation is increased in a right hand direction, left hand helical load surfaces 806 are engaged where the engaged tangential contact length "C" decreases while relative axial separation "Z" (axial stroke) between the driving and driven cams increases until a limiting position is reached where further rotation would result in the peaks riding over each other. Because the cam pair must also transmit load, the limiting position actually occurs when the amount of contact is insufficient to bear the required load allowing a total displacement represented by vector R in the plot shown where the axial component of R equals Z, i.e., axial stroke. Referring now to FIG. 42B, this same limitation is shown for cam assembly 801 as it would appear under application of left hand rotation to drive cam body 802 relative to driven cam body 803 causing right hand helical load surfaces 805 to be active where the total displacement is represented by vector L. There are thus limits to the axial stroke and load capacity (represented by dimensions Z and C respectively in FIG. 42A and FIG. 42B) of such a bi-rotary single cam pair, especially when combined with other competing design variables such as preferred pitch or helix angles governing both left and right hand activation as is apparent by comparing cam pair 804 in FIG. 42A and FIG. 42B under right hand and left hand rotation respectively. While such single cam pair configurations providing axial stroke as a function of imposed relative bi-directional rotation provide substantial utility, in certain applications yet more stroke and load capacity are desirable.

It is one purpose of this aspect of the present invention to provide means to reduce this limitation in operating range and capacity inherent to bi-directional single cam pairs which means is thus adaptable to any of the linkages referred to as a "cam" in Table 1. Referring now to FIG. 43, the improved cam architecture of the present invention (again shown in a schematic two dimensional representation where the axial and tangential directions are shown as ordinate and abscissa respectively) provides tri-cam assembly 810, having drive cam body 812, driven cam body 813 and at least one intermediate cam body 814 to act between the drive cam body 812 and driven cam body 813; and is thus referred to herein as a tri-cam architecture. A drive cam pair 815 is provided to act between the drive and intermediate cams, 812 and 814 respectively, and a driven cam pair 816, is provided to act between the intermediate and driven cams, 814 and 813 respectively. Drive cam pair 815 is comprised of mating stop dogs 817 defined by relatively steep helical angle (here shown as vertical) mating dog stop surfaces 818 and relatively shallow left hand helix angle mating helical dog ramp surfaces 819 where the mating helical dog ramp surfaces 819 also act continuous with mating load threads 820. Driven cam pair 816 is comprised of mating load ramps 821 defined by relatively steep helical angle mating ramp stop surfaces 822 (here shown as vertical) and right hand mating helical load ramp surfaces 823, here shown as having an intermediate helix angle (similar to that of right hand helical load surfaces 805 illustrated for cam pair 804 of FIG. 41).

Referring now to FIG. 44A, tri-cam assembly 810 is shown as it would appear under application of some right hand rotation causing relative displacement of drive cam pair 815 initially causing separation of dog stop surfaces 818 and under sufficient rotation also causing separation of dog ramp surfaces 819 so that the load is completely carried by mating load threads 820 at a displacement or over a range indicated by vector R. It will now be apparent that under right hand rotation the axial stroke and load capacity of load cam pair 815 are not limited to the usable contact length of helical dog ramp surfaces 819 but are only limited by load threads 820 which can be readily arranged to provide sufficient engaged length and strength to provide adequate strength with virtually unlimited axial stroke, effectively removing these as limitations for design purposes. In fact, dog ramp surfaces 819 are redundant and need not be engaged at all.

Referring still to FIG. 44A, the helix angles of load ramps 821 and ramp stop surfaces 822 defining driven cam pair 816 are selected with respect to the helix angle of load threads 820, and other variables such as friction coefficient as will be apparent to one skilled in the art, so that under the action of advancing or retracting right hand rotation, no displacement occurs in driven cam pair 816.

Referring now to FIG. 44B, cam assembly 810 is shown as it would appear under application of left hand rotation of drive cam body 812 relative to driven cam body 813. In this case driven cam pair 816 is active and functions in a manner analogous to that already described for drive cam pair 815 with load ramp helix directions reversed. Application of left hand rotation to drive cam body 812 causes ramp stop surfaces 821 to separate and correlatively sliding contact on helical load surfaces 823 causes intermediate cam body 814 and drive cam body 812 to displace axially upward relative to driven cam body 813 providing displacement over a range indicated by vector L. Axial and left hand torque load, carried by tri-cam assembly 810, is reacted through drive cam pair 815 where stop dogs 817, through selection of the helix angle on contacting dog stop surfaces 818 and positioning, can be arranged to control the manner in which load is reacted through drive cam pair 815 to control stress and prevent torsional load from tending to thread lock intermediate cam body 814 to drive cam body 812 in consequence of their coupling through load thread 820, i.e., thread frictional locking in the manner of a nut and bolt. Also, similar to the behaviour under right hand rotation already described, the helix angle of load ramps 821 is selected with respect to the helix angle of load threads 820, so that under the action of advancing or retracting left hand rotation, no displacement occurs in drive cam pair 815.

It will now be apparent that tri-cam assembly 810 provides two cam pairs (drive cam pair 815 and driven cam pair 816): the first active and providing axial stroke under right hand rotation while the second is static; and the second active and providing axial stroke under left hand rotation while the first is static.

Comparing displacement vectors R & L between FIGS. 42A & 42B with 44A and 44B respectively, illustrates that for comparable geometric parameters a greater axial stroke can be achieved under both right and left hand rotation with drive and driven cam pairs 815 and 816 (FIGS. 44A & 44B) of the tri-cam architecture 810 than can be achieved with a single bi-directional cam pair 804 (FIGS. 42A & 42B).

Referring again to FIG. 44B, given the above teaching incorporating load threads 820 into the drive cam pair 815, it will now be apparent that load threads can be provided to act in coordination with mating helical load surfaces 823 to increase stroke and load capacity; however in certain applications as can occur with tubular running tools, it is advantageous to allow free separation of the drive and driven cam bodies 812 and 813 respectively, which is allowed by the illustrated configuration shown in FIG. 44C where intermediate cam body 814 remains coupled by load threads 820 to drive cam body 812 but is not so coupled to driven cam body 813 allowing free separation as might be required to ensure grip activation under application of axial load without concurrent rotation when tri-cam assembly 810 is used in say the Base (Configuration 1) architecture of a gripping tool as shown in FIG. 41. As an intermediate architecture (not shown), where load threads coupling driven cam body 813 and intermediate cam body 814 are desirable, yet some degree of similar freedom for axial separation is also required, the load threads can be provided with substantial backlash. It will be evident to one skilled in the art that for single start threads this backlash is only limited by the thread pitch less the required thread tooth thicknesses so that substantial free axial separation can be achieved for applications where relatively larger pitch can be accommodated, i.e., applications where low helix angle is not required.

As an additional intermediate architecture (not shown), both cam pairs could be arranged as dog ramp surfaces continuous with load threads (with a small backlash), and as such would be referred to as a quad-cam architecture (not shown). The quad-cam architecture would be arranged with a fourth cam component constrained to allow axial movement but not rotational movement relative to the driven cam and rigidly attached to the grip assembly such that on release of the latch, the cam assembly retains the ability to freely stroke axially to engage the work piece under a biasing load. Such an arrangement would be beneficial if a stroke greater than could be accommodated on the tri-cam architecture (specifically limited by the driven cam pair arrangement) was required.

Referring again to FIG. 44B, the summation of axial height and hence strength capacity of stop dogs 817 will be seen to be a function of pitch or helix angle selected for mating load threads 820 (and similarly dog ramp surfaces 819), so that for applications where low thread helix angle is advantageous it becomes more difficult to ensure sufficient strength to react left hand torsional load is achieved through stops dogs 817 with correlatively low axial height. For such applications, it is a further purpose of the present invention to provide means to overcome this limitation by replacing intermediate cam body 814 in tri-cam assembly 810, referring now to FIG. 45A, with intermediate cam assembly 830 acting between drive cam body 812 and driven cam body 813. Intermediate cam assembly 830 is comprised of supplementary stop dog boost ring 831 and intermediate cam tube 832, where dog boost cam pair 833 is provided to act between stop dog ring 831 and intermediate cam tube 832. Dog boost cam pair 833 having boost ramp surfaces 834 and boost catch surfaces 835. In general, intermediate cam assembly 830 acts in the same manner as intermediate cam 814 under application of right and left hand rotation, as already described with reference to FIGS. 44A and 44B for tri-cam assembly 810. Comparing now FIGS. 44B and 45A, the action of stop dog boost ring 831 under application of left hand torque is evident where left hand torque causes stop dog ring 831 to ride up on boost ramp surfaces 834 inducing full engagement of dog stop surfaces 818, such that the engaged height of dog stop surfaces 818 is thus arranged to be greater where the dog boost ring architecture is employed. It will also be apparent that the helix angle of boost ramp surfaces is selected in coordination with the helix angle of dog stop surfaces 818 to induce the indicated full engagement of dog stop surfaces 818 under left hand rotation and similarly the engaged length of boost ramp surfaces 834 are correlatively arranged to have sufficient strength to support the load reacted through dog stop surfaces 818. Referring now to FIG. 45B showing tri-cam assembly 830 under modest right hand rotation, stop dog boost ring 831 is shown fully slid down boost ramp surfaces 34 (cam pair 833 in fully retracted position) as it can be variously induced to move by: prior contact with dog ramp surfaces 819 under right hand rotation (where the helix angle of dog ramp surfaces 819 is selected in coordination with the helix angle of boost catch surfaces 834 to induce such movement); gravity; or a biasing spring (not shown) applying a retracting force relative to intermediate cam tube 832. With respect to this position, cam pair 815 is arranged so that dog stop surfaces 818 have a degree of overlap great enough to 'catch' if left hand rotation is applied but 'clear' under application of additional right hand rotation causing additional axial stroke under constraint of load thread 820 as illustratively shown in FIG. 45C.

Referring now to FIG. 44C, in certain applications it is desirable to constrain the free axial separation allowed between the drive and driven cam bodies 812 and 813 respectively by providing a latch. It is therefore an additional purpose of the present invention to provide a latch operative with the tri-cam architecture supporting latching of drive cam body 812 to driven cam body 813 as illustratively shown in FIG. 46A, where latch 840 is illustrated with tri-cam 810 again in two dimensional representation where the radial planes in which the features of latch 840 occur will in general differ from those in which tri-cam 810 occur. Latch ring 841 is a generally tubular body close fitting with and co-axially mounted on driven cam body 813 having right hand helical slots 842 in which close fitting latch keys 843 are placed where latch keys 843 are rigidly attached to driven cam body 13 which arrangement constrains latch ring 841 to only move between an axially extended and retracted position relative to driven cam body 813, defining the latch stroke, along a helical path defined by the selected length of helical slots 842 relative to the length of latch keys 843. Latch cam pair 847 is provided to act between latch ring 841 and drive cam body 812 and is defined by generally mating profiled latch hooks 844 having a height selected to be somewhat less than the selected latch stroke, and having back surfaces 845. Latch hooks 844 are shown in their engaged position in FIG. 46A, and thus arranged, prevent axial separation of drive cam body 812 and driven cam body 813 where axial load that might otherwise act to separate is reacted from drive cam body 812 through latch hooks 844 into latch ring 841 and into latch keys 843 as constrained by helical slots 842 and from latch keys 843 into driven cam body 813 to which latch keys 843 are attached. However, upon right hand rotation, referring now to FIG. 46B, latch hooks 844 tend to disengage and latch ring 841 is free to retract as allowed by keys 843 in right hand helical slots 842 where retraction can be variously induced by: gravity; biasing spring 846 acting between latch ring 841 and driven cam body 813; or with sufficient rotation, contact of hook back surfaces 845 with helix angle of mating hook back surfaces 845 selected with respect to helix angle of slots 842 to induce retracting forces. Upon left hand rotation and with cam pair 816 mated as shown in FIG. 46B, i.e., no axial separation, sufficient engagement of latch hooks 844 is yet arranged to re-latch hooks 844. However, if drive cam body 812 is first raised causing axial separation sufficient to prevent engagement of latch hooks 844 then left hand rotation applied, referring now to FIG. 46C, re-latching is prevented and cam pair 816 is active to cause axial stroke.

As illustrated and described with reference to FIG. 46A through 46C the cam assembly operating procedure, starting in the latched position, can be described in two steps as follows:

1. Set tool down (into work piece)
2. Turn to right (to disengage latch and engage drive cam pair)

Where in order to use the tool to breakout joints by engaging the driven cam pair, two additional steps are required as follows:

3. Pickup on tool
4. Turn to left (to engage driven cam pair)

The operating procedure to disengage the tool from the work-piece is similarly simple and also requires two or three steps from the makeup or breakout ramps respectively, as follows:

1. Set down tool
2. Turn to left (to retract grip assembly and engage latch)

Where in order to latch the tool from the driven cam pair one additional step is required, as follows:

1a. Turn to the right to engage the drive cam pair, then proceed to step 1.

Given the simplicity of the operating procedure, it is possible that an unanticipated or unintentional event could lead to sufficient left hand torque, rotation and compression being applied to the tool simultaneously to engage the latch and that if such events were sufficiently frequent that the risk of unplanned latching and consequently disengagement of the grip assembly from the work piece may be unacceptable. In such applications where it is desirable to constrain the free axial separation allowed between the drive and driven cam bodies, by providing a latch particularly to support insertion and removal of fully mechanical gripping tools, it may also be desirable to prevent unintentional engagement of the latch. To that end, it is a further purpose of the present invention to provide a lockout mechanism operative with tri-cam and latch architecture of FIGS. 44 and 46A through 46C respectively. A further preferred embodiment of the present invention is illustrated in two dimensional schematic views and described with reference to FIGS. 47A through 47F. This embodiment is an integral internal mechanical lockout, design to incorporate lockout function into the cam assembly of FIG. 46A through 46C. The lockout equipped cam assembly operating procedure can be described in six steps as follows:

1. Set tool down (into work-piece)
2. Turn to right (to disengage latch)
3. Pickup (to clear latch hooks)
4. Turn to Left (to engage driven cam pair)
5. Set tool down (to compress spring)
6. Turn to right (to engage lockout, engage drive cam pair, and grip work piece)

Where an additional step is required to breakout joints, as follows:

7. Turn to left (to engage driven cam pair, and grip the work piece)

The operating procedure to disengage the lockout and latch the tool from the makeup position also requires six steps as follows:

1. Set down (to ensure engagement of drive cam pair)
2. Turn to left (to disengage casing and unlock tool)
3. Pickup (to allow latch to spring back)
4. Turn to right (to go back to the drive cam pair)
5. Set down (set down to engage the drive cam pair)
6 Turn to left (to retract the grip assembly and latch tool)

If starting from engagement on the driven cam pair one additional step is required, as follows:

1a. Turn to the right to engage the drive cam pair, then proceed to step 1.

It is evident from the above procedure description that additional steps reduce the risk of unintentional disengagement by increasing operational complexity.

Referring now to FIG. 47A, showing the tri-cam architecture with integral mechanical latch in a schematic two dimensional representation as it would appear with the latch engaged. The tri-cam assembly with lockout has drive cam body 812, driven cam body 813, intermediate cam body 814 and latch 840. Latch cam pair 847 is provided to act between latch body 841 and drive cam body 812 and is defined by generally mating profiled latch hooks 844. Latch hook profile 845 of latch body 841 includes lockout dog 861 on top face 862 and latch hook profile 845 of drive cam body 812 has generally mating lockout dog pocket 863 on bottom face 864 and lockout dog clearance on top face 869. The angles of lockout dog faces 865 and 866 are selected in conjunction with the angle of lockout dog pocket faces 867 and 868, and the geometry of key slots 842 to facilitate engagement of lockout, disengagement of lockout and latch body clearance during makeup. Key slots 842 of latch body 841 and keys 843 rigidly attached to driven cam 813, have lockout face pair 870 comprised of generally mating lockout faces 871 and 872. The angle of lockout faces 871 and 872 is selected in conjunction with the angle of load threads 820 to eliminate unintentional release of lockout due to vibration and to reduce positional uncertainty of lockout dog 861 engagement with toe of latch hook profile 845 of drive cam body 812. Driven cam 813 has stroke limited, pre-stressed compression spring 873, when latch 840 is disengaged biasing spring 846 pushes face 874 latch body 841 into contact with spring stop 875. The spring rate and pre-stress of compressive spring 873 is selected in conjunction with the spring rate and pre-stress of biasing spring 846 such that spring 873 does not compress past the initial pre-stress position under the load of the biasing spring 846 and any incidental loads including component weight.

Referring now to FIG. 47B which shows the cam assembly of FIG. 47A in a schematic two dimensional representation as it would appear with latch disengaged and the latch hook faces in contact, compressive spring 873 remains fully extended and contact with latch body 841 positions it such that the hook faces of latch hook profile 845 are overlapping and slidingly engaged. Keys 843 are positioned in the helical section 877 of key slot 842 such that right hand rotation will cause the latch hook profile to become disengaged and left hand rotation will cause latch body 841 to slide helically on key slots 842 and engage the hook of latch hook profile 845, by extending biasing spring 846 to position the assembly as shown in FIG. 47A.

Referring now to FIG. 47C which illustratively shows the cam assembly of FIG. 47A in a schematic two dimensional representation as it would appear with latch disengaged and under application of left hand torque with helical load ramp surfaces 823 of driven cam pair 816 engaged and helical dog ramp surfaces 819 and mating stop dog surfaces 818 of drive cam pair 815 engaged.

Referring now to FIG. 47D which illustratively shows the cam assembly of FIG. 47A in a schematic two dimensional representation as it would appear under compressive load after engagement on the driven cam pair 816. All mating faces of both drive cam pair 815 and driven cam pair 816 are engaged and cam assembly 810 is under compression. Face 874 of latch body 841 is engaged on spring stop 875 and compressive spring 873 is compressed passed the pre-stress position. Keys 843 are positioned in the helical section 877 of the key slot 842. Lockout dog 861 is engaged in lockout dog pocket 863. application of right hand rotation to the drive cam will move the latch body 841 into the lockout position by bringing the faces 871 and 872 of lockout pair 870 into engagement.

Referring now to FIG. 47E which illustratively shows the cam assembly of FIG. 47A in a schematic two dimensional representation as it would appear with the latch 840 locked out and the drive cam 812 and latch body 841 positioned to disengage the lockout with application with application of left hand rotation relative to the driven cam 813. The toe of latch profile 845 of drive cam 812 is slidingly engaged on face 865 of lockout dog 861, and left hand rotation along the drive cam pitch will result in a similar movement of latch body 841 relative to driven cam 813 and intermediate cam 814, subsequent positive axial movement of the drive cam 812 will cause key 843 to move from lockout section 876 into the helical section 877 of key slot 842.

Referring now to FIG. 47F which illustratively shows the cam assembly of FIG. 47A in a schematic two dimensional representation as it would appear locked out and with right hand rotation applied to the drive cam 812 relative to driven cam 813 and intermediate cam 814. It is understood that, as shown, in the locked out position, both the drive cam pair 815 and the driven cam pair 816 can be active.

It will now be apparent that the integral mechanical lockout architecture of the present invention is well adapted to stop the unintentional latching of the tri-cam architecture of the present invention, due to the reduced likelihood of the additional steps required in the latching sequence occurring unintentionally.

It is understood that the latch can be lockout by a number of means including but not limited to mechanical and hydraulic.

Other arrangements of latching between drive cam body 812 and driven cam body 813 can be similarly provided. One such configuration (not shown) biases latch ring 841 in the normally extended position. Upon right hand rotation latch ring 841 tends to be push latch hooks 844 out of engagement. Latch hooks are shaped and distributed to prevent partial engagement at intermediate rotational positions (within one turn or less) where partial engagement preventing left hand rotation would otherwise occur, as allowed by the pitch of load thread 820 and the selected height of latch hooks 844.

It will now be apparent that the latching tri-cam architecture of the present invention is well adapted to support the provision of additional radial stroke as might be advantageous with externally gripping tools such as shown in FIG. 41, where for example it is typically desirable to grip coupled tubulars having a range of sizes below the coupling.

Internally Gripping (Internal Grip) Tubular Running Tool Tri-cam Architecture

Referring to FIG. 48 through 53B, there will now be described a preferred embodiment of an improved gripping tool referred to here as an "internal grip tubular running tool with tri-cam architecture". Referring now to FIG. 48, showing an external view of the tubular running tool of the preferred embodiment generally designated by the numeral 900 and shown as it would appear in the latched configuration, having body assembly 910, and grip element assembly 920.

Referring now to FIG. 49, showing a cross sectional view of tubular running tool 900 as it would appear in the latched configuration internal to and co-radially located with proximal end 901 of work-piece 902. Tubular running tool 900 is configured at its upper end 905 for connection to a top drive quill, or the distal end of such drive string components as may be attached thereto, (not shown) by load adaptor 912 integral to mandrel 930, so that mandrel 930 acts as the main body of running tool 900. Load adaptor 912 is generally axi-symmetric and made from a suitably strong material. It has an upper end 921 configured with internal threads 922 suitable for sealing connection to a top drive quill, with internal through bore 923 continuous with mandrel 930.

Referring still to FIG. 49, tubular running tool 900 has body assembly 910 comprised of an elongate generally cylindrical mandrel 930 having upper end 931, lower end 932 with external frusto-conical surfaces 933, and internal bore 936. Mandrel 930 has body thread 934 and spline element 935 at upper end 931. Tubular running tool 900 is provided with lock ring 940 having spline section 942 at lower end 941. Lock ring 940 is here shown having generally tubular external sleeve 984 external to and close fitting with load adaptor 912, where external sleeve 984 is provided to protect load adaptor 912 from tong damage. Mandrel 930 carries an internal axially activated grip assembly 920 having an elongate and generally cylindrical lower end 909 inserted and coaxially located within the upper proximal end 901 of a tubular work piece 902. Grip assembly 920 is comprised of cage 944, with upper end 945 and lower end 946, and having thread element 947 at lower end 946, axial retention groove 948, and a plurality of radially oriented windows 949 placed around the circumference at lower end 946, in which jaws 960 are disposed. Generally elongate jaws 960, with upper end 961, lower end 962, inner surface 963 outer grip surface 964 and parallel sides (not shown), have a plurality of frusto-conical contact faces 966 on inner surface 963 that engage with mating frusto-conical surfaces 933 of mandrel 930 forming slip interface 914 acting to provide radial stroke to jaws 960 in response to axial activation.

Referring still to FIG. 49, tubular running tool 900 has bi-rotary to axial stroke activation tri-cam latching linkage 1000 generally configured with tri-cam architecture and includes drive cam body 1020, driven cam body 1060, and intermediate cam body 1040. Linkage 1000 acts between mandrel 930 and grip assembly 920 and is contained by housing assembly 980 including drive and driven cam housings 981 and 982 respectively. Tri-cam latching linkage 1000 functions and is generally arranged as previously described in reference to schematic FIG. 43 through 44C and 46A through 46C.

Referring now to FIG. 50A, showing linkage 1000 in the latched configuration, which assembly is provided with drive cam body 1020 having upper end 1022. Referring now to FIG. 50B, showing a cross section view of tri-cam assembly 1000 in the latched configuration, tri-cam assembly 1000 has drive cam body 1020 with lower end 1023, external surface 1024 and internal surface 1025, and one or more torque lugs 1026 (here shown as eight) at upper end 1022. Internal surface 1025 of drive cam body 1020 has thread element 1027 at upper end 1022 and seal element 1028 at lower end 1023. Referring again to FIG. 49, body thread 934 on mandrel 930 threadingly engages thread element 1027 on drive cam body 1020, while seal element 1028 sealingly engages external surface of mandrel 930. Spline section 942 of lock ring 940 meshingly engages both the torque lugs (not visible in this section view, but shown in FIG. 50B referenced with numeral 1026) on drive cam body 1020 and spline element 935 on mandrel 930 such that drive cam body 1020 is structurally and rigidly attached to and prevented from moving both axially and circumferentially relative to mandrel 930. Referring again to FIG. 50B, bottom face 1029 of drive cam body 1020 contains repeating latch hooks 1030. The outside surface 1024 of drive cam body 1020 contains a plurality of load threads 1031 at lower end 1023. Load threads 1031 are generally comprised of a push thread with load flank 1033 and stab flank 1034. Drive cam body 1020 has seal element 1036 on external surface 1024 at upper end 1022. Referring again to FIG. 50A, drive cam body 1020 has dog stop surfaces 1032 and dog ramp surfaces 1037 located on downward facing shoulder 1096 external surface 1024 at upper end 1022.

Referring still to FIG. 50A, intermediate cam body 1040 with upper end 1041, lower end 1042, inside surface (not shown) and outside surface 1044, has one or more dog stop surfaces 1045 (shown here as three) at upper end 1041 that engage with dog stop surfaces 1032 at upper end 1022 of drive cam body 1020 collectively forming dog stop surface pair 1055. Also at upper end 1041 of intermediate cam body 1040 are one or more (shown as three) dog ramp surface 1056 which mate with and slidingly engage dog ramp surface 1037 of drive cam body 1020 collectively forming dog ramp surface pair 1057. Referring again to FIG. 50B, intermediate cam body 1040 has load threads 1046 (shown here as a multi-start thread form with thread lead matching helix pitch of dog ramp surfaces 1056) on inside surface 1043 at upper end 1041, which threads are arranged as push threads with load flank 1047 and stab flank 1048, and mate with and slidingly engage load threads 1031 of drive cam body 1020 forming load thread pair 1068, and thus combined with dog stop surface pair 1055 and dog ramp surface pair 1057 collectively forming drive cam pair 1049. Referring now to FIG. 50A, intermediate cam body 1040 has one or more (here shown as six) helical load ramp surfaces 1050 located adjacent to and co-radial with an equal number stop load surfaces 1051 at lower end 1042.

Referring still to FIG. 50A, driven cam body 1060 with upper end 1061, lower end 1062, and outside surface 1063 has a plurality of helical load ramp surfaces 1065 located adjacent to and co-radial with stop load surfaces 1066 on upper end 1061. Helical load ramp surfaces 1065 and stop load surfaces 1066 of driven cam body 1060 mate with and slidingly engage helical load ramp surfaces 1050 and stop load surfaces 1051 of intermediate cam body 1040 collectively forming driven cam pair 1067. Referring now to FIG. 50B, driven cam body 1060 has one or more torque lugs 1069 in this case twelve (12), on bottom face 1070 at lower end 1062. Referring now to FIG. 49, torque lugs 1069 of driven cam body 1060 mate with torque lugs 943 at the upper end 945 of cage 944 and in this embodiment bolted together at bolt holes 1097 (bolts not shown) to structurally and rigidly connect driven cam body 1060 to cage 944. Referring again to FIG. 50B, on the inside surface 1064 at the lower end 1062 of driven cam body 1060 is seal element 1073 and upward facing shoulder 1074, while on the outside surface 1063 at lower end 1062 is seal element 1075.

Referring still to FIG. 50B, cam assembly 1000 has generally tubular shaped latch ring 1100 with upper end 1101, lower end 1102, and inside surface 1103. Referring now to FIG. 51, showing an assembly of drive cam body 1020, latch ring 1100 and latch keys 1090, latch ring 1100 has a plurality of helical latch key pockets 1105 (here shown as six) which can be evenly spaced circumferentially on outside surface 1104. Latch key pockets 1105 have inner face 1106, load face 1107, and helical sliding cam faces 1109 and 1110. Inner face 1106 of latch key pocket 1105 has pin clearance slot 1108 that extends to inside surface 1103 of latch ring 1100. Referring again to FIG. 50B, at the lower end 1102 of latch ring 1100 on the inside surface 1103 is upward facing shoulder 1115. The top face 1112 at the upper end 1101 of latch cam 1100 has repeating latch hooks 1113. Latch hooks 1113 on latch cam 1100 mates with the latch hooks 1130 on the bottom face 1129 of drive cam body 1020, collectively forming latch hook pair 1114, latch hooks 1030 and 1113 are selected such that when engaged latch hook pair 1114 prevents relative axial separation of driven cam body 1060 relative to drive cam body 1020.

Referring again to FIG. 51A, latch ring 1100 is assembled such that latch keys 1090 are located internal to latch key pockets 1105. Referring now to FIG. 51B, showing a partial cutaway view of a partial cam assembly including driven cam ring 1060, latch ring 1100, latch pins 1137, latch keys 1090, and spring elements 1146 and 1149, latch pins 1137 and latch lugs 1138 (not shown in this view) are rigidly attached to driven cam body 1060 and extend through said cam body to slidingly engage shear pin holes 1091 in latch key 1090. Referring now to FIG. 50A radially oriented latch pin 1137 in combination with radially oriented latch lug 1138, which is not aligned in the same radial plane as latch pin 1137, collectively restrain movement of latch key 1090 relative to driven cam body 1060. so that latch ring 1100 is constrained to move helically relative to the driven cam body 1060 by an amount defined by the relative axial length difference between, referring again to FIG. 51A, the latch key 1090 and latch key pocket 1105. Referring again to FIG. 51B, latch pin 1137 with inside ends 1139 extend through clearance slot 1108 in latch key pocket 1105, and slidingly engage retainer ring pin holes 1123 in retainer ring 1120 and collectively constrain movement of retainer ring 1120 relative to driven cam ring 1060. Referring again to FIG. 51A, as assembled load faces 1093 of latch key 1090 and load face 1107 of latch ring 1100 collectively form load face pair 1115, such that when latched axial load is transferred from the driven cam body 1020 (not visible in this view) to the latch ring 1100 though load face pair 1115. Helical sliding cam faces 1096 and 1097 of latch key 1090 and helical cam faces 1109 and 1110 of latch ring 1100, collectively form helical sliding cam face pairs 1117 and 1118 respectively, such that when latch keys 1090 are moving up or down relative to latch ring 1100, cam face pair 1118 or 1117 respectively is engaged. Referring now to FIG. 51C, showing a partial assembly including drive cam 1020, latch ring 1100, and latch key 1090 as it would appear upon initial right hand rotation of drive cam 1020, latch ring 1100 tends to be pushed downward to the position shown where hooks 1114 still slightly overlap 1116 to facilitate re-latching under left hand rotation, as explained with reference to FIG. 46B, but yet not interfere under subsequent right hand rotation causing axial stroke as constrained by movement along load thread 1031.

Referring again to FIG. 50B, tri-cam assembly 1000 can have spring element 1146, in this case a coil spring located internal to latch ring 1100 and acting in compression between spring retaining ring 1120 and latch ring 1100, such that spring element 1146 typically works in conjunction with gravity and functions to bias the latch ring 1100 in the axial downward position.

Referring again to FIG. 49 tri-cam assembly 1000 is located internal to cam housing assembly 980 comprised of driven cam housing 981 rigidly attached to driven cam 1060 and sealingly engaged with seal element 1075 and drive cam housing 982 rigidly attached drive cam 1020 and sealingly engaged with seal element 1036, housing assembly 980 provides a sealed cam chamber 983 allowing compressed gas to be added to chamber 983 to function as a spring that will tend to force grip assembly 922 into engagement with work piece 902 upon disengagement of latch 1095.

Referring now to FIG. 50A, showing tri-cam assembly 1000 in an external view as it would appear in the latched position, where drive cam body 1020, driven cam body 1060 are at the minimum axial spacing such that drive cam pair (not shown), dog stop surface pair 1055 and dog ramp surface pair 1057 of drive and intermediate cam bodies 1020 and 1040 respectively are engaged and driven cam pair 1067 of intermediate and driven cam bodies 1040 and 1060 respectively, are engaged. Referring now to FIG. 50B, showing a cross sectional view of tri-cam assembly 810 in the latched configuration, provided a latch ring 1100, which latch 1095 is located internal to and co-radially with tri-cam assembly 1000 and is described previously in reference to FIG. 46A through 46C. Latch 295 provides the means to prevent the free axial separation of drive and driven cam bodies 1020 and 1060 respectively.

Referring now to FIG. 52A, showing an external view of tri-cam assembly 1000 as it would appear under application of right hand torque, drive cam pair 1049 is engaged and drive cam body 1020 has undergone two thirds of a turn relative to driven cam body 1060 and intermediate cam body 1040. Stop load surface pair 1068 and driven cam pair 1067 are engaged reacting both axial and torsional load between driven and intermediate cam bodies 1060 and 1040 respectively. Referring now to FIG. 52B, showing a cross sectional view of tri-cam assembly 1000 as it would appear under application of right hand torque as previously described with reference to FIG. 52A. Latch 1095 has disengaged and latch ring 1100 is in the downward position as biased by gravity (in this orientation) and spring element 1146, such that the bottom end 1102 of latch ring 1100 is engaged on spring element 1149. Spring element 1149 is a relatively stiff spring, in this case a Belleville washer stack comprised of three Belleville washers arranged in parallel and preloaded in compression such that the combined force of the biasing elements acting on latch ring 1100 are small relative to the preload of spring element 1149 and as such the position of spring element 1149 is known and consequently the axial position of the downward biased latch ring 1100 is also known. Spring element 1149 functions to prevent overload of latch hooks 1114 in the event that compressive load is applied to tri-cam assembly 1000 with only limited latch hook pair 1114 engagement. Left hand helical drive cam pair 1055, in this case is six start American buttress push thread form, allows rotation causing axial stroke in excess of one full rotation which is greater than would be possible with single bi-rotary cam pair as described with reference to FIGS. 42A and 42B.

Referring now to FIG. 53A, showing an external view of tri-cam assembly 1000 as it would appear with latch 1095 disengaged and under application of left hand torque, driven cam pair 1067 is engaged and drive and intermediate cam bodies 1020 and 1040 respectively have undergone a relatively small amount of rotation with respect to driven cam body 1060. Dog stop surface pair 1055 and helical dog ramp surface pair 1057 have engaged to react axial and torsional load between drive cam body 1020 and intermediate cam body 1040. Referring now to FIG. 53B, showing a cross sectional view of tri-cam assembly 1000 as it would appear with latch 1095 disengaged and under application of left hand torque, latch ring 1100 is in the downward position such that bottom end 1102 of latch ring 1100 is in contact with spring element 1149. To move tri-cam assembly 1000 from the latched configuration as previously described with reference to FIGS. 49A and 49B to the configuration shown in FIGS. 53A and 52B right hand torque needs to first be applied to disengage latch 1095 then axial displacement is applied sufficient to move latch hooks 1114 out of range of overlap (see FIG. 51B) such that under applied left hand torque, driven cam pair 1067 will engage without interference of the latch hooks 1114. Referring again to FIG. 49, the axial stroke required to move latch hooks 1114 out of range of engagement is arranged to fall within the dead stroke of the tool, i.e., the axial stroke required before possible engagement of grip assembly 920 on work-piece 902. Right hand helical driven cam pair 1067, in this case a six start ramp provides axial stroke and torsion load under left hand rotation at an intermediate cam angle and also provides free axial separation of intermediate and driven cam bodies 1040 and 1060 respectively if latch 1095 is disengaged, allowing axial stroke of gripping tool 900 to act to grip work piece 902 under action of applied axial load independent of rotation.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. An improvement in a gripping tool having a gripping assembly with a grip surface carried by movable grip elements to radially move the grip surface from a retracted to an extended position, the gripping assembly being activated by axial movement, the improvement comprising:

a tri-cam linkage comprising a drive cam body, a driven cam body and at least one intermediate cam body, the drive cam body and the at least one intermediate cam body providing a drive cam pair with a cam surface on the drive cam body engaging a first cam surface on the at least one intermediate cam body, the at least one intermediate cam body and the driven cam body providing a driven cam pair with a second cam surface on the at least one intermediate cam body acting in opposition to the first cam surface and engaging a cam surface on the driven cam body, the tri-cam linkage acting between a body of the gripping tool and the gripping assembly translating bi-rotary movement in either a clockwise or counterclockwise direction of the body relative to the grip surface into axial movement to drive axial stroke activation of the gripping assembly.

2. An improvement in a gripping tool having a gripping assembly with a grip surface carried by movable grip elements to radially move the grip surface from a retracted to an extended position, the gripping assembly being activated by axial movement, the improvement comprising:

a tri-cam linkage comprising a drive cam body, a driven cam body and at least one intermediate cam body, the drive cam body and the at least one intermediate cam body providing a drive cam pair with a cam surface on the drive cam body engaging a first cam surface on the at least one intermediate cam body, the at least one intermediate cam body and the driven cam body providing a driven cam pair with a second cam surface on the at least one intermediate cam body acting in opposition to the first cam surface and engaging a cam surface on the driven cam body, the tri-cam linkage acting between a body of the gripping tool and the gripping assembly translating bi-rotary movement in either a clockwise or counterclockwise direction of the body relative to the grip surface into axial movement to drive axial stroke activation of the gripping assembly;

wherein the drive cam pair is arranged to only be active to cause axial stroke as a function of rotation under a first direction of rotation and the driven cam pair under the second direction of rotation, which separation of bi-rotary activation into two cam pairs facilitates providing greater axial stroke and correlatively radial stroke of the grip surface than is possible where a single cam pair is employed in a bi-rotary activated linkage.

3. The improvement of claim 1, wherein the tri-cam linkage is arranged with a latch that when engaged will prevent axial stroke activation of the tri-cam linkage.

4. The improvement of claim 3, wherein the tri-cam linkage is provided with a mechanical lockout comprising a lockout dog on one portion of the latch and a mating lockout dog pocket on another portion of the latch that when activated prevent engagement of the latch.

5. A gripping tool, comprising:

at least one body including an associated load adaptor adapted to be connected to and interact with one of a drive head or reaction frame;

a gripping assembly carried by the at least one body and having at least one grip surface adapted to move from a retracted position to an engaged position to radially engage the grip surface with a work piece upon relative axial displacement of the at least one body relative to the grip surface in at least one axial direction; and a tri-cam linkage acting between the at least one body and the gripping assembly, the tri-cam linkage comprising a drive cam body, a driven cam body and at least one intermediate cam body, the drive cam body and the at least one intermediate cam body providing a drive cam pair with a cam surface on the drive cam body engaging a first cam surface on the at least one intermediate cam body, the at least one intermediate cam body and the driven cam body providing a driven cam pair with a second cam surface on the at least one intermediate cam body acting in opposition to the first cam surface and engaging a cam surface on the driven cam body, the tri-cam linkage translating bi-rotary movement in either a clockwise or counterclockwise direction of the load adaptor relative to the grip surface into axial movement to drive axial stroke activation of the gripping assembly.

* * * * *